US010388215B2

(12) United States Patent
Matsueda et al.

(10) Patent No.: US 10,388,215 B2
(45) Date of Patent: Aug. 20, 2019

(54) DISPLAY DEVICE AND ORGANIC LIGHT EMITTING DEVICE

(71) Applicant: NLT Technologies, Ltd., Kanagawa (JP)

(72) Inventors: Yojiro Matsueda, Kanagawa (JP); Yoshihiro Nonaka, Kanagawa (JP); Kenichi Takatori, Kanagawa (JP)

(73) Assignee: TIANMA JAPAN, LTD., Kanagawa (JP)

( * ) Notice: Subject to any disclaimer, the term of this patent is extended or adjusted under 35 U.S.C. 154(b) by 177 days.

(21) Appl. No.: 15/350,476

(22) Filed: Nov. 14, 2016

(65) Prior Publication Data

US 2017/0132974 A1 May 11, 2017

(30) Foreign Application Priority Data

Nov. 11, 2015 (JP) ..... 2015-221413

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2300/0426* (2013.01); *G09G 2300/0861* (2013.01); *G09G 2310/062* (2013.01); *G09G 2310/08* (2013.01); *G09G 2320/0214* (2013.01); *G09G 2320/0626* (2013.01); *G09G 2320/0666* (2013.01); *G09G 2320/0673* (2013.01)

(58) Field of Classification Search
None
See application file for complete search history.

(56) References Cited

U.S. PATENT DOCUMENTS

| | | | |
|---|---|---|---|
| 2010/0060176 | A1 | 3/2010 | Takahashi et al. |
| 2012/0187425 | A1 | 7/2012 | Omoto |
| 2013/0140589 | A1 | 6/2013 | Kwak |

FOREIGN PATENT DOCUMENTS

| | | |
|---|---|---|
| JP | 2004-361737 | 12/2004 |
| JP | 2010-66331 | 3/2010 |
| JP | 2010-281872 | 12/2010 |

(Continued)

OTHER PUBLICATIONS

Japanese Office Action for Application No. 2015-221413 dated Jun. 11, 2019 with English translation provided.

*Primary Examiner* — Gustavo Polo
(74) *Attorney, Agent, or Firm* — Young & Thompson

(57) ABSTRACT

Provided is an OLED display device preventing an occurrence of a crosstalk using a simple structure.

A display device includes: a display unit that includes a plurality of pixel circuits each including an organic light emitting element; a control unit that applies electric potential to the pixel circuits for a first period, and that controls emission luminance of the organic light emitting elements for a second period after the first period; and an application unit that applies a voltage of less than or equal to a threshold voltage of the organic light emitting element before a start of the second period in which the organic light emitting element has internal capacitance to maintain an electric potential difference between the anode electrode and the cathode electrode for a vertical scanning period in which a displayed image to be refreshed when the control unit controls the organic light emitting element not to emit light.

16 Claims, 33 Drawing Sheets

(56) References Cited

FOREIGN PATENT DOCUMENTS

| | | |
|---|---|---|
| JP | 2012-155953 | 8/2012 |
| JP | 2013-118182 | 6/2013 |
| JP | 2014-197466 | 10/2014 |

DISPLAY DEVICE AND ORGANIC LIGHT EMITTING DEVICE

CROSS-REFERENCE TO RELATED APPLICATIONS

This non-provisional application claims priority under 35 U.S.C. § 119(a) on Patent Application No. 2015-221413 filed in Japan on Nov. 11, 2015, the entire contents of which are hereby incorporated by reference.

FIELD

The present disclosure relates to a display device and an organic light emitting device.

BACKGROUND

Organic electric field light emitting display devices each displaying a color image by using organic light emitting elements of three colors including red, green, and blue are used.

In description presented below, organic electric field light emission may be described as organic electroluminescence (EL).

There are cases where a crosstalk phenomenon occurs in which an organic light emitting element that is originally to be in a non-emitting state emits light. In description presented below, such a crosstalk phenomenon will be described as a crosstalk.

In a case where a crosstalk occurs, a problem such as a decrease in the resolution due to blurring of an image displayed in an OLED (organic light emitting diode) display device, an appearance of a different color other than an original display color, or a decrease in the contrast ratio occurs. Such a crosstalk may occur not only in an organic light emitting element that is in a non-light emitting state according to black display data but also in an organic light emitting element that is in a low-luminance light emitting state according to display data close to black.

In Japanese Patent Application Laid-Open No. 2012-155953 (hereinafter, referred to as Patent Document 1), Japanese Patent Application Laid-Open No. 2013-118182 (hereinafter, referred to as Patent Document 2), and Japanese Patent Application Laid-Open No. 2014-197466 (hereinafter, referred to as Patent Document 3), OLED display devices preventing a crosstalk by arranging a crosstalk preventing electrode set to less electric potential at the periphery of each organic light emitting element have been disclosed.

Each of OLED display devices disclosed in Patent Document 1 to Patent Document 3 includes a crosstalk preventing electrode at the periphery of each organic light emitting element. Due to this electrode, the structure of each organic light emitting element becomes complex.

SUMMARY

According to one aspect, there is provided a display device including: a display unit that includes a plurality of pixel circuits each including both an organic light emitting element including a light emitting layer that emits light by a current flowing between an anode electrode and a cathode electrode and a control element controlling the current; a control unit that applies electric potential according to an image signal to the pixel circuits for a first period, and that controls emission luminance of the organic light emitting elements based on the electric potential by means of the control elements for a second period after the first period; and an application unit that applies a voltage of less than or equal to a threshold voltage of the organic light emitting element to the anode electrode before a start of the second period. The organic light emitting element has internal capacitance to maintain an electric potential difference between the anode electrode, the electric potential of which is applied by the application unit, and the cathode electrode at a voltage of less than or equal to the threshold voltage, for a vertical scanning period in which a displayed image to be refreshed when the control unit controls the organic light emitting element not to emit light.

It is to be understood that both the foregoing general description and the following detailed description are exemplary and explanatory and are not restrictive of this disclosure.

DETAILED DESCRIPTION

Embodiment 1

In the specification and the claims, ordinal numbers, such as "first", "second", and "third", are given in order to clarify the relationship between elements and to prevent confusion between the elements. Therefore, the ordinal numbers do not limit the number of elements.

Figure 1:
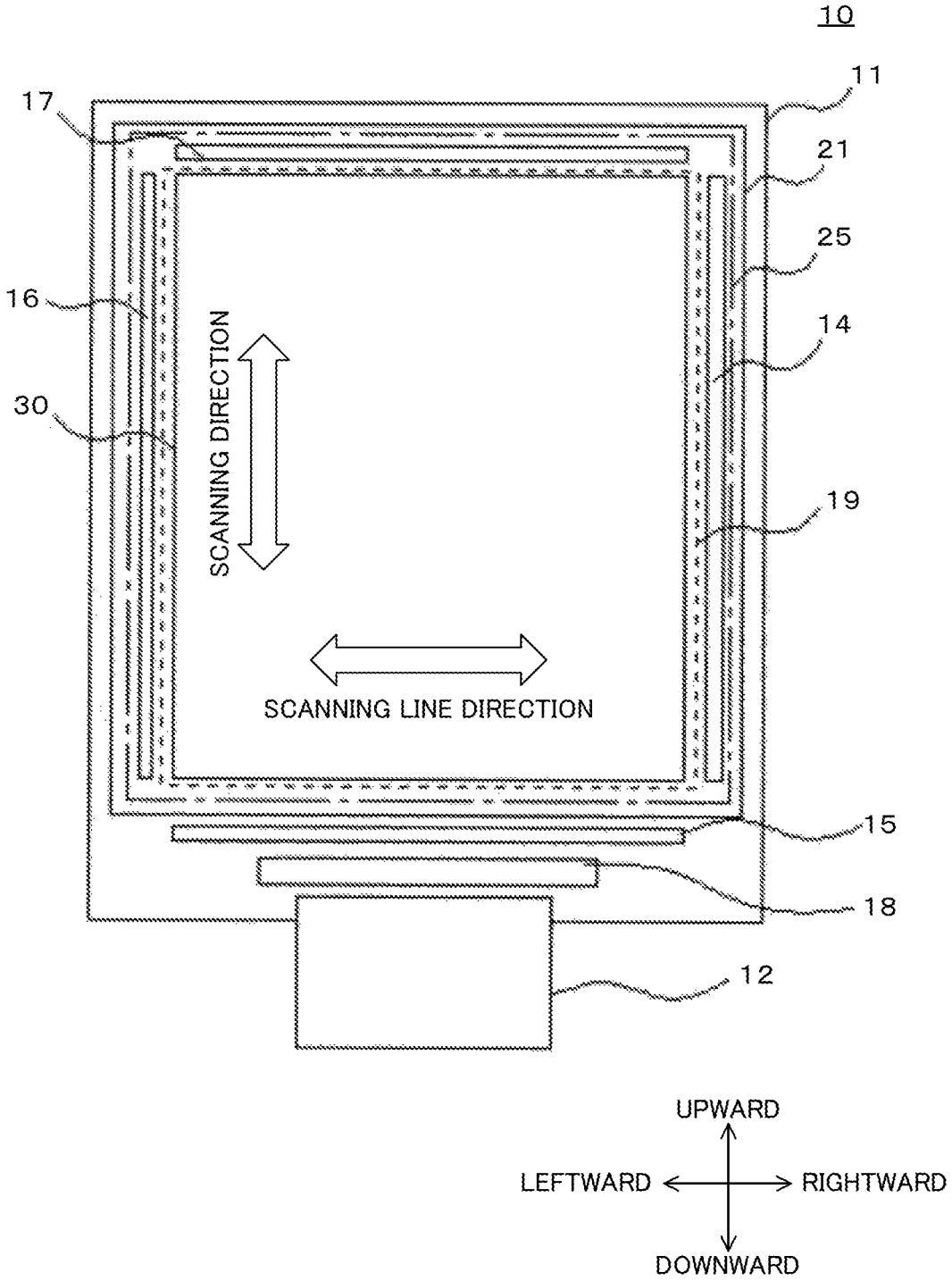
FIG. 1 is an external view of a display device.

FIG. 1 is an external view of a display device 10. FIG. 1 is a diagram viewed from the front side, in other words, an image display face side of the display device 10. The display device 10 is a device that displays a still image and a moving image. The display device 10 is built in an electronic apparatus. Examples of the electronic apparatus include a smartphone, a mobile phone, a tablet terminal, a personal computer (PC), a television set, and the like. In description presented below, forward, backward, leftward, rightward, upward, and downward directions denoted by arrows in each drawing will be used. The display device 10 according to this embodiment is an OLED display panel. The display device 10 according to this embodiment has a vertically-long rectangle shape and displays an image by scanning scanning lines arranged in the horizontal direction in the vertical direction.

The display device 10 includes a rectangular thin film transistor (TFT) substrate 11 and a flexible printed circuit (FPC) 12. The TFT substrate 11 is a substrate made of glass. In one face of the substrate, various circuits and connection terminals are formed through a semiconductor manufacturing process.

Here, the features of the semiconductor manufacturing process will be described. A semiconductor integrated circuit such as an integrated circuit (IC) is manufactured by repeating processes of film forming, development, trace element injection, and the like for the surface of a flat substrate such as a glass substrate or a silicon substrate. A manufacturing apparatus that is appropriate for each process is available in the market, and each process can be performed with positioning precision of a nanometer level and dimension precision of a nanometer level. The manufacturing apparatus repeats a thermal annealing process for controlling the improvement of film quality and device performance and a processing process using immersion into liquid such as hydrofluoric acid having high reactivity or an adhesive gas. A semiconductor manufacturing process having such features will be referred to as a semiconductor process in description presented below.

The FPC 12 is a flexible substrate that is connected to connection terminals formed in the TFT substrate 11. In the FPC 12, a connector, which is not illustrated in the drawing, connected to a control device of an electronic apparatus is mounted. The display device 10 acquires an image signal from the control device of the electronic apparatus through the connector mounted in the FPC 12.

A rectangular display unit 30 is provided in a central portion of the TFT substrate 11. In the display unit 30, a large number of organic light emitting elements 31 (see FIG. 4) are regularly arranged. The structure of the display unit 30 will be described later in detail. A common cathode electrode 19 is provided so as to cover the upper face of the display unit 30. The cathode electrode 19 is a transparent electrode, for example, made of indium tin oxide (ITO), transparent conductive ink, or Graphene.

Along four sides of the TFT substrate 11, an emission control driver 14, an application unit 15, a scan driver 16, and a protection circuit 17 are formed through a semiconductor process. Hereinafter, an overview of such a semiconductor circuit will be described.

The emission control driver 14 is formed along the right side of the TFT substrate 11. The emission control driver 14 is a circuit that controls an emission time of each organic light emitting element 31 disposed inside the display unit 30 based on an image signal acquired though the FPC 12.

The application unit 15 is formed along the lower side of the TFT substrate 11. The application unit 15 will be described later in detail.

The scan driver 16 is formed along the left side of the TFT substrate 11. The scan driver 16 is a circuit that selects and drives a scanning line of the display unit 30 based on an image signal acquired through the FPC 12. The protection circuit 17 is a circuit that prevents damage in the display panel due to discharge of static electricity or the like.

The front side of the display unit 30, the emission control driver 14, the scan driver 16, and the protection circuit 17 is covered with a sealing plate 21. The sealing plate 21 is a transparent glass plate having a rectangular shape. Along four sides of the sealing plate 21, a sealing part 25 is disposed. The sealing part 25 is a part that connects the TFT substrates 11 and the sealing plate 21 together in an airtight manner. The sealing part 25, for example, is formed through glass frit bonding using glass frit acquired by melting low-melting point glass powders or the like.

On the lower side of the application unit 15, a driver IC 18 is mounted. The driver IC 18 is an integrated circuit that processes an image signal acquired through the FPC 12 and controls the emission control driver 14, the application unit 15, and the scan driver 16. Each terminal of the driver IC 18 is connected to a connection terminal disposed in the TFT substrate 11, for example, through an anisotropic conductive film not illustrated in the drawing. The driver IC 18 is an example of a control unit according to this embodiment controlling the light emission luminance of the organic light emitting element 31.

A thick-line arrow illustrated in the vertical direction in FIG. 1 represents a scanning direction. A thick-line arrow illustrated in the horizontal direction in FIG. 1 represents a scan-line direction. The scan-line direction represents the arrangement direction of a scan signal line (see FIG. 18). As the sequence for scanning pixels 33 (see FIG. 4), the pixels may be sequentially scanned from a pixel 33 disposed at the upper side in FIG. 1 toward the lower side.

Figure 2:
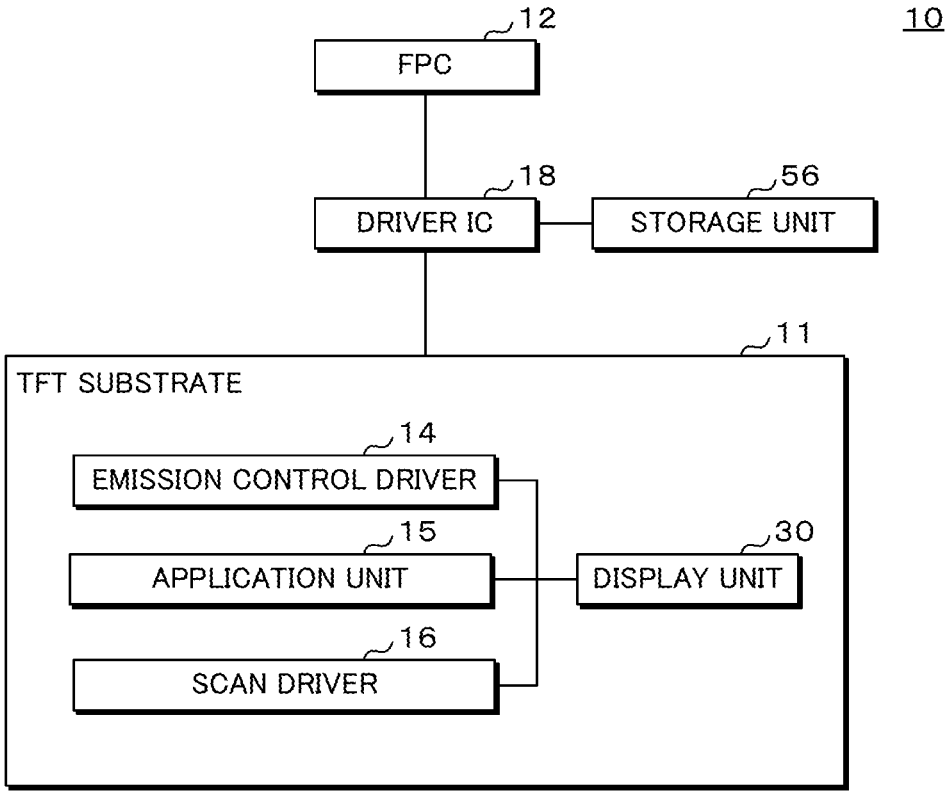
FIG. 2 is a diagram that illustrates the hardware configuration of a display device.

FIG. 2 is a diagram that illustrates the hardware configuration of the display device 10. The display device 10, in addition to the FPC 12 and the TFT substrate 11 described above, includes a storage unit 56. The storage unit 56 is a storage device such as a static random access memory (SRAM), a dynamic random access memory (DRAM), or a flash memory.

The driver IC 18 is connected between the FPC 12 and the TFT substrate 11. The storage unit 56 is connected to the driver IC 18. In addition, the storage unit 56 may be disposed inside the driver IC 18.

The driver IC 18 processes an image signal acquired through the FPC 12 and outputs a processed image signal to the emission control driver 14, the application unit 15, and the scan driver 16 of the TFT substrate 11. The emission control driver 14, the application unit 15, and the scan driver 16 control the display unit 30. A correspondence between a signal output from the driver IC 18 and a signal input to the emission control driver 14, the application unit 15, and the scan driver 16 will be described later.

Figure 3:
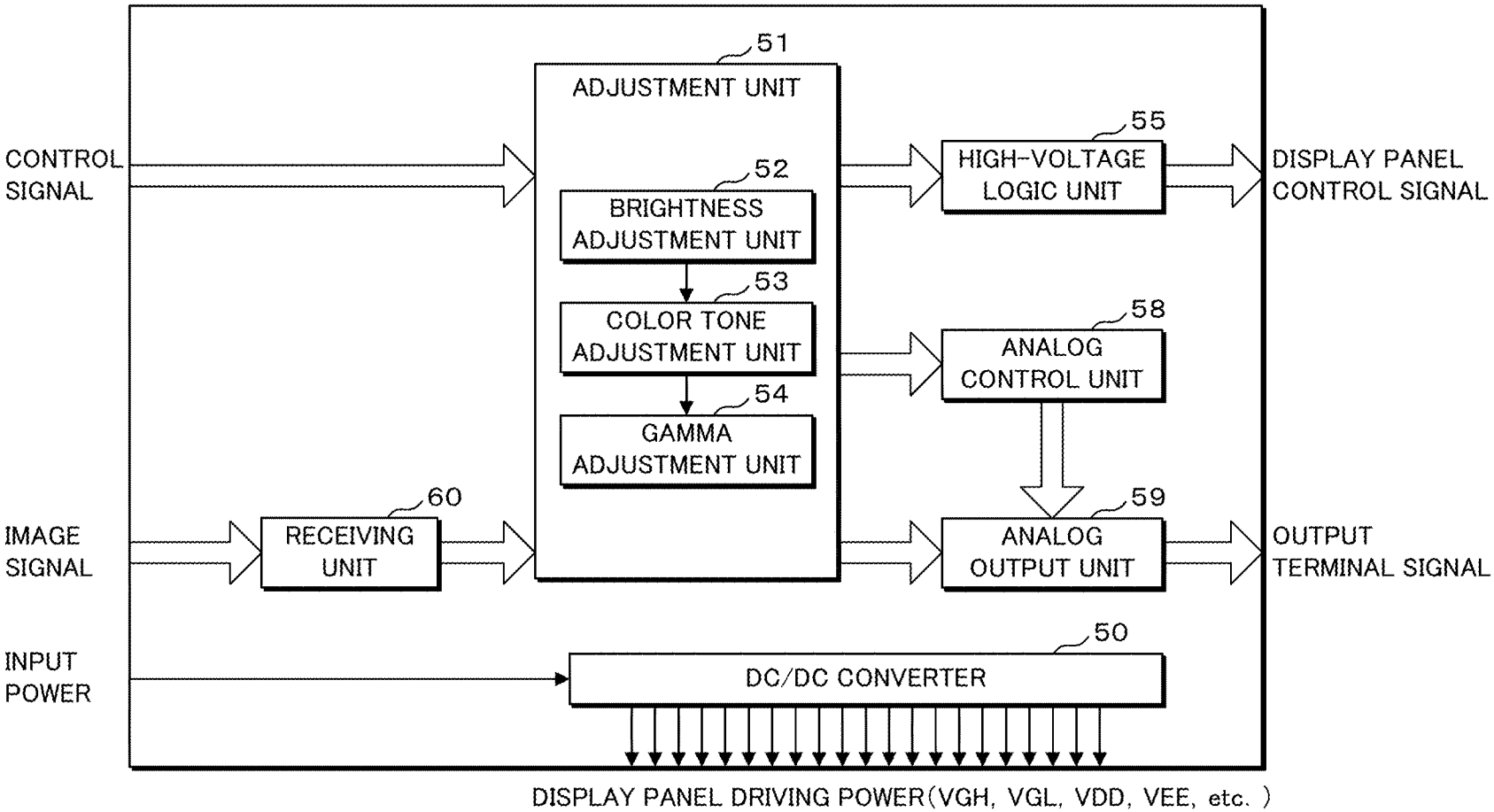
FIG. 3 is a diagram that illustrates the configuration of a driver IC.

FIG. 3 is a diagram that illustrates the configuration of the driver IC 18. The driver IC 18 includes: an adjustment unit 51; a receiving unit 60; a high-voltage logic unit 55; an analog control unit 58; an analog output unit 59; and a DC/DC converter 50. The adjustment unit 51 is a low-voltage logic circuit that can operate at a high speed. The adjustment unit 51 includes: a brightness adjustment unit 52; a color tone adjustment unit 53; and a gamma adjustment unit 54. The brightness adjustment unit 52, the color tone adjustment unit 53, and the gamma adjustment unit 54 are respectively realized by a brightness adjustment circuit, a color tone adjustment circuit, and a gamma adjustment circuit.

The adjustment unit 51 may be a processor that is mounted inside the driver IC 18. In such a case, the adjustment unit 51 reads a control program from the storage unit 56 or a nonvolatile storage device, which is not illustrated in the drawing, disposed inside the driver IC 18 and expands and executes the read control program in a DRAM, which is not illustrated in the drawing, mounted inside the driver IC 18. In this way described above, the brightness adjustment unit 52, the color tone adjustment unit 53, and the gamma adjustment unit 54 are realized.

A control signal, an image signal, and input power are supplied to the driver IC 18 through the FPC 12. The image signal, for example, is a signal that is in compliance with a standard set by a mobile industry processor interface alliance (MIPI).

The receiving unit 60 receives an image signal and outputs the received image signal to the adjustment unit 51. The brightness adjustment unit 52, the color tone adjustment unit 53, and the gamma adjustment unit 54 sequentially process an image signal based on control signals, thereby adjusting the image signal to be a signal according to the characteristics of the display device 10.

Based on an image signal processed by the adjustment unit 51, the high-voltage logic unit 55 generates a display panel control signal. The display panel control signal is a high-voltage digital signal. The high-voltage logic unit 55 outputs display panel control signals to the emission control driver 14, the application unit 15, and the scan driver 16 through wirings at the TFT substrate 11. The signals transmitted to the emission control driver 14 and the scan driver 16 operate as input signals of both the drivers. The signal transmitted to the application unit 15 operates as a timing control signal of the application unit 15.

A part of the adjustment unit 51 that generates a signal used for controlling the scan driver 16 is an example of a first switching unit according to this embodiment. In addition, a part of the adjustment unit 51 that generates a signal used for controlling the application unit 15 is an example of a second switching unit according to this embodiment.

The analog control unit 58 and the analog output unit 59 process an image signal processed by the adjustment unit 51 and output an output terminal signal. The output terminal signal is an analog signal. The analog output unit 59 outputs the output terminal signal to the display unit 30 through a wiring disposed at the TFT substrate 11 and the application unit 15. The output terminal signal operates as an analog input signal of the display unit 30.

The DC/DC converter 50 generates display panel driving power based on the image signal processed by the adjustment unit 51 and input power and supplies the generated display panel driving power to each circuit disposed at the TFT substrate 11. Each circuit is operated by the supplied display panel driving power.

The emission control driver 14, the application unit 15, and the scan driver 16 control the luminance of each organic light emitting element 31. The display unit 30 displays an image in accordance with the control process.

Figure 4:
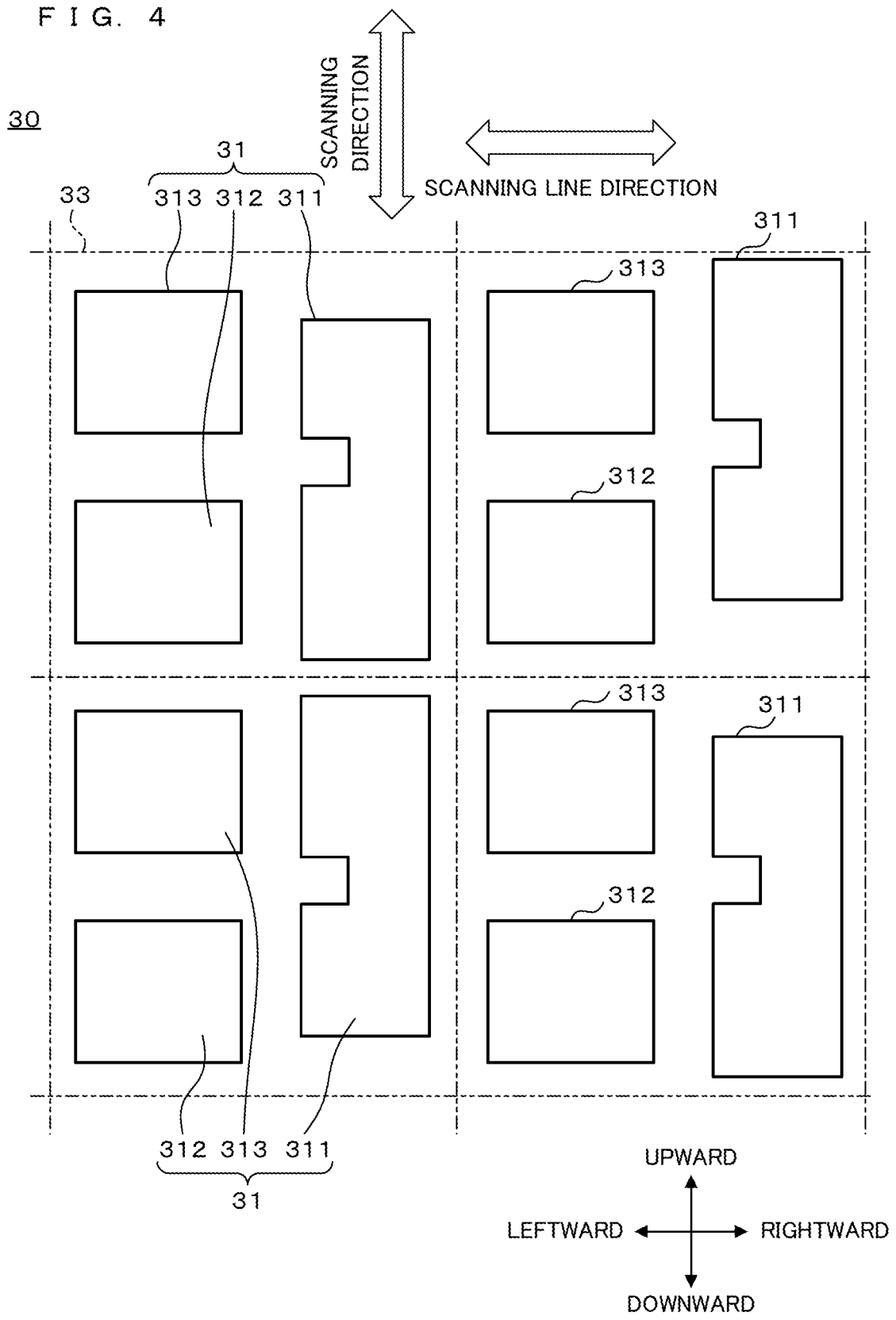
FIG. 4 is an explanatory diagram that illustrates the arrangement of organic light emitting elements.

FIG. 4 is an explanatory diagram that illustrates the arrangement of the organic light emitting elements 31. FIG. 4 illustrates a partial enlarged view of the display unit 30 viewed from the front side. In the display unit 30, three types of organic light emitting elements 31 are regularly arranged. In description presented below, each pattern having a polygon shape denoted by solid lines schematically illustrates a light emitting portion of the organic light emitting element 31.

Here, first-color organic light emitting elements 311 are organic light emitting elements 31 that emit light in a first color. In addition, second-color organic light emitting elements 312 are organic light emitting elements 31 that emit light in a second color. Third-color organic light emitting elements 313 are organic light emitting elements 31 that emit light in a third color. In the display device 10 according to this embodiment, for example, the first color is blue, the second color is green, and the third color is red.

The first-color organic light emitting elements 311 are arranged in the shape of columns in the vertical direction. Two first-color organic light emitting elements 311 are adjacent to each other in the vertical direction so as to form one set. The shape of each first-color organic light emitting element 311 is an approximate "U" shape having a dent in the left long side. This dent has an approximate square shape. The dent is dented toward the inside of the first-color organic light emitting element 311.

Each of the second-color organic light emitting element 312 and the third-color organic light emitting element 313 has a rectangular shape that has long sides along the horizontal direction, has short sides along the vertical direction, and has the sizes of the long sides and the short sides to be close to each other. The second-color organic light emitting element 312 and the third-color organic light emitting element 313 have the same dimension. The second-color organic light emitting elements 312 and the third-color organic light emitting elements 313 are alternatingly arranged in the vertical direction.

A column in which the first-color organic light emitting elements 311 are arranged and a column in which the second-color organic light emitting elements 312 and the third-color organic light emitting elements 313 are arranged are alternatingly aligned in the horizontal direction. When only a column in which the second-color organic light emitting elements 312 and the third-color organic light emitting elements 313 are arranged is seen, the second-color organic light emitting elements 312 and the third-color organic light emitting elements 313 are aligned along the direction of the long side of each organic light emitting element 31.

A set of three organic light emitting elements 31 including the first-color organic light emitting element 311, the second-color organic light emitting element 312, and the third-color organic light emitting element 313 adjacent to each other forms one pixel 33. The boundary of the pixel 33 is denoted by two-dot chain lines. The pixels 33 have an arrangement of a matrix pattern. Thus, each of the first-color organic light emitting elements 311, the second-color organic light emitting element 312, and the third-color organic light emitting element 313 each one being present in each pixel 33 has the arrangement of a matrix pattern. A predetermined space is formed between the organic light emitting elements 31. Here, the predetermined space, for example, is a space shorter than the length of one side of the organic light emitting element 31.

According to a combination of the luminance values of the first-color organic light emitting element 311, the second-color organic light emitting element 312, and the third-color organic light emitting element 313, the color and the luminance of the pixel 33 are determined. For example, in a case where the luminance values of all the organic light emitting elements 31 have maximum values, the color of the pixel 33 is white. On the other hand, in a case where all the organic light emitting elements 31 are in a non-emission state, the color of the pixel 33 is black.

A boundary line of a pixel 33 denoted by two-dot chain lines in FIG. 4 is a line passing through the center between pixels 33 adjacent to each other. The boundary line of the pixel 33 is a virtual line used for description, and a member representing the boundary between pixels 33 is not present in the display unit 30. A combination of the organic light emitting elements 31 included in one pixel 33 is determined under the control of the driver IC 18.

Figure 5:
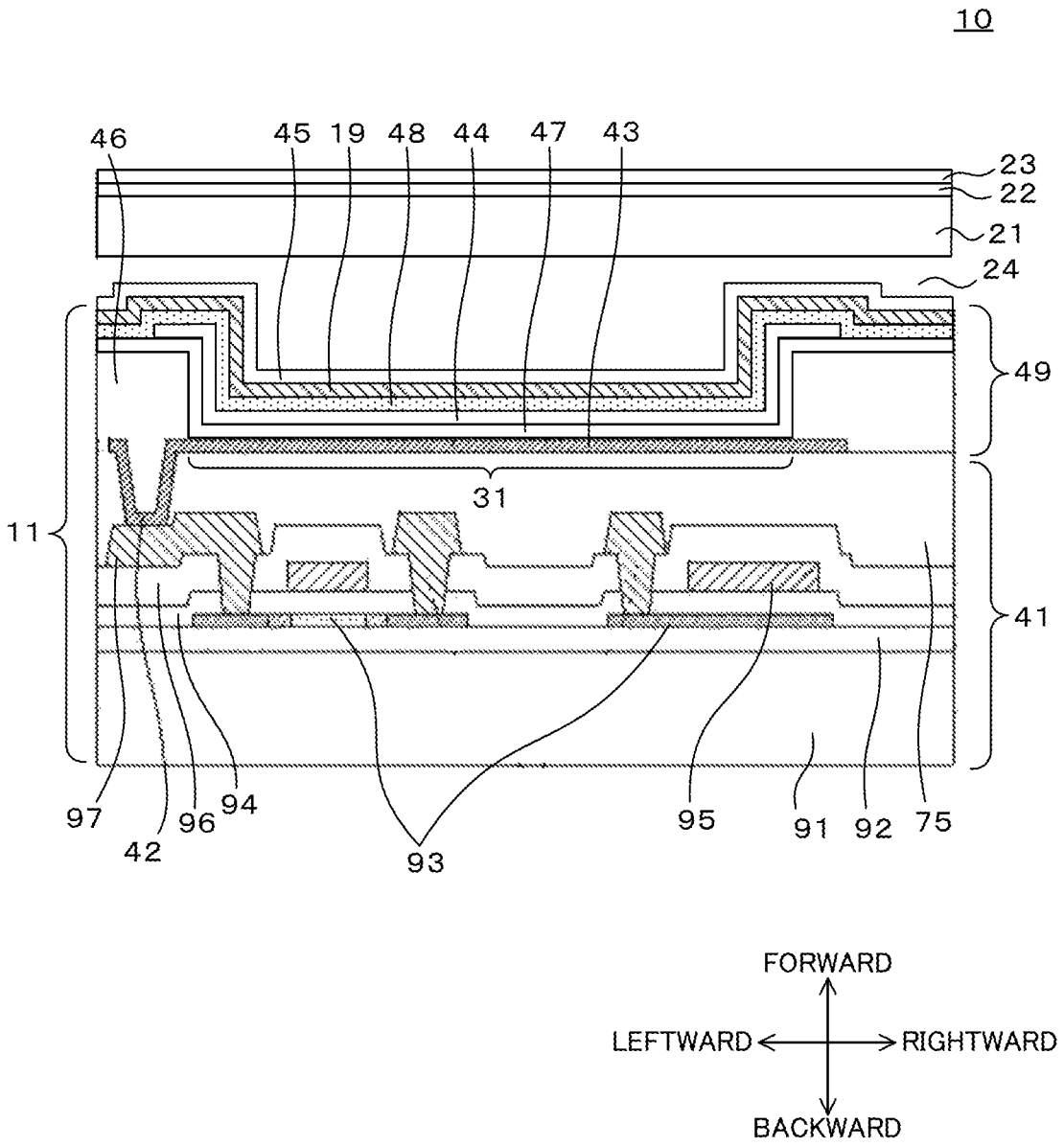
FIG. 5 is a schematic cross-sectional view of a display device.

Here, the reason for arranging the organic light emitting elements 31 as illustrated in FIG. 4 will be described. First, an overview of the structure of the organic light emitting elements 31 will be described. FIG. 5 is a schematic cross-sectional view of the display device 10.

FIG. 5 illustrates a schematic cross-sectional view of a portion of the display device 10, which includes one organic light emitting element 31, taken along a face perpendicular to a face at which an image is displayed. As described above, the display device 10 includes the TFT substrate 11 and the sealing plate 21. Between the TFT substrate 11 and the sealing plate 21, dry air 24 is sealed. On the front side of the sealing plate 21, a ¼ wavelength phase difference plate 22 and a polarizing plate 23 are disposed.

The TFT substrate 11 includes a wiring portion 41 and a pixel arranging portion 49. In the wiring portion 41, the emission control driver 14, the application unit 15, the scan driver 16, the protection circuit 17, and an electric circuit are formed through a semiconductor process. The electric circuit includes a TFT circuit output connecting portion 42. The electric circuit connects the emission control driver 14, the application unit 15, the scan driver 16, and the protection circuit 17 and stores electric charge for a predetermined period. The TFT circuit output connecting portion 42 connects the electric circuit and each organic light emitting element 31.

The wiring portion 41 includes: a light transmissive substrates 91 such as a glass substrate; an underlying insulating film 92; a polysilicon layer 93; a gate insulating film 94; a first metal layer 95; an interlayer insulating film 96; a second metal layer 97; and a flattening layer 75. The structure of the wiring portion 41 will be described later in detail.

The wiring portion 41 and the pixel arranging portion 49 are connected together through the TFT circuit output connecting portion 42. One TFT circuit output connecting portion 42 is arranged for one organic light emitting element 31.

The pixel arranging portion 49 includes: an anode electrode 43; a common layer 47; a light emitting layer 44; a cathode underlayer 48; a cathode electrode 19; a cap layer 45; and an isolation portion 46. One anode electrode 43 is connected to one TFT circuit output connecting portion 42.

The anode electrode 43 is an electrode layer that is separately disposed for each organic light emitting element 31. The isolation portion 46 is disposed at the front side of the anode electrode 43. The isolation portion 46 is an insulating layer having a rectangular hole. The isolation portion 46 covers the TFT circuit output connecting portion 42 and the edge of the anode electrode 43 but does not cover the center portion of the anode electrode 43. The organic light emitting element 31 is configured by a portion of the anode electrode 43 that is not covered with the isolation portion 46, the common layer 47 of a portion laminated at the front side thereof, the light emitting layer 44; the cathode underlayer 48, the cathode electrode 19, and the cap layer 45.

The anode electrode 43 exposed from the hole formed in the isolation portion 46 and the isolation portion 46 are covered with the common layer 47. The common layer 47 is a layer of an organic compound and, for example, has a dual layer structure of a hole injection layer and a hole transport layer. The common layer 47 is continuous between organic light emitting elements 31 adjacent to each other. In other words, the common layer 47 is a layer disposed to be common to the organic light emitting elements 31 adjacent to each other.

The center portion of the anode electrode 43 and the front side of the edge of the hole formed in the isolation portion 46 are covered with the light emitting layer 44. The light emitting layer 44 is a layer of an organic compound emitting light in one of the first color, the second color, and the third color when a voltage is applied, in other words, an OLED layer.

The OLED layer and the front side of the common layer 47 are covered with the cathode underlayer 48. The cathode underlayer 48 is a layer of an organic compound and, for example, is an electron transport layer.

On the front side of the cathode underlayer 48, the cathode electrode 19 is disposed. As described above, the cathode electrode 19 is a transparent electrode that continuously covers the organic light emitting elements 31 included in the display unit 30. In other words, the cathode electrode 19 is an electrode that is disposed to be common to the organic light emitting elements 31 adjacent to each other.

On the front side of the cathode electrode 19, the cap layer 45 is disposed. The cap layer 45, similar to the cathode electrode 19, is a layer that continuously covers the organic light emitting elements 31. The cap layer 45 is a layer of a transparent material having a high refractive index.

The operation of the organic light emitting element 31 will be described. According to the operations of the application unit 15 and the scan driver 16, a voltage is applied to the anode electrode 43 through the TFT circuit output connecting portion 42 connected to the organic light emitting element 31. According to an electric potential difference between the anode electrode 43, and the cathode electrode 19, holes are injected from the common layer 47 to the light emitting layer 44, and electrons are injected from the cathode underlayer 48 to the light emitting layer 44.

Inside the light emitting layer 44, light is generated when exciton generated according to recombination of holes and electrons are returned to a ground state. In other words, the light emitting layer 44 emits light by a current flowing between the anode electrode and the cathode electrode. This light is reflected by the anode electrode 43 and is transmitted through the cathode electrode 19 and exits to the front side of the display device 10. The organic light emitting elements 31 arranged in the display unit 30 emit light according to an image signal input from the outside, whereby the display device 10 displays an image.

In the side face of the hole of the isolation portion 46 and the light emitting layer 44 disposed at the front side of the isolation portion 46, a distance up to the anode electrode 43 is long, and holes and electrons are difficult to recombine, whereby it is difficult to emit light. For this reason, light emission occurs in a shape coinciding with a portion of the hole formed in the isolation portion 46.

The cap layer 45, the dry air 24, and the sealing plate 21 achieve the role of a protective layer preventing the light emitting layer 44, the common layer 47, and the cathode underlayer 48 from deteriorating due to humidity and the like and being damaged due to an external force.

Figure 6:
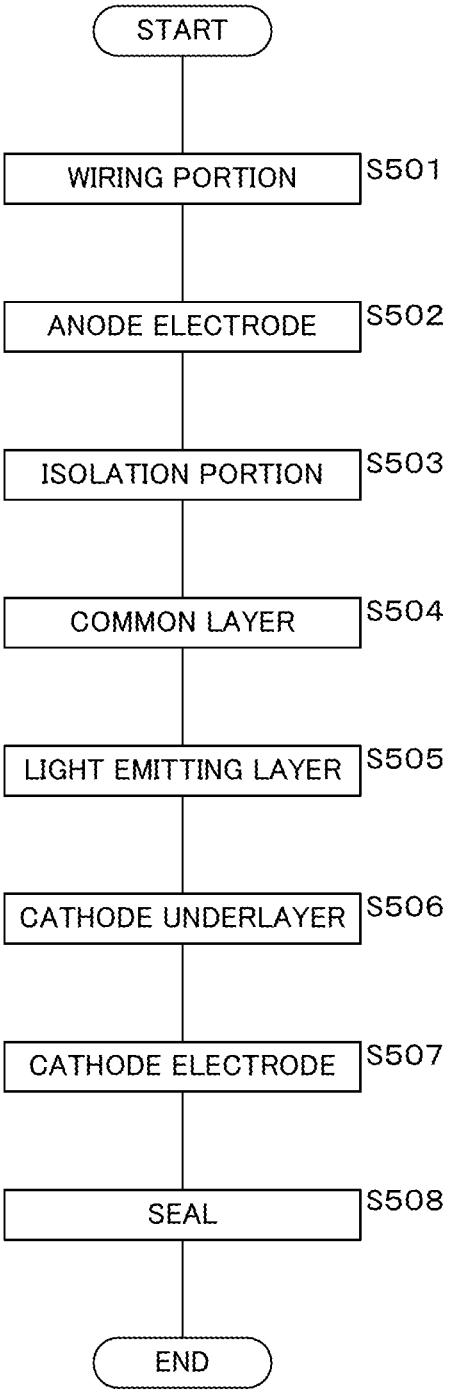
FIG. 6 is a flowchart that illustrates a manufacturing process of an OLED display panel.

FIG. 6 is a flowchart that illustrates a manufacturing process of an OLED display panel. FIGS. 7 to 17 are explanatory diagrams that illustrate the manufacturing process of the OLED display panel. An overview of a method of manufacturing the display device 10 according to this embodiment will be described with reference to FIGS. 6 to 17. Here, manufacturing apparatuses such as a deposition apparatus, a sputtering apparatus, a spin coat apparatus, an exposure apparatus, a development apparatus, an etching apparatus, a sealing apparatus, and a cutting apparatus, conveyance apparatuses connecting such apparatuses, and the like used for manufacturing the display device 10 are not illustrated in the drawings. Such apparatuses operate according to a predetermined program.

A manufacturer of the display device 10 produces a wiring portion 41 at the front side of a light transmissive substrate 91 such as a glass substrate by using a semiconductor process (Step S501). At this time, the manufacturer of the display device 10 also produces an emission control driver 14, an application unit 15, a scan driver 16, and a protection circuit 17

An overview of the process of Step S501 will be described. Hereinafter, one organic light emitting element 31 will be described as an example. The manufacturing process of the emission control driver 14, the application unit 15, the scan driver 16, and the protection circuit 17 are similar to the manufacturing process of integrated circuits that is conventionally used, and thus, description thereof will not be presented.

Figure 7:
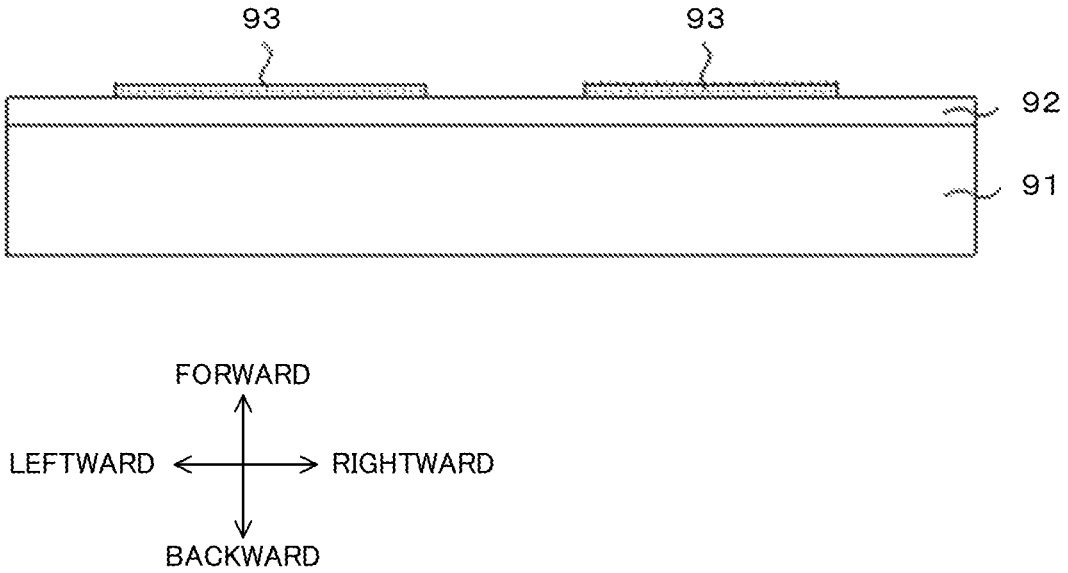
FIG. 7 is an explanatory diagram that illustrates a manufacturing process of an OLED display panel.
Figure 8:
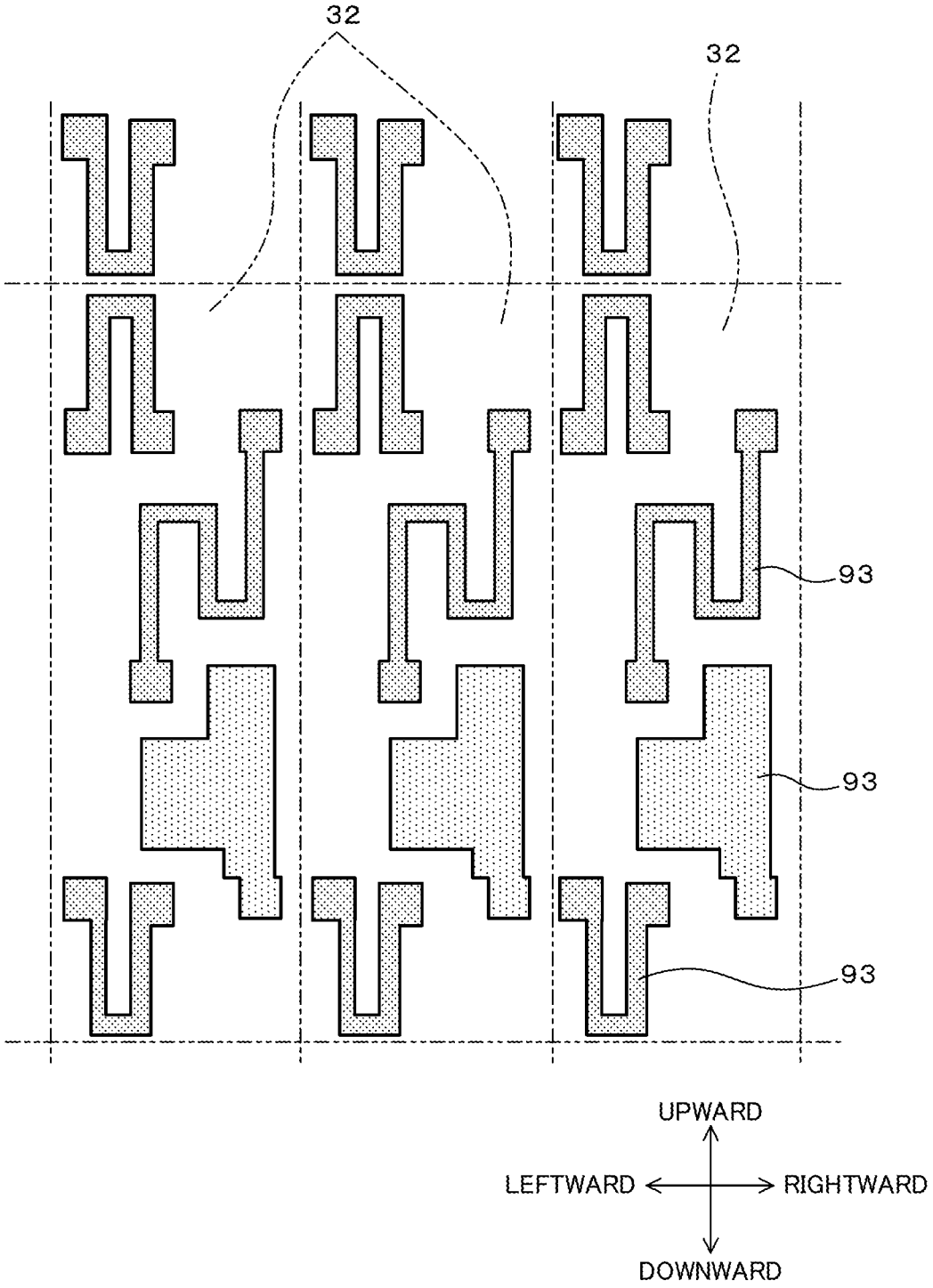
FIG. 8 is an explanatory diagram that illustrates a manufacturing process of an OLED display panel.

First, the description will be presented with reference to FIGS. 7 and 8. FIG. 7 is a schematic cross-sectional view of a display device 10 that is in the middle of a manufacturing process. FIG. 8 is a diagram of the display device 10 of a stage illustrated in FIG. 7 that is viewed from the front side. In the display device 10 according to this embodiment, while three field effect transistors (FET) are included for one organic light emitting element 31, one FET is illustrated for one organic light emitting element 31 in the schematic cross-sectional view.

The manufacturing apparatus, for example, deposits a silicon nitride film or the like at one face of the light transmissive substrate 91 by using a chemical vapor deposition (CVD) method or the like, thereby forming an underlying insulating film 92. Next, the manufacturing apparatus deposits amorphous silicon over the underlying insulating film 92 using the CVD method or the like and performs crystallization using excimer laser annealing (ELA) so as to form a polysilicon layer 93 having a predetermined shape.

Two-dot chain lines illustrated in FIG. 8 represent borders of the wiring portion 41 corresponding to one organic light emitting element 31. These two-dotted lines are virtual lines for the description, and a member representing a boundary is not present in the wiring portion 41. In the description presented hereinafter, one section of the wiring portion 41 corresponding to one organic light emitting element 31 will be referred to as a wiring section 32.

Figure 9:
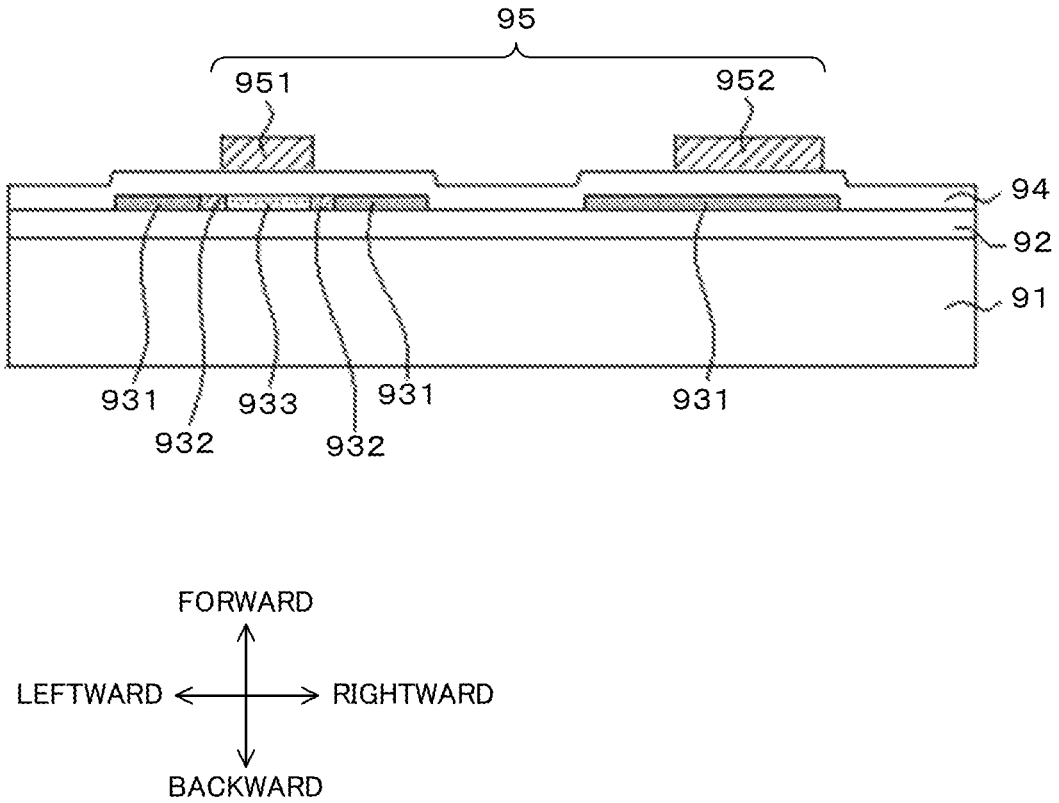
FIG. 9 is an explanatory diagram that illustrates a manufacturing process of an OLED display panel.
Figure 10:
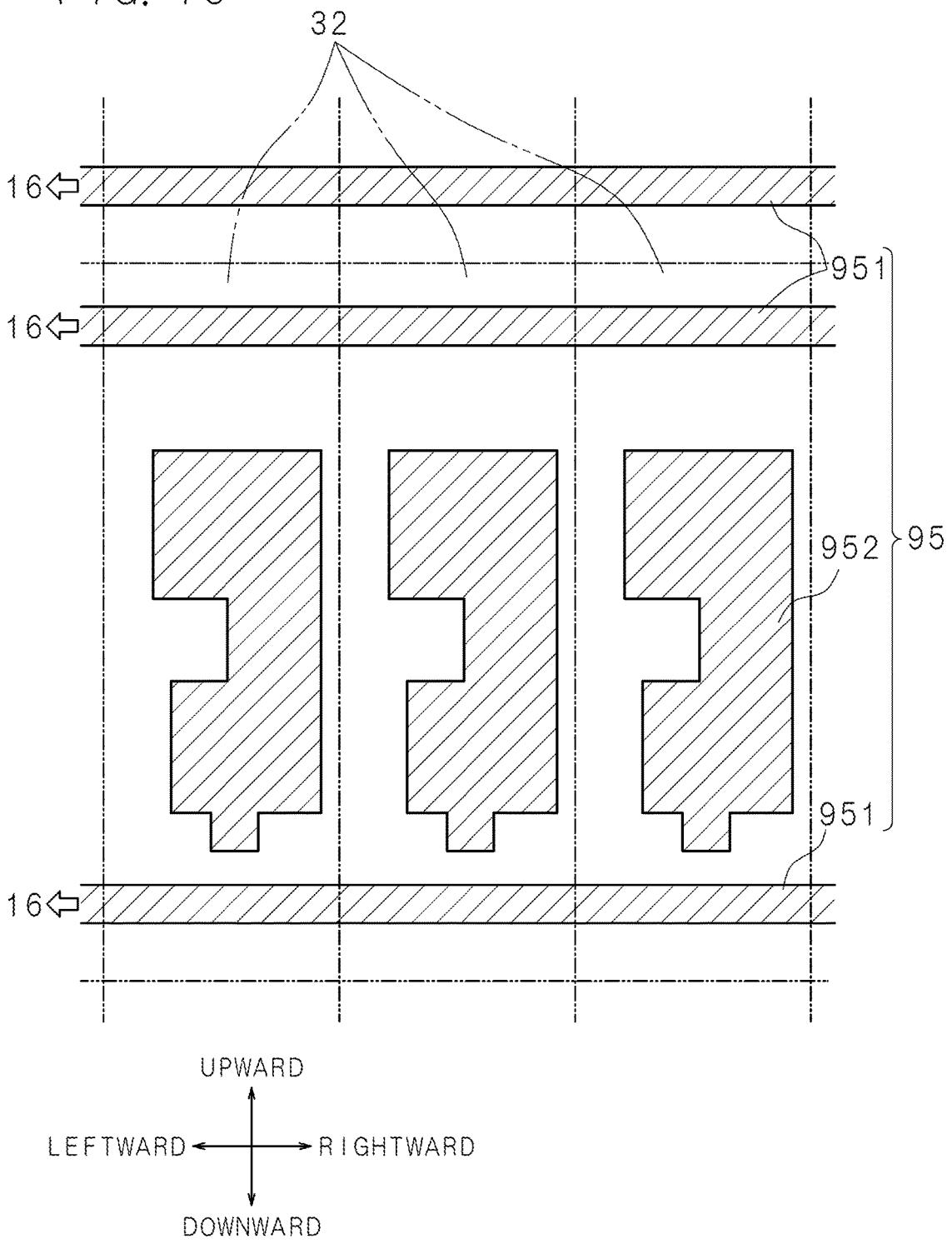
FIG. 10 is an explanatory diagram that illustrates a manufacturing process of an OLED display panel.

The description will be continued with reference to FIGS. 9 and 10. FIG. 9 is a schematic cross-sectional view of the display device 10 that is in the middle of a manufacturing process. FIG. 10 is a diagram of the display device 10 of a stage represented in FIG. 9 that is viewed from the front side. The manufacturing apparatus, for example, deposits a silicon oxide film or the like over the polysilicon layer 93 by using the CVD method or the like, thereby forming a gate insulating film 94. The manufacturing apparatus forms a high-concentration impurity layer 931 having a predetermined shape by using a doping process in which impurities are added to the polysilicon layer 93 from the upper side of the gate insulating film 94. The manufacturing apparatus laminates a first metal layer 95 having a predetermined shape by using the sputtering method or the like. The first metal layer 95 includes a TFT gate electrode 951 and a storage capacitor electrode 952.

The wiring sections 32 adjacent to each other in the horizontal direction are connected using two TFT gate electrodes 951 each having a linear shape growing in the horizontal direction. The two TFT gate electrodes 951 are connected to the scan driver 16.

The manufacturing apparatus performs an additional doping process in which additional impurities are added to the polysilicon layer 93 using the first metal layer 95 as a mask, thereby forming a low-concentration impurity layer 932 having a predetermined shape. A portion to which impurities are not added is an un-doped layer 933.

Figure 11:
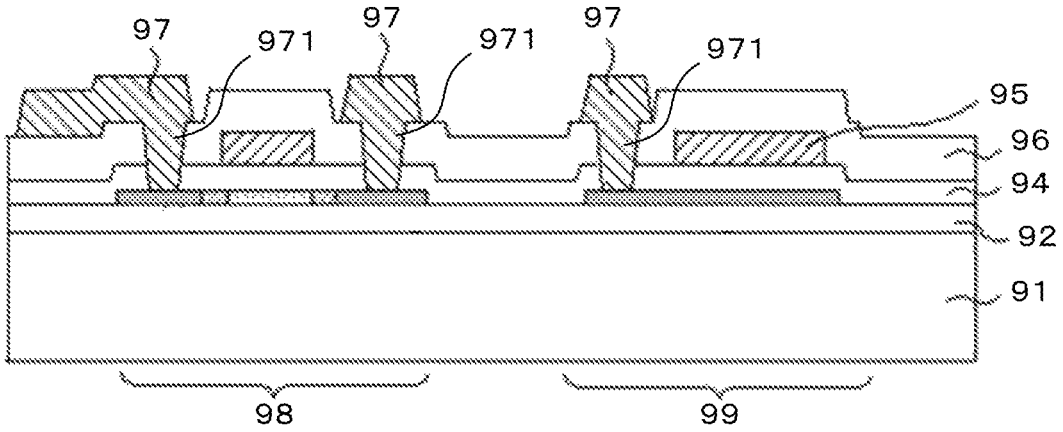
FIG. 11 is an explanatory diagram that illustrates a manufacturing process of an OLED display panel.
Figure 11:
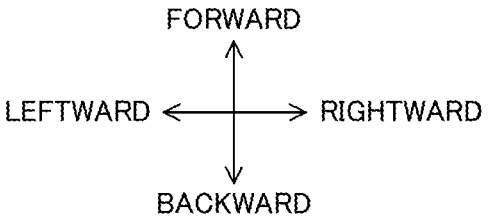
Figure 12:
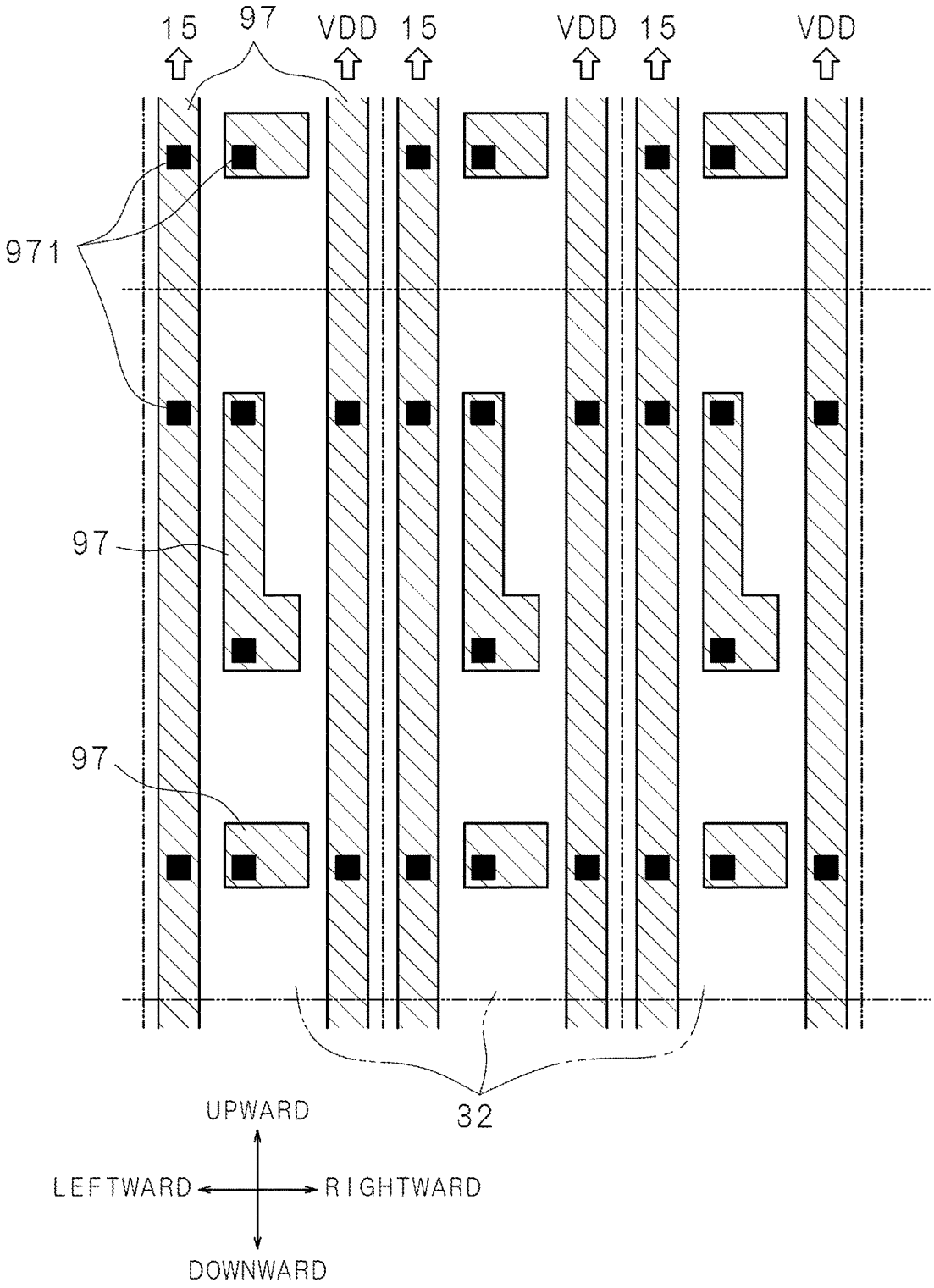
FIG. 12 is an explanatory diagram that illustrates a manufacturing process of an OLED display panel.

The description will be continued with reference to FIGS. 11 and 12. FIG. 11 is a schematic cross-sectional view of the display device 10 that is in the middle of a manufacturing process. FIG. 12 is a diagram of the display device 10 of a stage represented in FIG. 11 that is viewed from the front side. The manufacturing apparatus, for example, deposits a silicon oxide film or the like by using the CVD method or the like, thereby forming an interlayer insulating film 96. The manufacturing apparatus performs anisotropic etching for the interlayer insulating film 96 and the gate insulating film 94, thereby generating a hole passing though up to the polysilicon layer 93. The manufacturing apparatus laminates a second metal layer 97 having a predetermined shape by using the sputtering method or the like. At this time, in a portion of the hole passing through up to the polysilicon layer 93, an interlayer connection portion 971 connecting the polysilicon layer 93 and the second metal layer 97 is formed.

The wiring sections 32 adjacent in the vertical direction are connected two second metal layers 97 each having a linear shape growing in the vertical direction. Out of the two second metal layers 97, left one is connected to the application unit 15, and right one is connected to a positive power supply VDD.

As illustrated in FIGS. 8, 10, and 12, in the process up to here, wiring sections 32 having an approximately same structure are arranged in a matrix pattern in the display unit 30.

Figure 13:
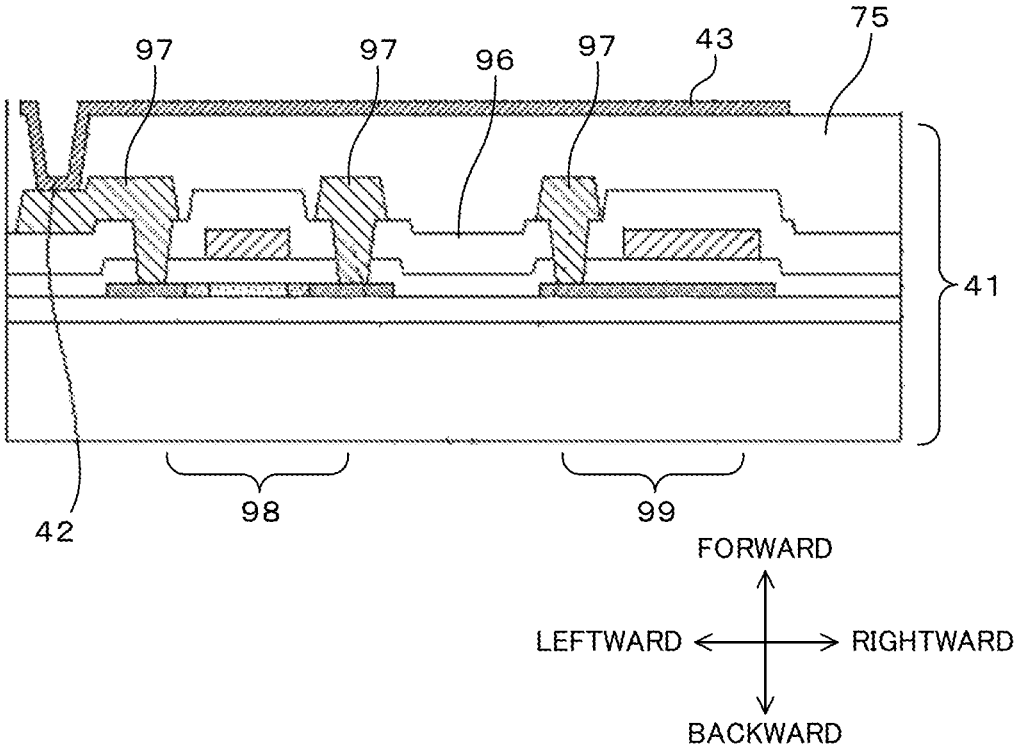
FIG. 13 is an explanatory diagram that illustrates a manufacturing process of an OLED display panel.
Figure 14:
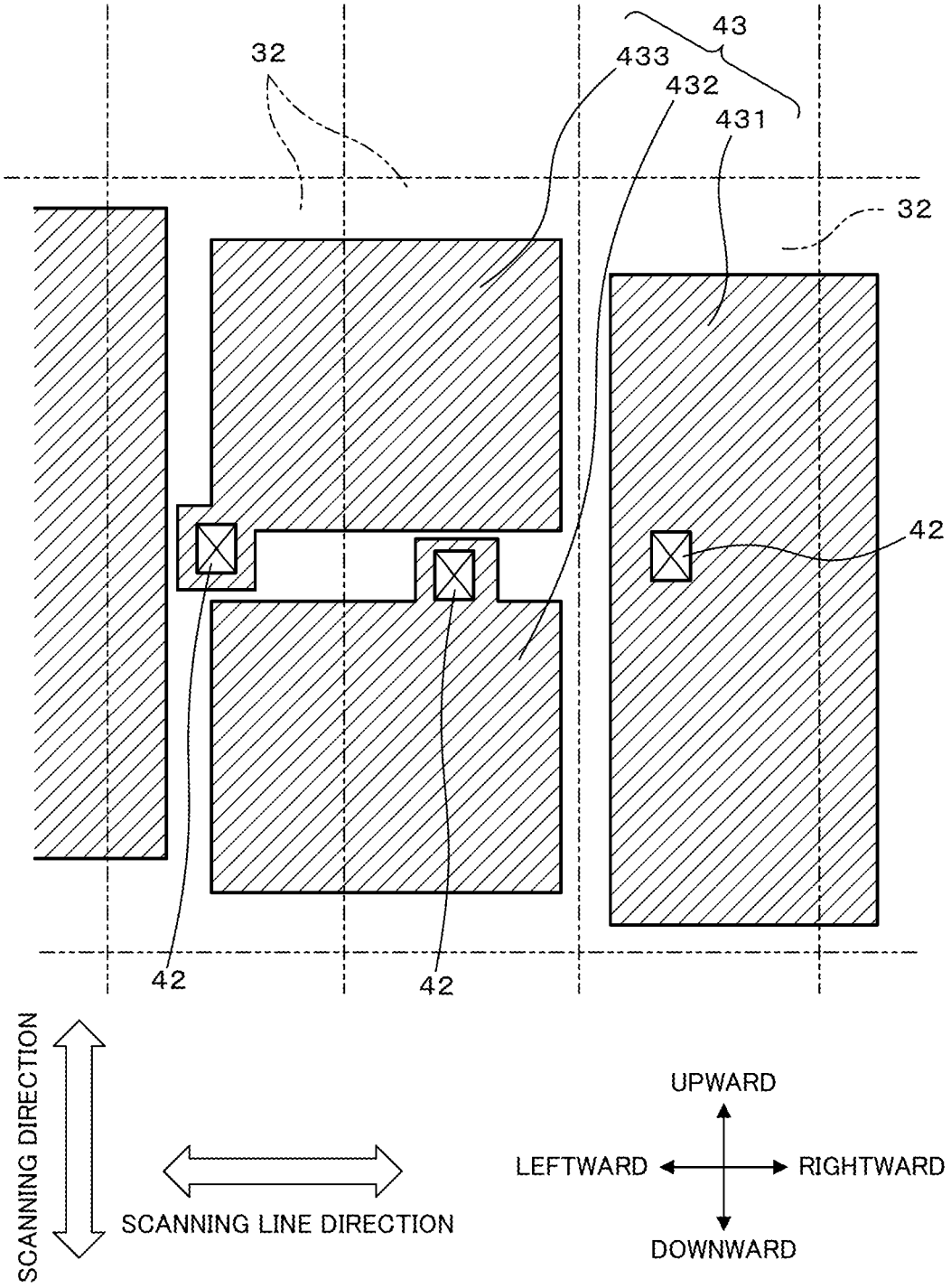
FIG. 14 is an explanatory diagram that illustrates a manufacturing process of an OLED display panel.

The description will be continued with reference to FIGS. 13 and 14. FIG. 13 is a schematic cross-sectional view of the display device 10 that is in the middle of a manufacturing process. FIG. 14 is a diagram of the display device 10 of a stage represented in FIG. 13 that is viewed from the front side. The manufacturing apparatus deposits a photosensitive organic material by using the spin coat method or the like, thereby forming a flattening layer 75. The manufacturing apparatus generates a hole passing through up to the second metal layer 97 by using anisotropic etching or the like. In this way described above, the manufacturing process of the wiring portion 41 ends, and a TFT portion 98 and a storage capacitor 99 are completed.

The description will be continued using flowcharts illustrated in FIGS. 6, 13, and 14. The manufacturing apparatus produces a TFT circuit output connecting portion 42 and an anode electrode 43 (Step S502). More specifically, for example, a vapor deposition apparatus deposits a metal thin film over the inner face of a hole passing though up to the front face of the flattening layer 75 and the second metal layer 97. The spin coat apparatus, the exposure apparatus, the development apparatus, and the etching apparatus removes the metal thin film in a predetermined shape, thereby producing the anode electrode 43 and the TFT circuit output connecting portion 42 that connects the anode electrode 43 and the second metal layer 97.

The shape of the anode electrode 43 will be described. The anode electrode 43 includes: a first-color anode electrode 431; a second-color anode electrode 432; and a third-color anode electrode 433. The first-color anode electrode 431 is an anode electrode 43 of the first-color organic light emitting element 311. The first-color anode electrode 431 has a rectangular shape. The first-color anode electrode 431 is connected to the second metal layer 97 through the TFT circuit output connecting portion 42 at a position of an upper-left inclination from the center. The second-color anode electrode 432 is an anode electrode 43 of the second-color organic light emitting element 312. The second-color anode electrode 432 has a shape in which a small rectangle is continued from an upper side of a rectangle. The second-color anode electrode 432 is connected to the second metal layer 97 through the TFT circuit output connecting portion 42 at a portion of the small rectangle. The third-color anode electrode 433 is an anode electrode 43 of the third-color organic light emitting element 313. The third-color anode electrode 433 has a shape in which a small rectangle is continued from a lower corner of a rectangle. The third-color anode electrode 433 is connected to the second metal layer 97 through the TFT circuit output connecting portion 42 at a portion of the small rectangle.

Figure 15:
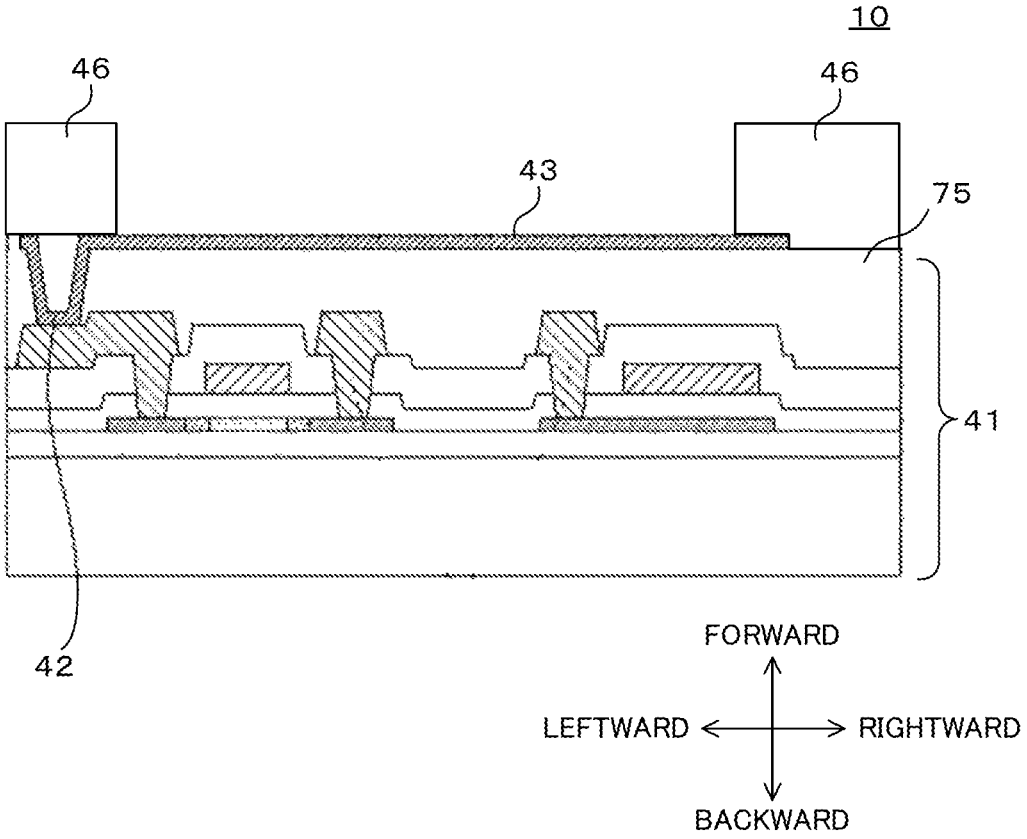
FIG. 15 is an explanatory diagram that illustrates a manufacturing process of an OLED display panel.
Figure 16:
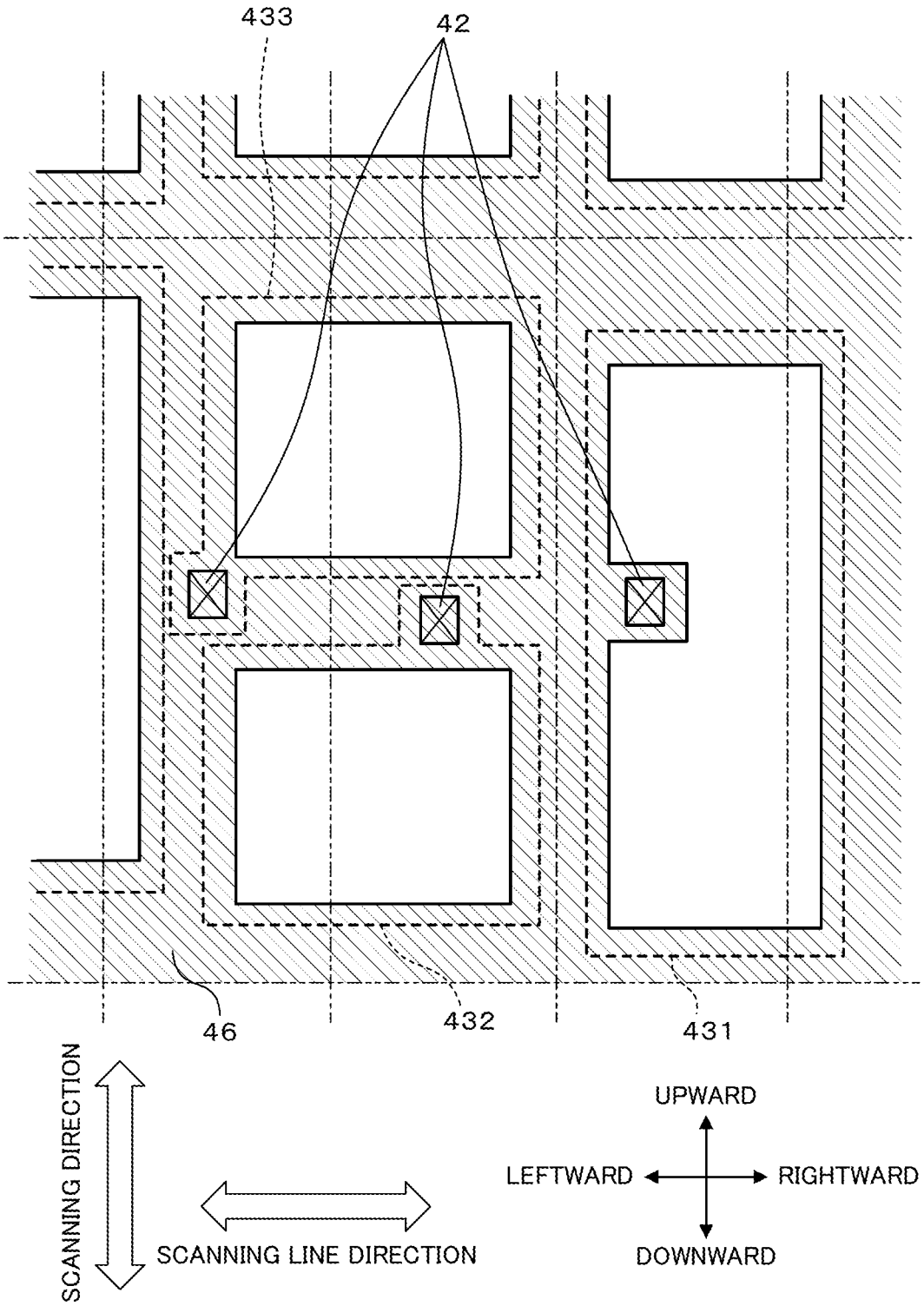
FIG. 16 is an explanatory diagram that illustrates a manufacturing process of an OLED display panel.

The description will be continued with reference to FIGS. 15, 16, and 6. FIG. 15 is a schematic cross-sectional view of the display device 10 that is in the middle of a manufacturing process. FIG. 16 is a diagram of the display device 10 of a stage represented in FIG. 15 that is viewed from the front side.

The manufacturing apparatus produces an isolation portion 46 (Step S503). More specifically, for example, after the spin coat apparatus deposits a photosensitive organic resin film, the exposure apparatus exposes a predetermined pattern, and the development apparatus and the etching apparatus removes unnecessary portions, thereby the isolation portion 46 is produced.

The shape of the hole formed in the isolation portion 46 will now be described. The hole of the isolation portion 46 formed at the front side of the first-color anode electrode 431 has an approximate "U" shape enclosing the TFT circuit output connecting portion 42. The holes of the isolation portion 46 disposed at the front sides of the second-color anode electrode 432 and the third-color anode electrode 433 have a rectangular shape.

As described above, the shape of a portion not covered with the isolation portion 46 of the anode electrode 43 coincides with the shape of the organic light emitting element 31 described with reference to FIG. 4.

The manufacturing apparatus produces a common layer 47 (Step S504). More specifically, for example, the vapor deposition apparatus deposits organic material layers of two layers including the hole injection layer and the hole transport layer at the front sides of the anode electrode 43 and the isolation portion 46. In addition, the common layer 47 is produced to have a different thickness according to the emission color of a light emitting layer 44 produced at the front side of the common layer 47. More specifically, the common layer 47 located at a position at which the light emitting layer 44 of red is formed is thick, and the common layer 47 located at a position at which the light emitting layer 44 of blue is formed is thin. By configuring as such, the front side can be radiated with high efficiency using light generated in the light emitting layer 44 and entering the common layer 47.

Figure 17:
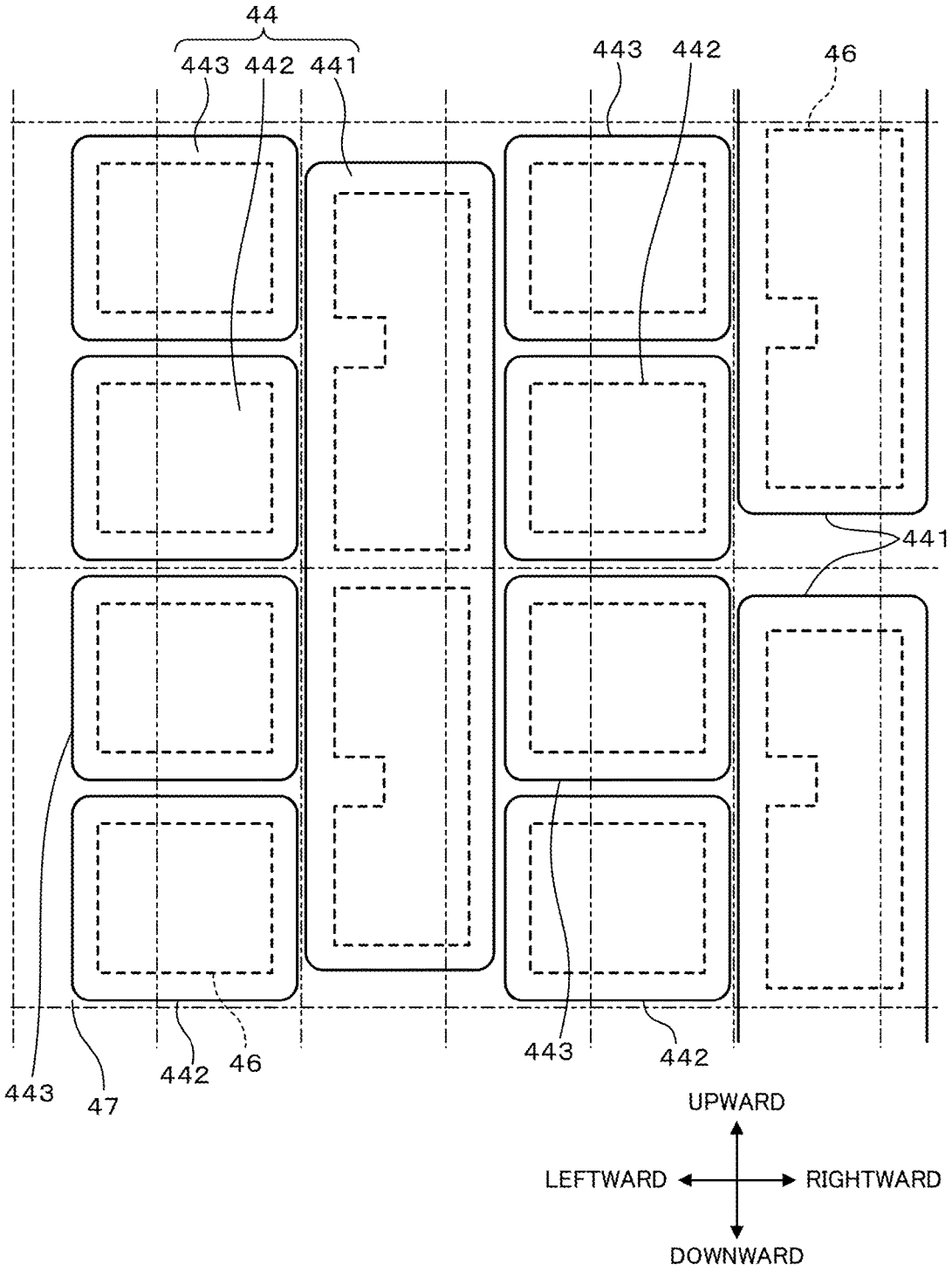
FIG. 17 is an explanatory diagram that illustrates a manufacturing process of an OLED display panel.

The description will be continued with reference to FIGS. 17 and 6. FIG. 16 is a diagram of the display device 10 that is in the middle of a manufacturing process viewed from the front side. FIG. 17 has a scale different from that of FIG. 16 and illustrates a range wider than that of FIG. 16.

The manufacturing apparatus produces a light emitting layer 44 (Step S505). The light emitting layer 44 includes three types of a first-color light emitting layer 441, a second-color light emitting layer 442, and a third-color light emitting layer 443. The first-color light emitting layer 441 is a light emitting layer 44 that emits light in a first color. The second-color light emitting layer 442 is a light emitting layer 44 that emits light in a second color. The third-color light emitting layer 443 is a light emitting layer 44 that emits light in a third color.

Since the material of the light emitting layer 44 has low durability, it is difficult to form the light emitting layer 44 through a semiconductor process including the thermal annealing process, immersion into liquid having high reactivity, processing using a corrosive gas, and the like. For this reason, the manufacturing apparatus selectively deposits the light emitting layer 44 only at predetermined positions by using a metal mask.

A method of producing the light emitting layer 44 will now be described. By using a metal mask having a hole having the shape of the first-color light emitting layer 441 illustrated in FIG. 17, the vapor deposition apparatus performs vapor deposition of a first-color light emitting layer 441 having a predetermined shape. Thereafter, by using a metal mask having a hole having the shape of the second-color light emitting layer 442, the vapor deposition apparatus performs vapor deposition of a second-color light emitting layer 442 having a predetermined shape. In addition, by using a metal mask having a hole having the shape of the third-color light emitting layer 443, the vapor deposition apparatus performs vapor deposition of a third-color light emitting layer 443 having a predetermined shape.

In addition, the first-color light emitting layer 441 is formed over two first-color organic light emitting elements 311 adjacent to each other in the vertical direction. One second-color light emitting layer 442 is formed for one second-color organic light emitting element 312. Similarly, one third-color light emitting layer 443 is formed for one third-color organic light emitting element 313.

Here, the production sequence of the first-color light emitting layer 441, the second-color light emitting layer 442, and the third-color light emitting layer 443 may be changed.

The vapor deposition apparatus produces a cathode underlayer 48 (Step S506). The vapor deposition apparatus sequentially produces the cathode electrode 19 and the cap layer 45 (Step S507). The cathode underlayer 48, the cathode electrode 19, and the cap layer 45 are layers extending over the whole display unit 30 and thus do not need to be produced with high precision.

The sealing apparatus seals the edge of the sealing plate 21 in an airtight manner (Step S508). Thereafter, the manufacturing apparatus attaches a ¼ wavelength phase difference plate 22 and a polarizing plate 23 to the front side of the sealing plate 21. According to the process described above, an OLED display panel is completed.

In addition, the manufacturer of the display device 10 may use an automatic manufacturing apparatus that performs a series of manufacturing processes by automatically controlling the apparatus used for each manufacturing process and the conveyance apparatus linking apparatuses. In such a case, a determination and execution of each step described above are performed by a control device of the automatic manufacturing apparatus.

The ¼ wavelength phase difference plate 22 and the polarizing plate 23 may be attached to the surface of the sealing plate 21 after Step S506. In addition, a plurality of TFT substrates 11 formed over one large glass substrate may be cut into a predetermined size by the cutting apparatus between Steps S507 and S508 or after Step S508.

The shape of the metal mask used when the light emitting layer 44 is generated in Step S505 will be described. As described above, in the process of Step S505, it is difficult to use the semiconductor process, and accordingly, the dimension precision and the positioning precision of the metal mask are much lower than those of Steps S501 to S503. In order to reliably cover the hole formed in the isolation portion 46 with the light emitting layer 44, it is necessary to form a hole having a sufficiently large size in the mask used in this process. On the other hand, in order to avoid mixing with a neighboring light emitting layer 44, it is necessary that holes, which are formed in the isolation portion 46, are sufficiently separate from each other.

In order to acquire a bright display device 10, it is preferable that each organic light emitting element 31 is large. In addition, in order to lengthen the lifespan of the OLED display panel, it is preferable that each organic light emitting element 31 is large. Meanwhile, in order to implement high definition of the display device 10, it is necessary to densely arrange a large number of small organic light emitting elements 31.

Here, referring back to FIG. 4, the arrangement of the organic light emitting elements 31 according to this embodiment will be described. The arrangement of the organic light emitting elements 31 illustrated in FIG. 4 is an arrangement in which the area of the organic light emitting element 31 can be increased in a display device 10 in which small organic light emitting elements 31 are arranged. This point will be described in more detail with reference to FIG. 17. By generating holes of the isolation portion 46 corresponding to two first-color organic light emitting elements 311 adjacent to each other using one hole of the metal mask, the width of such two isolation portions 46 can be decreased. As the width of the isolation portions 46 is decreased, the size of the first-color organic light emitting element 311 can be increased.

Figure 18:
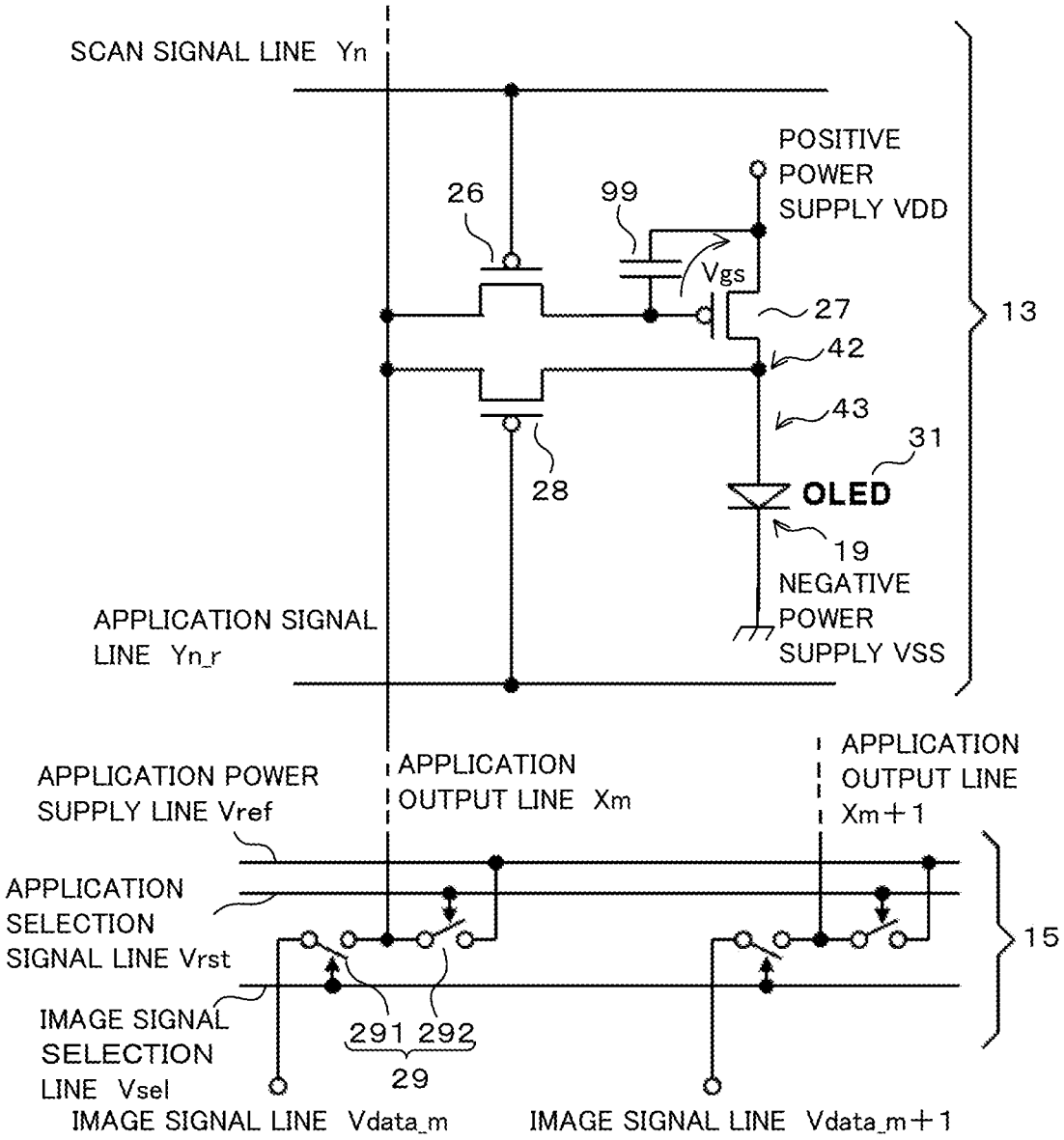
FIG. 18 is a circuit diagram that illustrates a circuit causing one organic light emitting element to emit light.

An example of a circuit that causes the organic light emitting element 31 to emit light will be described. FIG. 18 is a circuit diagram that illustrates a circuit that causes one organic light emitting element 31 to emit light. In FIG. 18, one organic light emitting element 31 is described using a graphic symbol of an OLED that represents an organic light emitting diode.

The circuit illustrated in FIG. 18 includes a pixel circuit 13 and an application unit 15. The pixel circuit 13 is configured by organic light emitting elements 31 and a peripheral circuit connected to the organic light emitting elements 31. FIG. 18 illustrates blocks corresponding to one organic light emitting element 31 included in the pixel circuit 13. In the pixel circuit 13, blocks corresponding to the number of the organic light emitting elements 31 are arranged in a matrix pattern. The display unit 30 of the display device 10 includes a plurality of pixel circuits 13.

The application unit 15 is a circuit that prevents a cross-talk in which an organic light emitting element 31 emits light in accordance with a current leaking from an adjacent organic light emitting element 31. FIG. 18 illustrates blocks corresponding to organic light emitting elements 31 of two columns in the scanning direction included in the application unit 15. In the application unit 15, blocks corresponding to the number of organic light emitting elements 31 arranged in the scanning line direction of the display unit 30 are arranged in one column.

The pixel circuit 13, in addition to the organic light emitting element 31, includes a switching TFT 26, a driving TFT 27, an application TFT 28, and a storage capacitor 99. The driving TFT 27 is an example of a control element according to this embodiment controlling a current flowing between the anode electrode 43 and the cathode electrode 19. In descriptions presented here and the drawings, while a P-channel TFT is illustrated as an example of the TFT, an N-channel TFT capable of realizing the configuration of the display device 10 described here may be used.

A positive power supply VDD, a negative power supply VSS, an n-th scan signal line Yn, an n-th application signal line Yn_r, and an m-th application output line Xm are connected to the pixel circuit 13. Here, n is an integer that is one or more and the number of scan signal lines or less. In addition, m is an integer that is one or more and the number of image signal lines Vdata_m to be described later or less. Digital signals are supplied from the scan driver 16 to the scan signal line Yn and the application signal line Yn_r. In description presented below, a digital signal supplied from the scan signal line Yn to the pixel circuit 13 will be described as a scan signal Yn. Similarly, a digital signal supplied from the application signal line Yn_r to the pixel circuit 13 will be described as an application signal Yn_r. An analog output of the application unit 15 is supplied to the application output line Xm. In description presented below, an analog signal supplied from the application unit 15 to the pixel circuit 13 through the application output line Xm will be described as an application output Xm.

The scan signal line Yn and the application signal line Yn_r are connected to the pixel circuits 13 of the organic light emitting elements 31 included in a plurality of pixels 33 arranged in the scanning line direction. The application output line Xm is connected to the pixel circuits 13 of organic light emitting elements 31 included in a plurality of pixels 33 arranged in the scanning direction of the display unit 30.

The positive power supply VDD is connected to a first electrode of the storage capacitor 99 and a source electrode of the driving TFT 27. The negative power supply VSS is connected to a cathode electrode 19 of the organic light emitting element 31. The scan signal line Yn is connected to a gate electrode of the switching TFT 26. The application signal line Yn_r is connected to a gate electrode of the application TFT 28. The application output line Xm is connected to the switching TFT 26 and a source electrode of the application TFT 28.

A drain electrode of the switching TFT 26 is connected to a second electrode of the storage capacitor C1 and the gate electrode of the driving TFT 27. The drain electrode of the driving TFT 27 is connected to the anode electrode 43 of the organic light emitting element 31 and the drain electrode of the application TFT 28 through the TFT circuit output connecting portion 42. In other words, the anode electrode 43 is connected to an example of a control element according to this embodiment.

The application unit 15 includes two switches 29 of a first switch 291 and a second switch 292 for one application output line Xm. The application output line Xm is connected between the first switch 291 and the second switch 292. An application power supply line Vref is connected to the other end of the second switch 292.

The first switch 291 switches presence/absence of a connection between the application output line Xm and the m-th image signal line Vdata_m. The first switch 291 is controlled according to a digital signal supplied from the driver IC 18 through an image selection signal line Vsel. In description presented below, a digital signal supplied from the image selection signal line Vsel to the pixel circuit 13 will be described as an image selection signal Vsel.

An analog image signal is supplied from the driver IC 18 to the image signal line Vdata_m. In description presented below, an analog signal supplied from the image signal line Vdata_m to the pixel circuit 13 will be described as an image signal Vdata_m. The image signal Vdata_m is a signal used for controlling the luminance of each organic light emitting element 31.

The second switch 292 switches presence/absence of a connection between the application output line Xm and the application power supply line Vref. The second switch 292 is controlled according to a digital signal supplied from the driver IC 18 through an application selection signal line Vrst. In description presented below, a digital signal supplied from the application selection signal line Vrst to the pixel circuit 13 will be described as an application selection signal Vrst.

The application unit 15 supplies analog DC power of predetermined electric potential to the pixel circuit 13 through the application power supply line Vref. The predetermined electric potential, for example, is electric potential acquired by adding a threshold voltage of the organic light emitting element 31 to the electric potential of the cathode electrode 19 or less.

Here, the threshold voltage of the organic light emitting element 31 is a voltage relating to emission/no-emission of the organic light emitting element 31. The threshold voltage of the organic light emitting element 31 represents a maximum voltage at which the organic light emitting element 31 does not emit light even when the electric potential of the anode electrode 43 is set to be more than the electric potential of the cathode electrode 19 by the threshold voltage. In other words, when an electric potential difference between the anode electrode 43 and the cathode electrode 19 exceeds the threshold voltage of the organic light emitting element 31, the organic light emitting element 31 starts light emission. The predetermined electric potential, for example, may be electric potential less than the electric potential of the cathode electrode 19 (for example, the negative power supply VSS).

In description presented below, analog power supplied from the application power supply line Vref to the pixel circuit 13 will be described as application power Vref.

Figure 19:
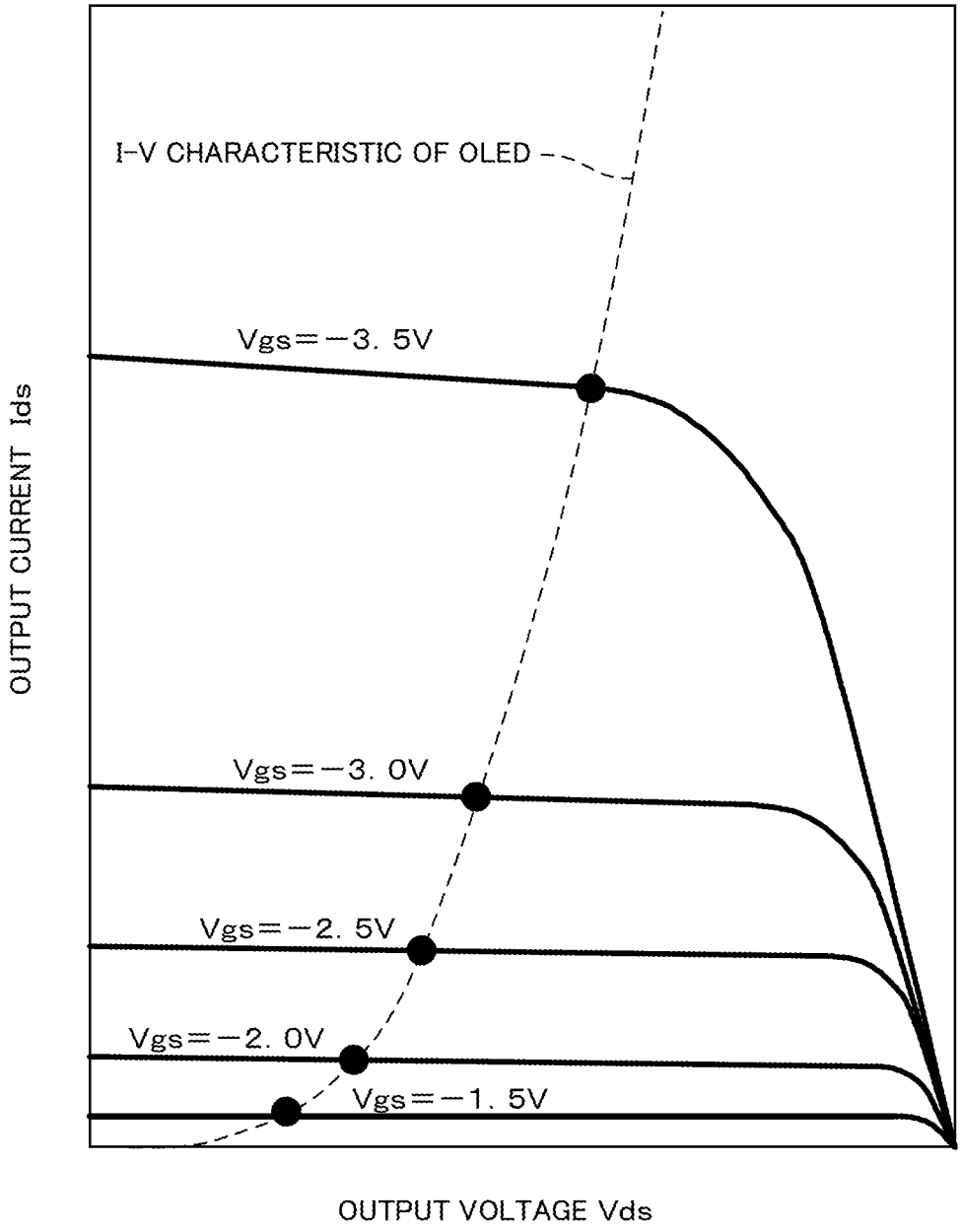
FIG. 19 is an explanatory diagram that illustrates output characteristics of a driving TFT.

FIG. 19 is an explanatory diagram that illustrates output characteristics of the driving TFT 27. The operation of the pixel circuit 13 will be described with reference to FIGS. 18 and 19.

In FIG. 19, the horizontal axis represents the output voltage Vds of the driving TFT 27. In FIG. 19, the vertical axis represents the output current Ids of the driving TFT 27. In FIG. 19, solid lines represent relations between the output voltage Vds and the output current Ids of the driving TFT 27 in a case where an electric potential difference Vgs between the gate electrode and the source electrode of the driving TFT 27 is −1.5 V, −2.0 V, −2.5 V, −3.0 V, and −3.5 V. In FIG. 19, a broken line represents an I-V characteristic that is a relation between the current and the voltage between the anode electrode 43 and the cathode electrode 19 of the OLED.

Figure 20:
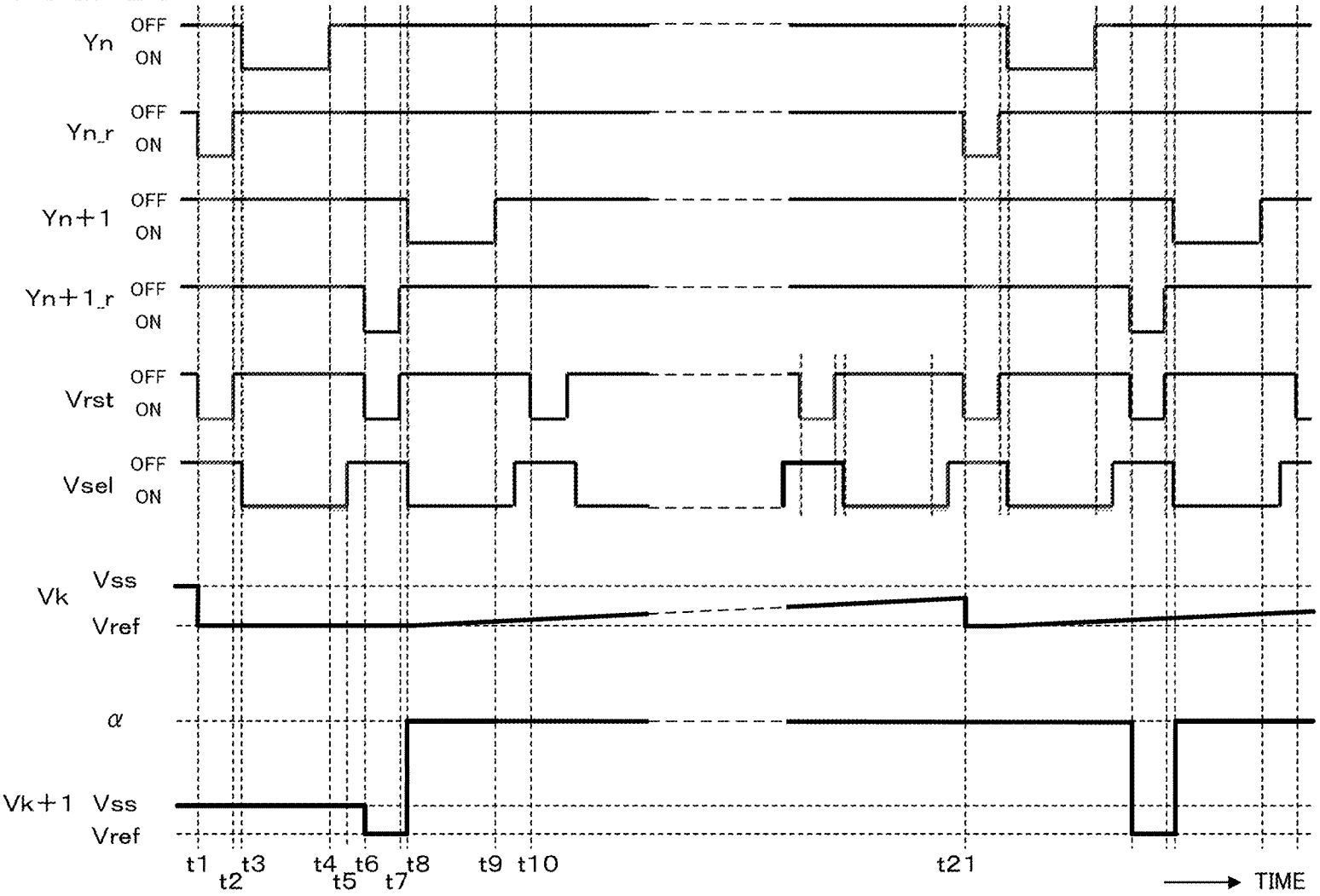
FIG. 20 is a timing diagram that illustrates the operations of a pixel circuit and an application unit.

FIG. 20 illustrates timing diagrams that illustrate the operations of the pixel circuit 13 and the application unit 15. In FIG. 20, the horizontal axis represents the time. Upper timing diagrams illustrated in FIG. 20 represent states of an n-th scan signal Yn, an n-th application signal Yn_r, an (n+1)-th scan signal Yn+1, an (n+1)-th application signal Yn+1_r, an application selection signal Vrst, and the image selection signal Vsel. In the upper timing diagrams illustrated in FIG. 20, the vertical axis represents that the upper side is an Off state, and a lower side represents an On state. A signal in the Off state is a so-called high-level signal. A signal in the On state is a so-called low-level signal.

The lower timing diagrams illustrated in FIG. 20 illustrate the electric potential Vk of the anode electrode 43 of the k-th organic light emitting element 31 and the electric potential (Vk+1) of the anode electrode 43 of the (k+1)-th organic light emitting element 31. Here, the k-th organic light emitting element 31 is an arbitrary organic light emitting element 31. In addition, k is an integer of two or more and a total number of organic light emitting elements 31 or less. In addition, the (k+1)-th organic light emitting element 31 is another organic light emitting element 31 adjacent to the k-th organic light emitting element 31. The k-th organic light emitting element 31 and the (k+1)-th organic light emitting element 31 are connected to a same application output line Xm. The k-th organic light emitting element 31 is connected to the n-th scan signal line Yn and the n-th application signal line Yn_r. The (k+1)-th organic light emitting element 31 is connected to the (n+1)-th scan signal line Yn+1 and the (n+1)-th application signal line Yn+1_r. In the lower timing diagrams illustrated in FIG. 20, the vertical axis represents the electric potential. In the lower timing diagrams illustrated in FIG. 20, the application power Vref and the negative power supply Vss are illustrated using broken lines.

Description will be started from a state in which all the n-th scan signal Yn, the n-th application signal Yn_r, the (n+1)-th scan signal (Yn+1), the (n+1)-th application signal Yn+1_r, the application selection signal Vrst, and the image selection signal Vsel are Off, and the k-th and the (k+1)-th organic light emitting elements 31 do not emit light. In addition, a case will be described as an example in which an image signal Vdata_m representing a non-emission state of the k-th organic light emitting element 31 and an emission state of the (k+1)-th organic light emitting element 31 is input.

At time t1, the driver IC 18 sets the n-th application signal Yn_r and the application selection signal Vrst to the On state. In a case where the application selection signal Vrst is in the On state, the second switch 292 connects the application output line Xm and the application power line Vref together. In a case where the application signal line Yn_r is in the On state, the application TFT 28 connects the application output line Xm to the anode electrode 43 of the k-th organic light emitting element 31 through the TFT circuit output connecting portion 42. For this reason, the electric potential Vk of the anode electrode 43 of the k-th organic light emitting element 31 has the same electric potential as the application power Vref.

In this way, setting of the electric potential Vk of the anode electrode 43 to the same electric potential as the application power Vref through the application output line Xm will be referred to as applying of the same electric potential as the application power Vref to the anode electrode 43. As described above, the application power Vref is analog DC power supply which supply electric potential of the threshold voltage of the organic light emitting element 31 or less, or electric potential less than that of the negative power supply VSS. The cathode electrode 19 of the organic light emitting element 31 has the same electric potential as that of the negative power supply VSS. Accordingly, electric potential of the threshold voltage of the organic light emitting element 31 or less and electric potential less than the electric potential of the cathode electrode 19 is applied to the anode electrode 43 of the k-th organic light emitting element 31 at time U.

At time t2, the driver IC 18 sets the n-th application signal Yn_r and the application selection signal Vrst to the Off state. In a case where the application selection signal Vrst is in the Off state, the second switch 292 blocks the application output line Xm from the application power line Vref. In a case where the application signal line Yn_r is in the On state, the application TFT 28 blocks the application output line Xm from the TFT circuit output connecting portion 42.

At time t3, the driver IC 18 sets the n-th scan signal Yn and the image selection signal Vsel to the On state. Between the time t2 and the time t3, an interval of about 0.5 microseconds is preferably arranged. The reason for this is that, in a case where the application power Vref is applied to the output terminal of the driver IC 18, there is a possibility that the driver IC 18 is damaged.

In a case where the image selection signal Vsel is in the On state, the first switch 291 connects the application output line Xm to the m-th image signal line Vdata_m. In a case where the scan signal Yn is in the On state, the switching TFT 26 connects the application output line Xm to the gate electrode of the driving TFT 27 and the storage capacitor 99.

As described above, in the timing diagram illustrated in FIG. 20, the image signal Vdata_m representing the non-emission state is input to the k-th organic light emitting element 31. The electric potential difference Vgs between the gate electrode and the source electrode of the driving TFT 27 is small, and an output current Ids between the source electrode and the drain electrode of the driving TFT 27 does not flow. For this reason, the k-th organic light emitting element 31 does not emit light.

At time t4, the driver IC 18 sets the n-th scan signal Yn to the Off state. In a case where the scan signal Yn is in the Off state, the switching TFT 26 blocks the application output line Xm from the gate electrode of the driving TFT 27 and the storage capacitor 99.

A period between time t3 and time t4 is an example of a first period according to this embodiment. The control unit according to this embodiment applies electric potential according to the image signal to the pixel circuit 13 of the k-th organic light emitting element 31 within the first period.

At time t5, the driver IC 18 sets the image selection signal Vsel to the Off state. In a case where the image selection signal Vsel is in the Off state, the first switch 291 blocks the application output line Xm from the m-th image signal line Vdata_m.

From time t1 to time t5, the driver IC 18 completes the input of image signals to a plurality of organic light emitting elements 31 included in the n-th scanning line.

At time t6, the driver IC 18 sets the (n+1)-th application signal Yn+1_r and the application selection signal Vrst to the On state. In a case where the application selection signal Vrst is in the On state, the second switch 292 connects the application output line Xm to the application power line Vref. In a case where the application signal line Yn+1_r is in the On state, the (n+1)-th application TFT 28 connects the application output line Xm to the anode electrode 43 of the (k+1)-th organic light emitting element 31 through the TFT circuit output connecting portion 42. For this reason, the electric potential Vk+1 of the anode electrode 43 of the (k+1)-th organic light emitting element 31 becomes the application power Vref.

At time t7, the driver IC 18 sets the (n+1)-th application signal Yn+1_r and the application selection signal Vrst to the Off state. In a case where the application selection signal Vrst is in the Off state, the second switch 292 blocks the application output line Xm from the application power line Vref. In a case where the application signal line Yn+1_r is in the Off state, the application TFT 28 blocks the application output line Xm from the TFT circuit output connecting portion 42.

At time t8, the driver IC 18 sets the (n+1)-th scan signal Yn+1 and the image selection signal Vsel to the On state. In a case where the image selection signal Vsel is in the On state, the first switch 291 connects the application output line Xm to the m-th image signal line Vdata_m. In a case where the scan signal Yn+1 is in the On state, the switching TFT 26 connects the application output line Xm to the gate electrode of the driving TFT 27 and the storage capacitor 99.

As described with reference to FIG. 18, in accordance with the electric potential difference Vgs between the gate electrode and the source electrode of the driving TFT 27, the output current Ids flows between the source electrode and the drain electrode of the driving TFT 27. According to the output current Ids, the organic light emitting element 31 emits light. In description presented below, the electric potential applied to the anode electrode 43 of the (k+1)-th organic light emitting element 31 will be described as "a". The electric potential a is electric potential between the positive power supply VDD and the negative power supply VSS and is determined according to the electric potential of the application output line Xm. In accordance with the electric potential of the application output line Xm, electric charge is accumulated in the storage capacitor 99.

At time t9, the driver IC 18 sets the (n+1)-th scan signal Yn+1 to the Off state. Between time t8 and time t9, a time for which sufficient electric charge is stored in the storage capacitor 99 is arranged as an interval. In a case where the (n+1)-th scan signal Yn+1 is set to the Off state, the switching TFT 26 blocks the application output line Xm from the gate electrode of the driving TFT 27 and the storage capacitor 99.

A period from time t8 to time t9 is an example of the first period according to this embodiment. The control unit according to this embodiment applies electric potential according to the image signal to the pixel circuit 13 of the (k+1)-th organic light emitting element 31 within the first period.

At time t10, the driver IC 18 sets the image selection signal Vsel to the Off state. In a case where the image selection signal Vsel is in the Off state, the first switch 291 blocks the application output line Xm from the m-th image signal line Vdata_m.

After time t10, the electric potential of the anode electrode 43 of the (k+1)-th organic light emitting element 31 is maintained according to the electric charge accumulated in the storage capacitor 99. In this way, the (k+1)-th organic light emitting element 31 continues to emit light.

The driver IC 18 completes the input of image signals to a plurality of organic light emitting elements 31 included in the (n+1)-th scanning line from time t6 to time t10. Thereafter, the driver IC 18 repeats the same operation for scanning lines corresponding to one screen, thereby displaying an image corresponding to one screen at the display unit 30.

At time t21, the driver IC 18 sets the n-th application signal Yn_r and the application selection signal Vrst to the On state. In a case where the application selection signal Vrst is in the On state, the second switch 292 connects the application output line Xm to the application power line Vref. In a case where the application signal Yn_r is in the On state, the application TFT 28 connects the application output line Xm to the anode electrode 43 of the k-th organic light emitting element 31 through the TFT circuit output connecting portion 42. For this reason, the electric potential Vk of the anode electrode 43 of the k-th organic light emitting element 31 has the same electric potential as that of the application power Vref.

A period from time t4 to time t21 is an example of a second period according to this embodiment. The control unit according to this embodiment, based on the electric potential applied to the pixel circuit 13 for the first period, controls the emission luminance of the k-th organic light emitting element 31 by means of the control element according to the embodiment of the present disclosure within the second period. In other words, the driver IC 18 controls the k-th organic light emitting element 31 to be in the non-emission state for the second period starting from time t4 and ends at time t21.

As described above, the application unit 15 applies the application power Vref less than the negative power supply VSS that is the electric potential of the cathode electrode 19 to the anode electrode 43 of the k-th organic light emitting element 31 for a period from time t1 to time t2 before the start of the second period.

Thereafter, the driver IC 18 repeats a similar operation after time t2, thereby displaying an image corresponding to a next one screen at the display unit 30.

Figure 21:
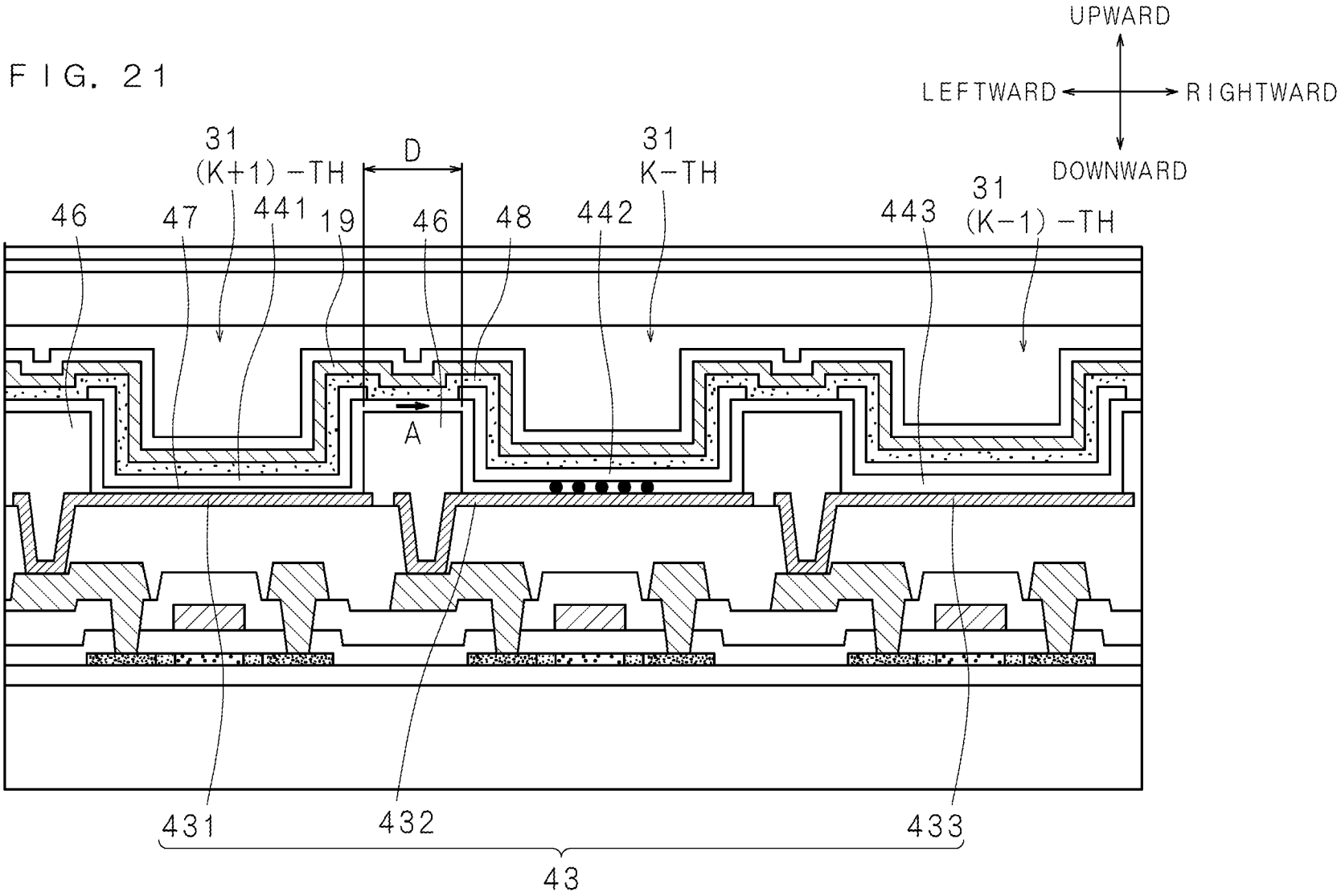
FIG. 21 is a schematic cross-sectional view that illustrates the operation of an application unit.

FIG. 21 is a schematic cross-sectional view that illustrates the operation of the application unit 15. FIG. 21 is a schematic cross-sectional view of a part of the display device 10 that includes three organic light emitting elements 31. In FIG. 21, the cross-sectional configuration of an organic light emitting element 31 portion is illustrated in a simplified manner, and the cross-sectional configuration of a TFT portion is illustrated in a further simplified manner. The operation of the application unit 15 according to this embodiment will be described with reference to FIGS. 20 and 21.

As illustrated in FIG. 21, a distance D between the k-th organic light emitting element 31 and the (k+1)-th organic light emitting element 31 is a length D of the isolation portion 46 at the boundary surface between the isolation portion 46 and the anode electrode 43.

The (k−1)-th, the k-th, and the (k+1)-th organic light emitting elements 31 are three organic light emitting elements 31 adjacent to each other in the scanning direction. The k-th organic light emitting element 31 is an arbitrary organic light emitting element 31. The k-th organic light emitting element 31 is connected to the n-th scan signal line Yn and the application signal line Yn_r. The (k+1)-th organic light emitting element 31 is connected to the (n+1)-th scan signal line Yn+1 and the application signal line Yn+1_r.

The anode electrode 43 of the k-th organic light emitting element 31 is blocked from the other circuits from time t4 to time t20. However, organic light emitting elements 31 adjacent to each other are connected through the common layer 47. While not illustrated in the timing diagram, the (k−1)-th organic light emitting element 31 that is adjacent to the opposite side is in the non-emission state and is blocked from the other circuits other than a time when the (k−1)-th organic light emitting element 31 is connected to the application output line Xm.

Black circles represent negative charge, in other words, electrons stored at the anode electrode 43 side of the k-th organic light emitting element 31. As described above, the electrons are stored by a capacitor that is configured by the anode electrode 43, the cathode electrode 19, and a layer of an organic film interposed therebetween.

During an emission period of the (k+1)-th organic light emitting element 31, some of holes supplied from the storage capacitor 99 to the common layer 47 through the anode electrode 43 form a leaking current A and flow into the common layer 47 of the k-th organic light emitting element 31. However, the leaking current A is much smaller than a current flowing through the organic light emitting element 31. For this reason, the influence of the leaking current A at the emission state of the organic light emitting element 31 can be nearly ignored.

As described above, after the electric potential of the application power Vref is applied to the anode electrode 43 of the k-th organic light emitting element 31 between time t1 to time t2, the anode electrode is blocked from the other circuits. As described with reference to FIG. 5, the organic light emitting element 31 has a structure in which a layer of a plurality of organic films is interposed between the anode electrode 43 and the cathode electrode 19. Accordingly, in a case where the organic light emitting element is blocked from the other circuits, similar to a capacitor, the organic light emitting element has a characteristic of maintaining electric charge and an electric potential difference. In description presented below, the static capacitance of a case where the organic light emitting element 31 is regarded as a capacitor will be described as internal capacitance.

As illustrated in FIG. 20, at time t2, the electric potential Vk of the anode electrode 43 of the k-th organic light emitting element 31, for example, is less than that of the negative power supply VSS that is the electric potential of the cathode electrode 19. Accordingly, the anode electrode 43 of the k-th organic light emitting element 31 maintains electrons. The amount of electrons maintained by the anode electrode 43 is in proportion to an electric potential difference between the anode electrode 43 and the cathode electrode 19 and the internal capacitance of the organic light emitting element 31.

The holes flowing into the common layer 47 in accordance with the leaking current A recombine with the electrons maintained in the anode electrode 43 and disappear. For this reason, the holes flowing into the common layer 47 in accordance with the leaking current A do not arrive at the light emitting layer 44. In other words, reverse bias maintained at the anode electrode 43 cancels the leaking current. Accordingly, a crosstalk in which the k-th organic light emitting element 31 emits light in accordance with a leaking current does not occur.

In the k-th organic light emitting element 31, the holes flowing into the anode electrode 43 in accordance with the leaking current A disappear over time t2 to time t21. According to the disappearance of the holes, as illustrated in FIG. 20, the electric potential Vk of the anode electrode 43 of the k-th organic light emitting element 31 gradually rises. However, since the electric potential Vk of the anode electrode 43 of the k-th organic light emitting element 31 is maintained to be less than that of the negative voltage VSS, there is no emission according to the flow of holes into the light emitting layer 44.

As described above, the k-th organic light emitting element 31 has internal capacitance to maintain an electric potential difference between the anode electrode 43 and the cathode electrode 19 at a value not causing the organic light emitting element 31 to emit light, for a period in which the display unit displays one screen. In other words, the period is equivalent to a vertical scanning period in which a displayed image to be refreshed.

That is to say, the internal capacitance of the organic light emitting element 31 maintains the electric potential to satisfy Equation (1), for the vertical scanning period when the organic light emitting element 31 does not emit.

[Numerical Expression 1]

$$V_{anode}-V_{cathode}\leq V_{oledth} \quad (1)$$

$V_{anode}$ is an electric potential of the anode electrode.

$V_{cathode}$ is an electric potential of the cathode electrode.

$V_{oledth}$ is the threshold voltage of the organic light emitting element.

In order to suppress the influence of the leaking current of the common layer, while the electric potential of the application power Vref is preferably the electric potential of the cathode electrode or less, in a case where a condition is satisfied, does not necessarily need to be the electric potential of the cathode electrode or less but may be a voltage that is at least the threshold of the organic light emitting element or less.

The display device 10 according to this embodiment includes a display unit 30, a control unit, and an application unit 15. Here, the control unit, for example, is a driver IC 18.

The display unit 30 includes a plurality of pixel circuits 13 each including both an organic light emitting element 31 and a control element. The organic light emitting element 31 includes a light emitting layer 44 that emits light by a current flowing between the anode electrode 43 and the cathode electrode 19. The control element controls the current. For example, the control element is a driving TFT 27.

The driver IC 18 applies electric potential according to an image signal to the pixel circuit 13 for a first period, and that controls the emission luminance of the organic light emitting element 31 through the driving TFT 27 based on the applied electric potential for a second period after the first period. The organic light emitting element 31 transits to an emission state or a non-emission state in accordance with the applied electric potential described above during the second period. Generally, the second period is called a light emission period.

The first period is a period before the light emission period. The first period is called a data voltage writing period. A data voltage is electric potential (in other words, a voltage) according to an image signal. For example, the driver IC 18 determines the data voltage.

The application unit 15, before the start of the second period, applies a voltage of less than or equal to the threshold voltage of the organic light emitting element 31 to the anode electrode 43. According to this applied voltage (also referred to as a bias voltage), light emission (also referred to as a crosstalk) of the organic light emitting element 31 according to a leaking current is prevented.

The organic light emitting element 31 has internal capacitance to maintain an electric potential difference between the anode electrode 43, the electric potential of which is applied by the application unit, and the cathode electrode 19 at a voltage of less than or equal to the threshold voltage, for a vertical scanning period in which a displayed image to be refreshed when the control unit controls the organic light emitting element not to emit light. More specifically, in a case where the organic light emitting element 31 is in the non-emission state under the control of the driver IC 18, the internal capacitance of the organic light emitting element 31 causes the electric potential difference to be a predetermined value or more. Here, the electric potential difference is an electric potential difference applied by the application unit 15.

The period in which one screen is displayed, for example, is 1/30 seconds or 1/60 seconds but is not limited thereto. The internal capacitance, for example, is Coled described in the following embodiment.

According to this embodiment, the OLED display device 10 preventing an occurrence of a crosstalk using a simple structure can be provided.

In this embodiment, a case has been described as an example in which an OLED display panel of a top emission type emits light to a face disposed at the opposite side of the wiring portion 41 is used for the display device 10. However, an OLED display panel of a bottom emission type emitting light to the wiring portion 41 side may be used for the display device 10.

The shape of the organic light emitting element 31 is not limited to that illustrated in FIG. 4. For example, the shape of the first-color organic light emitting element 311 may be a rectangle. In a case where the first-color organic light emitting element 311 has a rectangular shape, the TFT circuit output connecting portion 42 and the first-color organic light emitting element 311 are preferably configured not to overlap with each other by changing the wiring of the wiring portion 41. As the shape of the first-color organic light emitting element 311, one of various shapes may be employed. For example, the shape of the first-color organic light emitting element 311 has a shape having at least four sides. Here, the shape having at least four sides, for example, is a quadrangle. In addition, the shape having at least four sides, for example, is a shape acquired by rounding the corners of the quadrature. Furthermore, the shape of the first-color organic light emitting element 311 may be an oval or an ellipse. In addition, the shape of the first-color organic light emitting element 311 may be a circular shape in which the TFT circuit output connecting portion 42 is arranged at the center.

As the shape of each of the second-color organic light emitting element 312 and the third-color organic light emitting element 313, one of various shapes may be employed. For example, the shape of each of the second-color organic light emitting element 312 and the third-color organic light emitting element 313 has a shape having at least four sides. Here, the shape having at least four sides, for example, is a quadrangle. In addition, the shape having at least four sides, for example, is a shape acquired by rounding the corners of the quadrature. Furthermore, the shape of each of the second-color organic light emitting element 312 and the third-color organic light emitting element 313 may be an oval or an ellipse. In addition, the dimension and the shape of the second-color organic light emitting element 312 may be different from those of the third-color organic light emitting element 313.

The display unit 30 may have a longitudinal rectangular shape that is longer in the horizontal direction than in the vertical direction. The display unit 30 may have a square shape.

In the display unit 30, organic light emitting elements 31 of only one color may be arranged. For example, by arranging only white organic light emitting elements 31 in the display unit 30, a monochrome display device 10 may be realized. In addition, in the display unit 30, organic light emitting elements 31 of four or more colors may be arranged.

By causing the whole display unit 30 to emit light in an arbitrary color white or other, the display device 10 can be used as an organic light emitting device for lighting.

Embodiment 2

Figure 22:
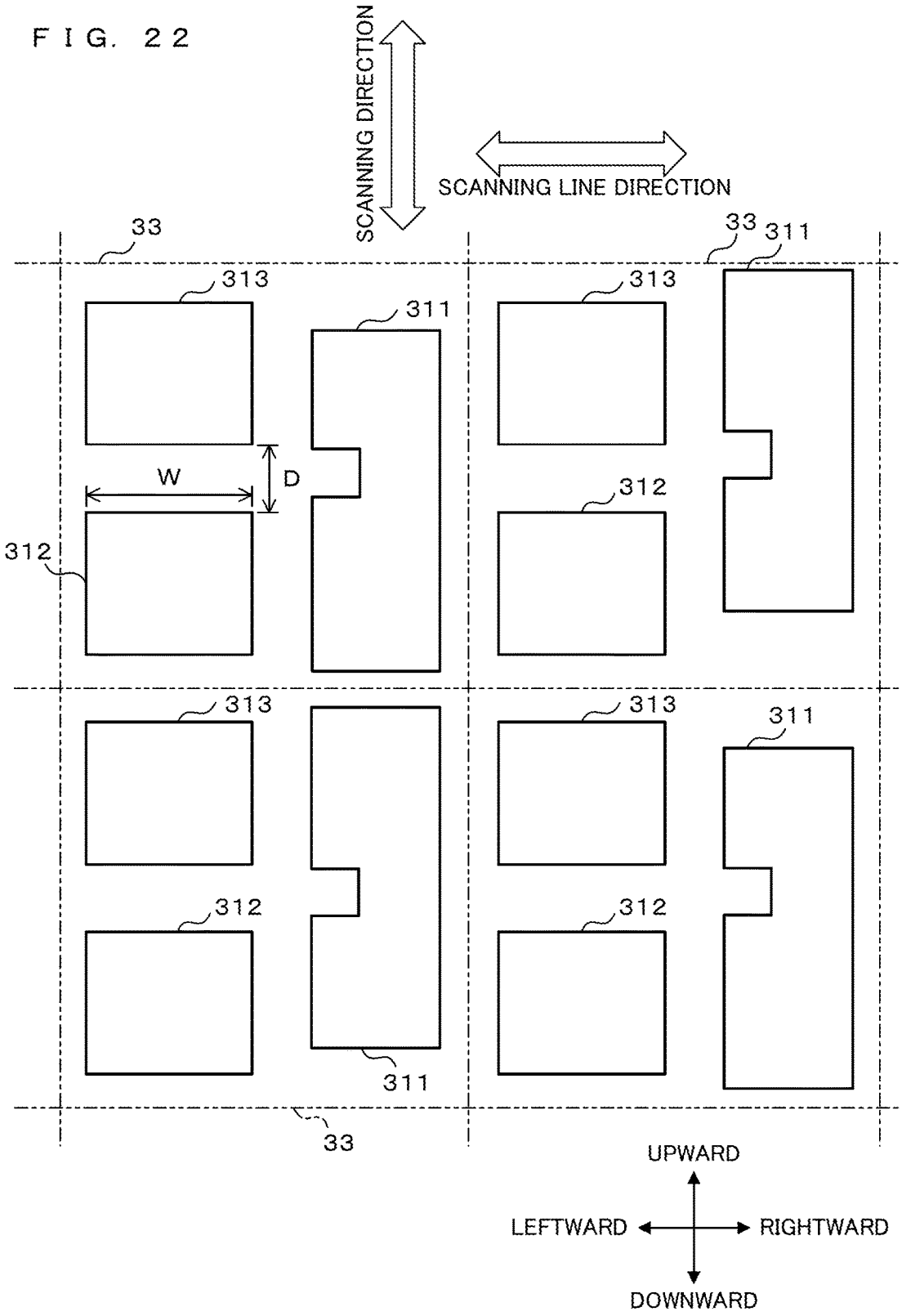
FIG. 22 is an explanatory diagram that illustrates the arrangement of organic light emitting elements according to Embodiment 2.

This embodiment relates to a display device 10 regulating dimensions between two organic light emitting elements 31 adjacent to each other. FIG. 22 is an explanatory diagram that illustrates the arrangement of organic light emitting elements 31 according to Embodiment 2. The display device 10 according to this embodiment will be described with reference to FIG. 22. Description of parts that are common to Embodiment 1 will not be presented.

The length of a portion of the upper side of a second-color organic light emitting element 312 that faces the lower side of a third-color organic light emitting element 313 is W. A distance between the upper side of the second-color organic light emitting element 312 and the lower side of the third-color organic light emitting element 313 is D. Here, W is also called an opening width, an opening length, or an emission width. In addition, D is also called an interval between pixels adjacent to each other or a distance between pixels adjacent to each other.

Depending on device characteristics and manufacturing conditions at the time of manufacturing an isolation portion 46, the edge of a hole of the isolation portion 46 has a shape that is obliquely open to the front side. In the case of such a shape, at a boundary surface between the isolation portion 46 and an anode electrode 43, a length of a portion of the upper side of a second-color organic light emitting element 312 that faces the lower side of a third-color organic light emitting element 313 is W. In addition, at a boundary surface between the isolation portion 46 and an anode electrode 43, a distance between the upper side of the second-color organic light emitting element 312 and the lower side of the third-color organic light emitting element 313 is D.

While not illustrated in the drawing, the thickness of a common layer 47 is T. In a case where the thickness of the common layer 47 is not uniform, the thickness T is defined by an average thickness of the common layer 47 interposed between the upper side of the second-color organic light emitting element 312 and the lower side of the third-color organic light emitting element 313.

A display unit 30 according to this embodiment satisfies Equation (2).

[Numerical Expression 2]

$$\frac{\rho \times D \times Coled}{T \times W} > Fr \tag{2}$$

Here, ρ is the resistivity of the common layer 47. The "resistivity" here means "electrical resistivity" and is also called "specific resistance." In this embodiment, ρ is the resistivity in the lateral direction, which may also be called "lateral resistivity."

T is a thickness of the common layer 47 between the second-color organic light emitting element 312 and the third-color organic light emitting element 313 adjacent thereto.

D is a distance between the upper side of the second-color organic light emitting element 312 and the lower side of the third-color organic light emitting element 313.

W is a length of a portion in which the upper side of the second-color organic light emitting element 312 and the lower side of the third-color organic light emitting element 313 face each other.

Coled is internal capacitance of the second-color organic light emitting element 312.

Fr is a vertical scanning period in which the displayed image to be refreshed.

In description presented below, the period Fr in which the display unit 30 displays one screen will be referred to as one frame. According to Equation (2), a product of a leak resistance value, which is a resistance value of a portion of the common layer 47 that is inside an area interposed between the upper side of the second-color organic light emitting element 312 and the lower side of the third-color organic light emitting element 313, and the internal capacitance of the second-color organic light emitting element 312 is less than one frame. In other words, the internal capacitance of the second-color organic light emitting element 312 is larger than a value acquired by dividing the period Fr by a resistance value of the common layer 47 between the second-color organic light emitting element 312 and the third-color organic light emitting element 313 adjacent to the second-color organic light emitting element 312.

Accordingly, during one frame in which the second-color organic light emitting element 312 is in the non-emission state, the electric potential of the anode electrode 43 of the second-color organic light emitting element 312 that rises according to a leaking current between the two organic light emitting elements 31 is maintained to be equal or less than that of the negative power supply VSS. For this reason, the occurrence of a crosstalk can be prevented.

According to this embodiment, by designing the organic light emitting elements 31 to satisfy Equation (2), the display device 10 preventing a crosstalk can be provided.

In this embodiment, it is preferable that the second-color organic light emitting element 312 is a green organic light emitting element 31. The reason for this will be described. In a case where the organic light emitting elements 31 of three colors including red, green, and blue are compared with each other, the green organic light emitting element 31 emits light at an electric potential difference Vgs less than those of the organic light emitting elements 31 of the other colors. Furthermore, since green has high visual sensitivity, also for light emission according to a weak crosstalk, a user is sensitive in the case of low image quality. Accordingly, by preventing only an occurrence of a crosstalk of the green organic light emitting element 31, degradation of image quality of the display device 10 according to a crosstalk can be prevented.

In this embodiment, the prevention of a crosstalk of the second-color organic light emitting element 312 according to a leaking current flowing from the third-color organic light emitting element 313 has been described. Also in the case of preventing a crosstalk of the third-color organic light emitting element 313 according to a leaking current flowing from the second-color organic light emitting element 312, a similar equation can be used.

In a case where ρ, D, T, and W represented in Equation (2) are different for each side of the organic light emitting element 31, it is preferable that the display unit 30 according to this embodiment satisfies Equation (3).

[Numerical Expression 3]

$$\min\left(\frac{\rho n \times Dn}{Tn \times Wn}\right) \times Coled > Fr \tag{3}$$

Here, n is an integer of one to four.

ρ n is resistivity of the common layer 47 between an n-th side of the organic light emitting element 31 and an organic light emitting element 31 adjacent to the n-th side.

Tn is a thickness of the common layer 47 between the n-th side of the organic light emitting element 31 and the organic light emitting element 31 adjacent to the n-th side.

Dn is a distance between the n-th side of the organic light emitting element 31 and the organic light emitting element 31 adjacent to the n-th side.

Wn is a length of a portion in which the n-th side of the organic light emitting element 31 and the side of the organic light emitting element 31 adjacent to the n-th face each other.

Coled is internal capacitance of the organic light emitting element 31.

Fr is a vertical scanning period in which the displayed image to be refreshed.

Embodiment 3

Figure 23:
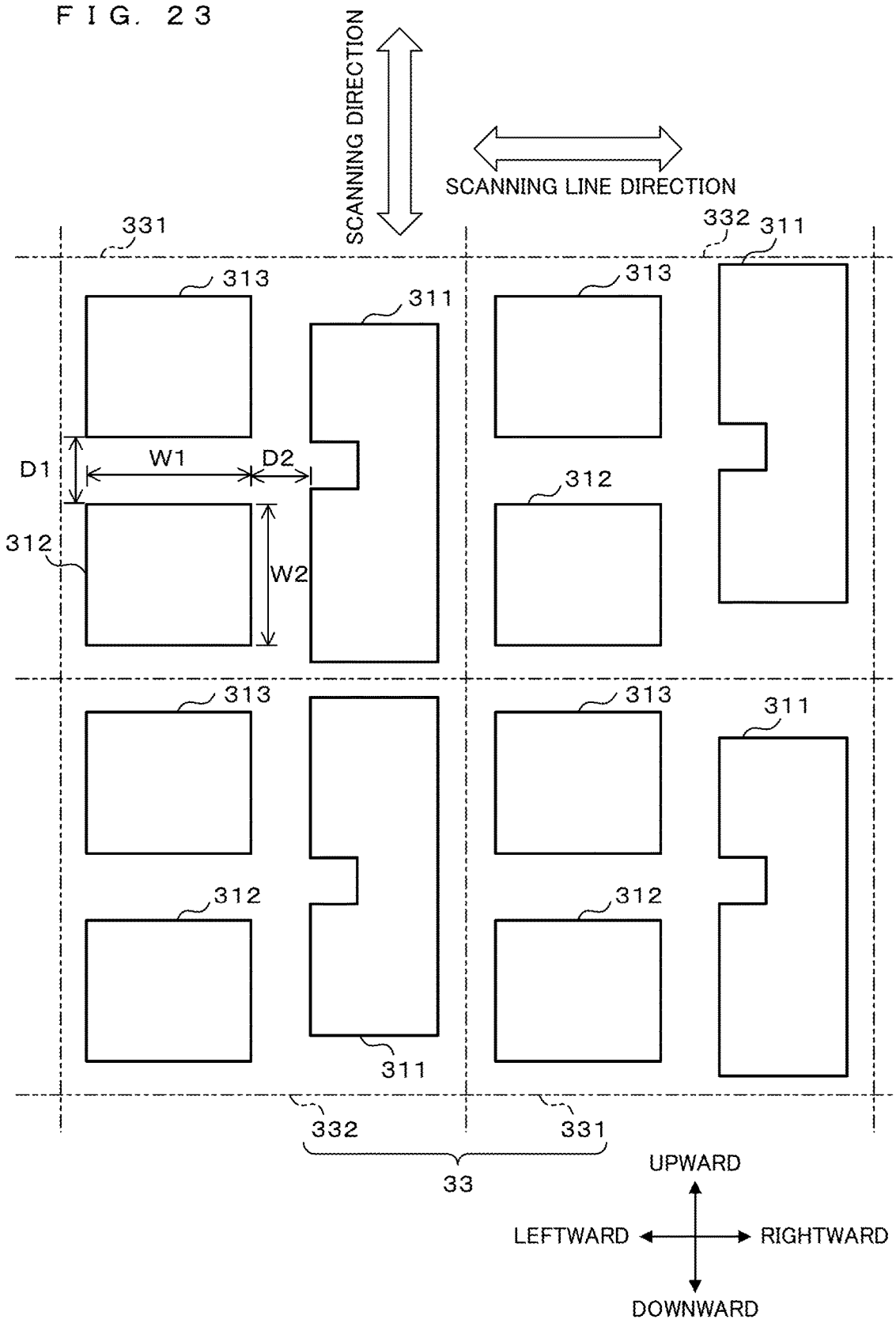
FIG. 23 is an explanatory diagram that illustrates the arrangement of organic light emitting elements according to Embodiment 3.

This embodiment relates to a display device 10 regulating dimensions between three organic light emitting elements 31 included within one pixel 33. FIG. 23 is an explanatory diagram that illustrates the arrangement of organic light emitting elements 31 according to Embodiment 3. The display device 10 according to this embodiment will be described with reference to FIG. 23. Description of parts that are common to Embodiment 2 will not be presented.

FIG. 23 illustrates four pixels 33. Among the pixels 33, there are two types of pixels including a first pixel 331 in which a first-color organic light emitting element 311 comes near the lower side and a second pixel 332 in which the first-color organic light emitting element 311 comes near the upper side. A length of a portion in which the right side of the first-color organic light emitting element 311 and the left side of the second-color organic light emitting element 312 face each other is longer in the first pixel 331. In this embodiment, dimensions among three organic light emitting elements 31 included in the first pixel 331 are regulated.

The length of a portion of the upper side of a second-color organic light emitting element 312 that faces the lower side of a third-color organic light emitting element 313 is W1. A distance between the upper side of the second-color organic light emitting element 312 and the lower side of the third-color organic light emitting element 313 is D1. While not illustrated in the drawing, a thickness of a common layer 47 inside an area interposed between the upper side of the second-color organic light emitting element 312 and the lower side of the third-color organic light emitting element 313 is T1, and resistivity of the common layer 47 of this portion is ρ1.

A length of a portion of the right side of the second-color organic light emitting element 312 that faces the left side of the first-color organic light emitting element 311 is W2. A distance between the right side of the second-color organic light emitting element 312 and the left side of the first-color organic light emitting element 311 is D2. While not illustrated in the drawing, a thickness of the common layer 47 inside an area interposed between the right side of the second-color organic light emitting element 312 and the left side of the first-color organic light emitting element 311 is T2, and resistivity of the common layer 47 of this portion is ρ2.

A display unit 30 according to this embodiment satisfies Equation (4).

[Numerical Expression 4]

$$\frac{1}{\frac{1}{\left(\frac{\rho 1 \times D1}{T1 \times W1}\right)} + \frac{1}{\left(\frac{\rho 2 \times D2}{T2 \times W2}\right)}} \times Coled > Fr \tag{4}$$

ρ1 is resistivity of the common layer 47 between the upper side of the second-color organic light emitting element 312 and the lower side of the third-color organic light emitting element 313.

T1 is a thickness of the common layer 47 between the upper side of the second-color organic light emitting element 312 and the lower side of the third-color organic light emitting element 313.

D1 is a distance between the upper side of the second-color organic light emitting element 312 and the lower side of the third-color organic light emitting element 313.

W1 is a length of a portion in which the upper side of the second-color organic light emitting element 312 and the lower side of the third-color organic light emitting element 313 face each other.

Coled is internal capacitance of the second-color organic light emitting element 312.

ρ2 is resistivity of the common layer 47 between the right side of the second-color organic light emitting element 312 and the first-color organic light emitting element 311.

T2 is a thickness of the common layer 47 between the right side of the second-color organic light emitting element 312 and the first-color organic light emitting element 311.

D2 is a distance between the right side of the second-color organic light emitting element 312 and the left side of the first-color organic light emitting element 311.

W2 is a length of a portion in which the right side of the second-color organic light emitting element 312 and the left side of the first-color organic light emitting element 311 face each other.

Fr is a vertical scanning period in which the displayed image to be refreshed.

According to Equation (4), a product of a leak resistance value, which is acquired by combining through a parallel connection of a resistance value of a portion of the common layer 47 that is inside an area interposed between the upper side of the second-color organic light emitting element 312 and the lower side of the third-color organic light emitting element 313 and a resistance value of a portion inside an area interposed between the right side of the second-color organic light emitting element 312 and the left side of the first-color organic light emitting element 311, and the internal capacitance of the second-color organic light emitting element 312 is less than one frame. Accordingly, during one frame in which the second-color organic light emitting element 312 is in the non-emission state, the electric potential of the anode electrode 43 of the second-color organic light emitting element 312 that rises according to a leaking current from the first-color organic light emitting element 311 and the third-color organic light emitting element 313 is maintained to be that of the negative power supply VSS or less. For this reason, the occurrence of a crosstalk can be prevented.

According to this embodiment, by designing the organic light emitting elements 31 to satisfy Equation (4), the display device 10 preventing a crosstalk caused by two organic light emitting elements 31 adjacent to each other can be provided.

In this embodiment, the prevention of a crosstalk of the second-color organic light emitting element 312 according to a leaking current flowing from two different organic light emitting elements 31 inside the same pixel 33 has been described. Also for the prevention of a crosstalk of the first-color organic light emitting element 311 and the prevention of a crosstalk of the third-color organic light emitting element 313, a similar equation can be used.

Embodiment 4

Figure 24:
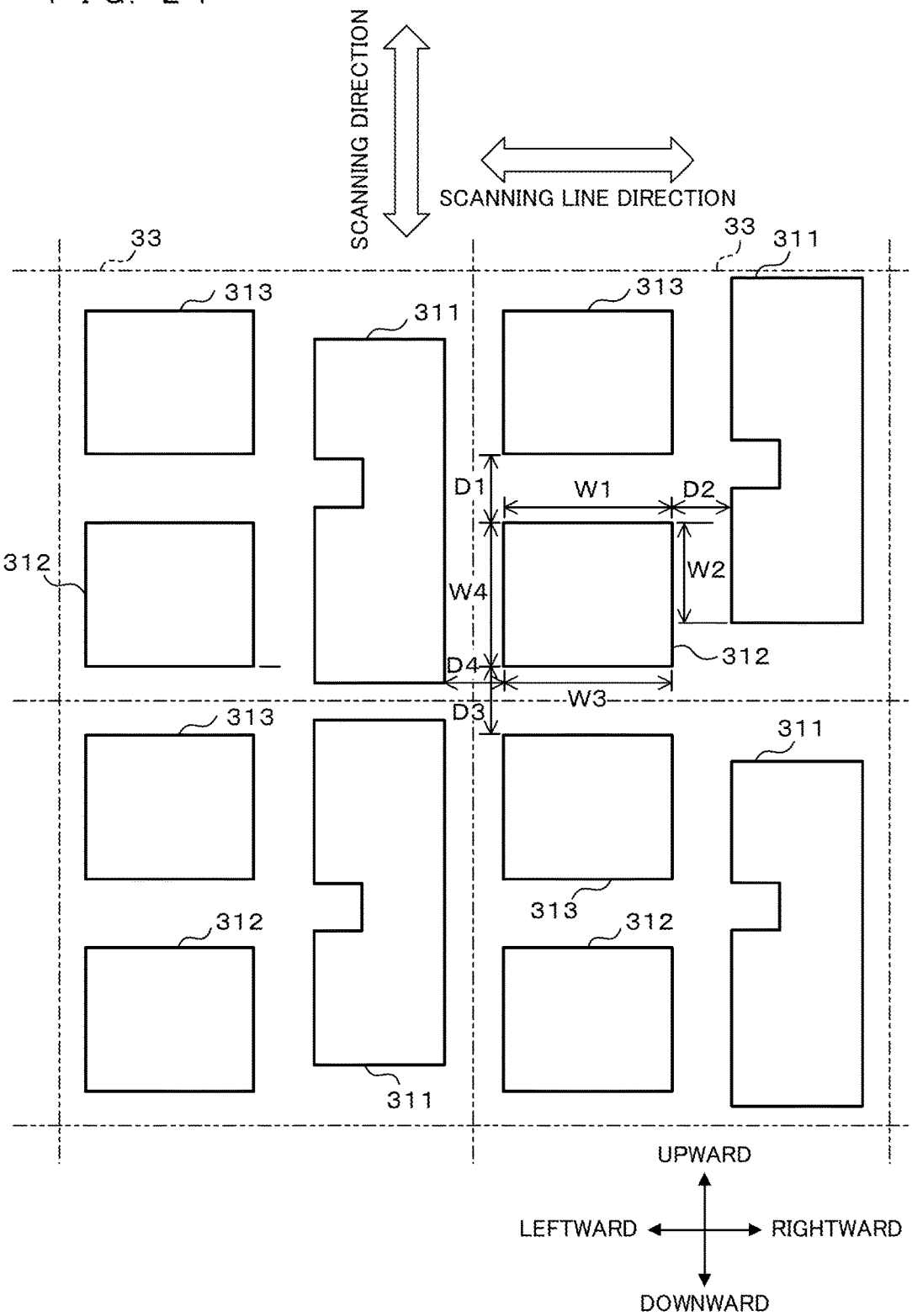
FIG. 24 is an explanatory diagram that illustrates the arrangement of organic light emitting elements according to Embodiment 4.

This embodiment relates to a display device 10 regulating dimensions among organic light emitting elements 31 adjacent to one organic light emitting element 31 at four sides. FIG. 24 is an explanatory diagram that illustrates the arrangement of organic light emitting elements 31 according to Embodiment 4. The display device 10 according to this embodiment will be described with reference to FIG. 24. Description of parts that are common to Embodiment 2 will not be presented.

The length of a portion of the upper side of a second-color organic light emitting element 312 that faces the lower side of a third-color organic light emitting element 313 is W1. A distance between the upper side of the second-color organic light emitting element 312 and the lower side of the third-color organic light emitting element 313 is D1. While not illustrated in the drawing, a thickness of a common layer 47 inside an area interposed between the upper side of the second-color organic light emitting element 312 and the lower side of the third-color organic light emitting element 313 is T1, and resistivity of the common layer 47 of this portion is ρ1.

A length of a portion of the right side of the second-color organic light emitting element 312 that faces the left side of the first-color organic light emitting element 311 is W2. A distance between the right side of the second-color organic light emitting element 312 and the left side of the first-color organic light emitting element 311 is D2. While not illustrated in the drawing, a thickness of the common layer 47 inside an area interposed between the right side of the second-color organic light emitting element 312 and the left side of the first-color organic light emitting element 311 is T2, and resistivity of the common layer 47 of this portion is ρ2.

The length of a portion of the lower side of the second-color organic light emitting element 312 that faces the upper side of the third-color organic light emitting element 313 is W3. A distance between the lower side of the second-color organic light emitting element 312 and the upper side of the third-color organic light emitting element 313 is D3. While not illustrated in the drawing, a thickness of the common layer 47 inside an area interposed between the lower side of the second-color organic light emitting element 312 and the upper side of the third-color organic light emitting element 313 is T3, and resistivity of the common layer 47 of this portion is ρ3.

A length of a portion of the left side of the second-color organic light emitting element 312 that faces the right side of the first-color organic light emitting element 311 is W4. A distance between the left side of the second-color organic light emitting element 312 and the right side of the first-color organic light emitting element 311 is D4. While not illustrated in the drawing, a thickness of the common layer 47 inside an area interposed between the left side of the second-color organic light emitting element 312 and the right side of the first-color organic light emitting element 311 is T4, and resistivity of the common layer 47 of this portion is ρ4.

By generalizing the relation described above, an arrangement preventing a crosstalk of an arbitrary organic light emitting element 31 will be described. In the description presented below, an organic light emitting element 31 of which a crosstalk is to be prevented will be described as a target organic light emitting element 31*t*. A length of a portion of an n-th side of target organic light emitting element 31*t* that faces a side of an adjacent organic light emitting element 31 will be described as Wn. Similarly, a distance between the n-th side of the target organic light emitting element 31*t* and the adjacent organic light emitting element 31 will be described as Dn. A thickness of the common layer 47 inside an area interposed between the n-th side of the target organic light emitting element 31*t* and the adjacent organic light emitting element 31 will be described as Tn, and resistivity of the common layer 47 of this portion will be described as ρn.

A display unit 30 according to this embodiment satisfies Equation (5).

[Numerical Expression 5]

$$\frac{1}{\sum_{n=1}^{M}\frac{1}{\left(\frac{\rho n \times Dn}{Tn \times Wn}\right)}} \times Coled > Fr \quad (5)$$

Here, M is the number of sides of the target organic light emitting element 31*t*.

ρn is resistivity of the common layer 47 between the target organic light emitting element 31*t* and another organic light emitting element 31 adjacent to the n-th side of the target organic light emitting element 31*t*.

Tn is a thickness of the common layer 47 between the target organic light emitting element 31*t* and another organic light emitting element 31 adjacent to the n-th side of the target organic light emitting element 31*t*.

Dn is a distance between the target organic light emitting element 31*t* and another organic light emitting element 31 adjacent to the n-th side of the target organic light emitting element 31*t*.

Wn is a length of a portion in which the n-th side of the target organic light emitting element 31*t* and a side of another organic light emitting element 31 adjacent to the n-th side of the target organic light emitting element 31*t* face each other.

Coled is internal capacitance of the target organic light emitting element 31*t*.

Fr is a vertical scanning period in which the displayed image to be refreshed.

According to this embodiment, by designing the organic light emitting elements 31 to satisfy Equation (5), the display device 10 capable of preventing a crosstalk also in a case where all the adjacent organic light emitting elements 31 emit light can be provided.

Embodiment 5

Figure 25:
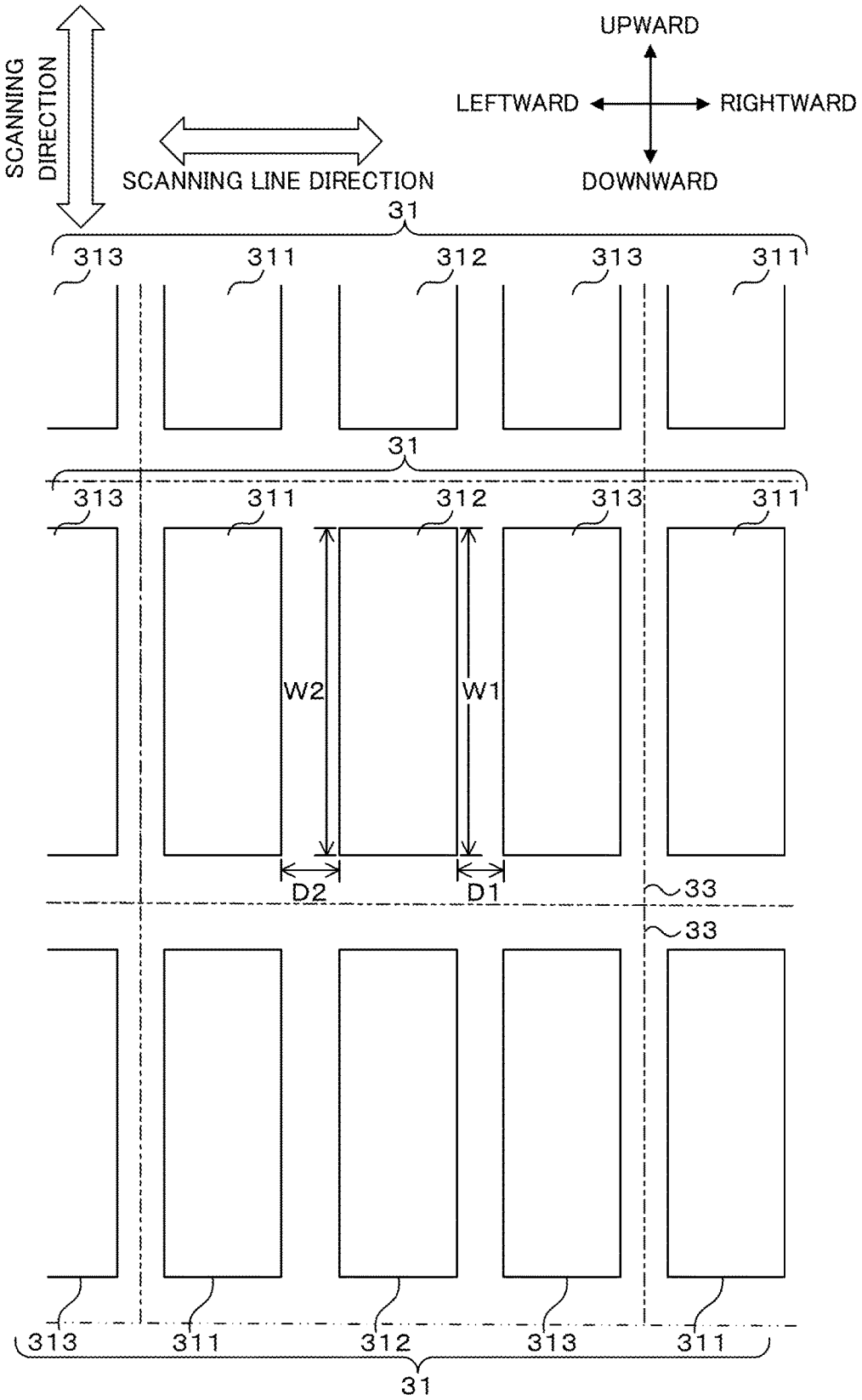
FIG. 25 is an explanatory diagram that illustrates the arrangement of organic light emitting elements according to Embodiment 5.

This embodiment relates to a display device 10 in which rectangular organic light emitting elements 31 are arranged in a matrix pattern. FIG. 25 is an explanatory diagram that illustrates the arrangement of organic light emitting elements 31 according to Embodiment 5. The display device 10 according to this embodiment will be described with reference to FIG. 25. Description of parts that are common to Embodiment 2 will not be presented.

A first-color organic light emitting element 311, a second-color organic light emitting element 312, and a third-color organic light emitting element 313 are rectangles of a same size having long sides in the vertical direction and having short sides in the horizontal direction. A set of three organic light emitting elements 31 form a pixel 33 denoted by two-dot chain lines. In the vertical direction, organic light emitting elements 31 of a same color are arranged.

The length of a portion of the right side, which is a first long side, of a second-color organic light emitting element 312 that faces the left side of a third-color organic light emitting element 313 is W1. A distance between the right side, which is the first long side, of the second-color organic light emitting element 312 and the left side of the third-color organic light emitting element 313 is D1. While not illustrated in the drawing, a thickness of a common layer 47 inside an area interposed between the right side, which is the first long side, of the second-color organic light emitting element 312 and the left side of the third-color organic light emitting element 313 is T1, and resistivity of the common layer 47 of this portion is ρ1.

A length of a portion of the left side, which is a second long side, of the second-color organic light emitting element 312 that faces the right side of the first-color organic light emitting element 311 is W2. A distance between the left side, which is a second long side, of the second-color organic light emitting element 312 and the right side of the first-color organic light emitting element 311 is D2. While not illustrated in the drawing, a thickness of the common layer 47 inside an area interposed between the left side, which is the second long side, of the second-color organic light emitting element 312 and the right side of the first-color organic light emitting element 311 is T2, and resistivity of the common layer 47 of this portion is ρ2.

A display unit 30 according to this embodiment satisfies Equation (6).

[Numerical Expression 6]

$$\frac{1}{\sum_{n=1}^{2}\frac{1}{\left(\frac{\rho n \times Dn}{Tn \times Wn}\right)}} \times Coled > Fr \quad (6)$$

ρn is resistivity of the common layer 47 between an organic light emitting element 31 and another organic light emitting element 31 adjacent to the n-th long side of the organic light emitting element 31.

Tn is a thickness of the common layer 47 between the organic light emitting element 31 and another organic light emitting element 31 adjacent to the n-th long side of the target organic light emitting element 31.

Dn is a distance between the organic light emitting element 31 and another organic light emitting element 31 adjacent to the n-th long side of the organic light emitting element 31.

Wn is a length of a portion in which the n-th long side of the organic light emitting element 31 and a side of another organic light emitting element 31 adjacent to the n-th long side of the target organic light emitting element 31 face each other.

Coled is internal capacitance of the organic light emitting element 31.

Fr is a vertical scanning period in which the displayed image to be refreshed.

In FIG. 25, while the length W1 and the length W2 are the same, in order to clearly discriminate the lengths W1 and W2 in Equation (6) from each other, different signs are illustrated as being assigned to the same length.

In this embodiment, the influence of a current leaking in the horizontal direction is focused, but the influence of a current leaking in the vertical direction is not considered. Currents leaking in the horizontal direction, in a case where the second-color organic light emitting element 312 is focused, include a leaking current flowing from the first-color organic light emitting element 311 to the second-color organic light emitting element 312 and a leaking current flowing from the third-color organic light emitting element 313 to the second-color organic light emitting element 312. In addition, currents leaking in the vertical direction, in a case where the second-color organic light emitting element 312 is focused include currents leaking from two second-color organic light emitting elements 312 positioned in the vertical direction.

In this way, the reason for not considering the current leaking in the vertical direction is that a distance X between two second-color organic light emitting elements 312 positioned in the vertical direction is longer than the distances D1 and D2. In other words, the distance X is a distance between common layers 47 of one second-color organic light emitting element 312 and another second-color organic light emitting element 312 positioned in the vertical direction.

According to this embodiment, a crosstalk of the display device 10 having a simple structure in which organic light emitting elements 31 are arranged in a matrix pattern can be prevented.

Embodiment 6

Figure 26:
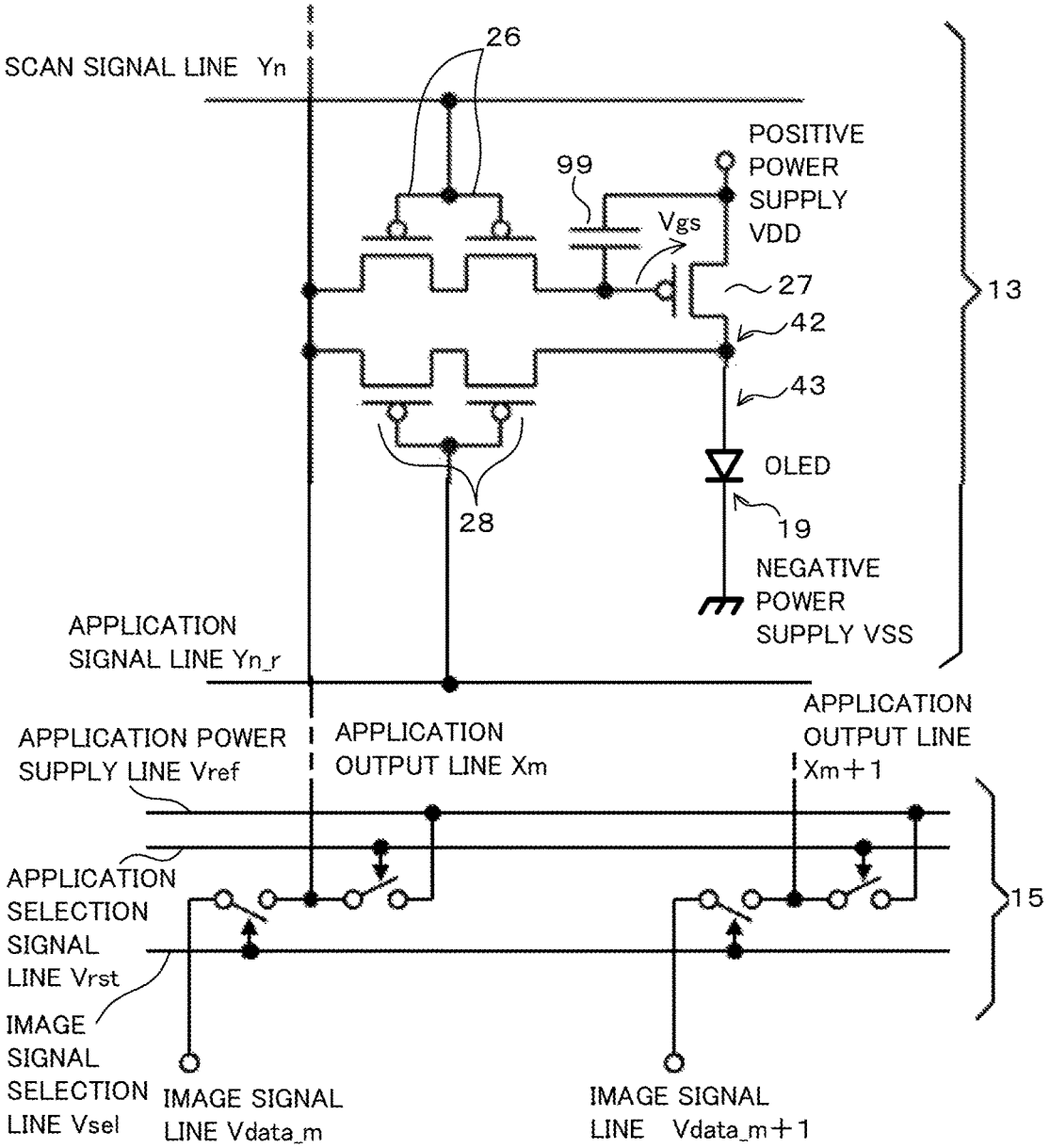
FIG. 26 is a circuit diagram that illustrates a circuit causing one organic light emitting element of Embodiment 6 to emit light.

This embodiment relates to a display device 10 using dual gate FETs for a switching TFT 26 and an application TFT 28. FIG. 26 is a circuit diagram that illustrates a circuit causing one organic light emitting element 31 of Embodiment 6 to emit light. The display device 10 according to this embodiment will be described with reference to FIG. 26. Description for parts common to Embodiment 1 will not be presented.

The switching TFT 26 and the application TFT 28 are dual gate FETs each having two gate electrodes. A positive power supply VDD, a negative power supply VSS, an n-th scan signal line Yn, an n-th application signal line Yn_r, and an application output line Xm are connected to the pixel circuit 13.

The positive power supply VDD is connected to a first electrode of a storage capacitor 99 and a source electrode of a driving TFT 27. The negative power supply VSS is connected to a cathode electrode 19 of the organic light emitting element 31. The scan signal line Yn is connected to two gate electrodes of the switching TFT 26. The application signal line Yn_r is connected to two gate electrodes of the application TFT 28. The application output line Xm is connected to source electrodes of the switching TFT 26 and the application TFT 28.

A drain electrode of the switching TFT 26 is connected to a second electrode of a storage capacitor C1 and a gate electrode of the driving TFT 27. The drain electrode of the driving TFT 27 is connected to an anode electrode 43 of the organic light emitting element 31 and a drain electrode of the application TFT 28 through a TFT circuit output connecting portion 42.

According to the configuration as above, the switching TFT 26 and the application TFT 28 operate similarly to the switching TFT 26 and the application TFT 28 according to Embodiment 1. By using the dual gate FETs for the switching TFT 26 and the application TFT 28, a high-frequency input signal can be reflected on the luminance of the organic light emitting element 31 more accurately than Embodiment 1.

According to this embodiment, the display device 10 that is appropriate for displaying a high-definition image signal of a high vision, 4K, 8K, or the like can be provided.

Embodiment 7

Figure 27:
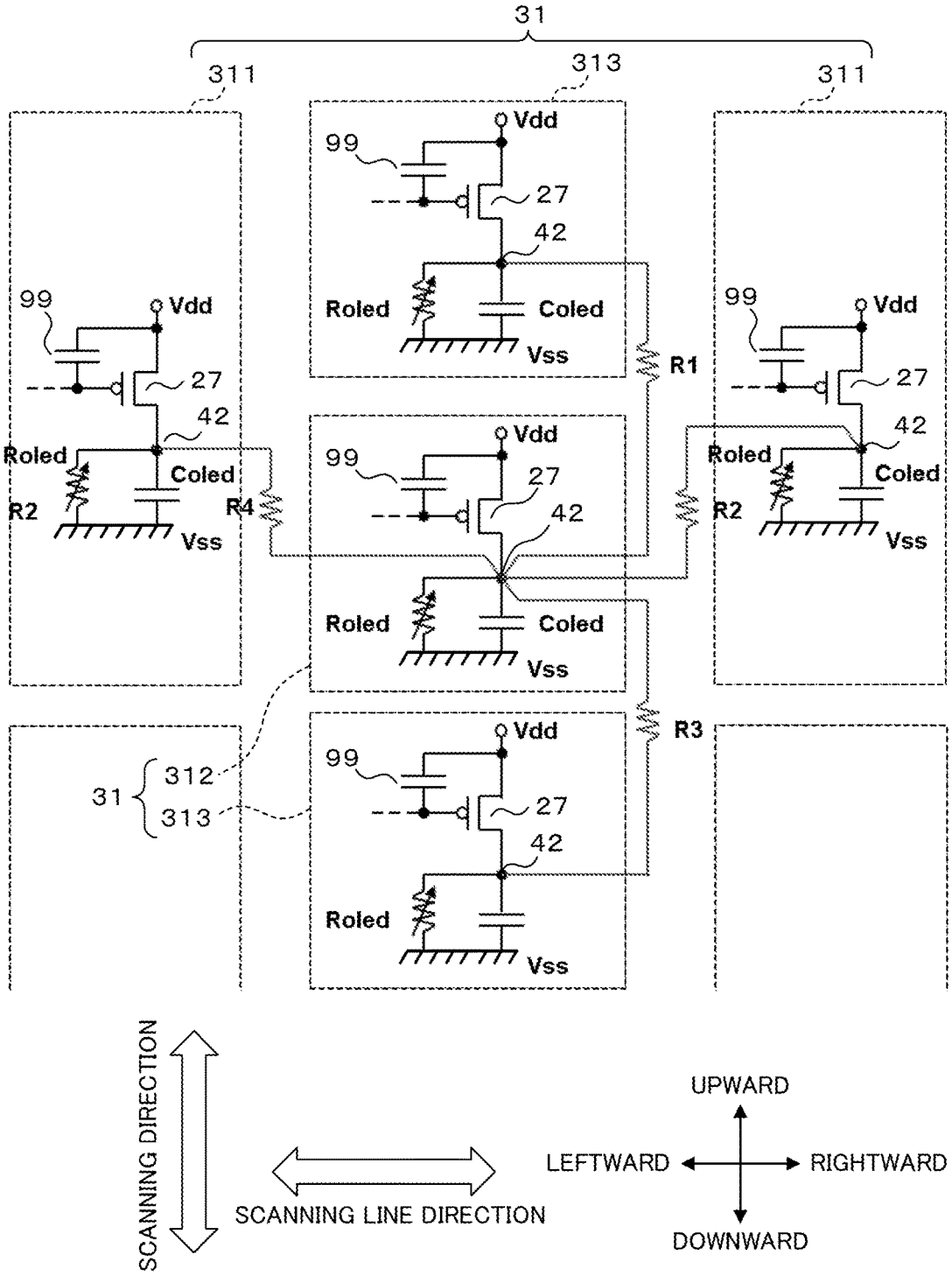
FIG. 27 is a circuit diagram that illustrates a circuit causing one organic light emitting element of Embodiment 7 to emit light.

This embodiment relates to a display device 10 representing each organic light emitting element 31 using internal capacitance and a variable resistance value. FIG. 27 is a circuit diagram that illustrates a circuit causing one organic light emitting element 31 of Embodiment 7 to emit light. Description of parts that are common to Embodiment 1 will not be presented.

In FIG. 27, the organic light emitting element 31 is represented as internal capacitance Coled and Roled connected in parallel. A switching FET 26, an application FET 28, an application unit 15, and each signal line connected to the organic light emitting element 31 are not illustrated in FIG. 27.

A structure preventing a crosstalk of a second-color organic light emitting element 312 will be described as an example. R1 is a resistance value between a TFT circuit output connecting portion 42 of the second-color organic light emitting element 312 and a TFT circuit output connecting portion 42 of a third-color organic light emitting element 313 adjacent thereto at the upper side. R2 is a resistance value between the TFT circuit output connecting portion 42 of the second-color organic light emitting element 312 and a TFT circuit output connecting portion 42 of a first-color organic light emitting element 311 adjacent thereto at the right side. R3 is a resistance value between the TFT circuit output connecting portion 42 of the second-color organic light emitting element 312 and the TFT circuit output connecting portion 42 of a third-color organic light emitting element 313 adjacent thereto at the lower side. R4 is a resistance value between the TFT circuit output connecting portion 42 of the second-color organic light emitting element 312 and the TFT circuit output connecting portion 42 of a first-color organic light emitting element 311 adjacent thereto at the left side.

The display unit 30 according to this embodiment satisfies Equation (7). In description described below, an organic light emitting element 31 of which a crosstalk is to be prevented will be described as a target organic light emitting element 31*t*.

[Numerical Expression 7]

$$R \times Coled > Fr \tag{7}$$

$$\frac{1}{R} = \sum_{n=1}^{M} \frac{1}{Rn}$$

Here, M is the number of the other organic light emitting elements 31 adjacent to a target organic light emitting element 31*t*.

Coled is internal capacitance of the target organic light emitting element 31*t*.

Fr is a vertical scanning period in which the displayed image to be refreshed.

In Equation (7), R represents a combined resistance value of a case where a resistance value between TFT circuit output connecting portions 42 of organic light emitting elements 31 adjacent to each other are connected in parallel.

In other words, the internal capacitance of the target organic light emitting element 31*t* is larger than a value acquired by dividing the period Fr by a combined resistance value acquired by combining resistance values of the common layer 47 between the target organic light emitting element 31*t* and a plurality of organic light emitting elements 31 adjacent to the target organic light emitting element 31*t*.

According to this embodiment, also in a case where an organic light emitting element 31 having a shape other than a rectangle such as a circle or an oval is used, the display device 10 preventing a crosstalk can be provided.

For example, in a case where organic light emitting elements 31 are arranged in a honeycomb shape, the number of organic light emitting elements 31 adjacent to one organic light emitting element 31 is six. Accordingly, it is preferable to use a resistance value acquired by combining six resistance values as R illustrated in Equation (7).

Embodiment 8

Figure 28:
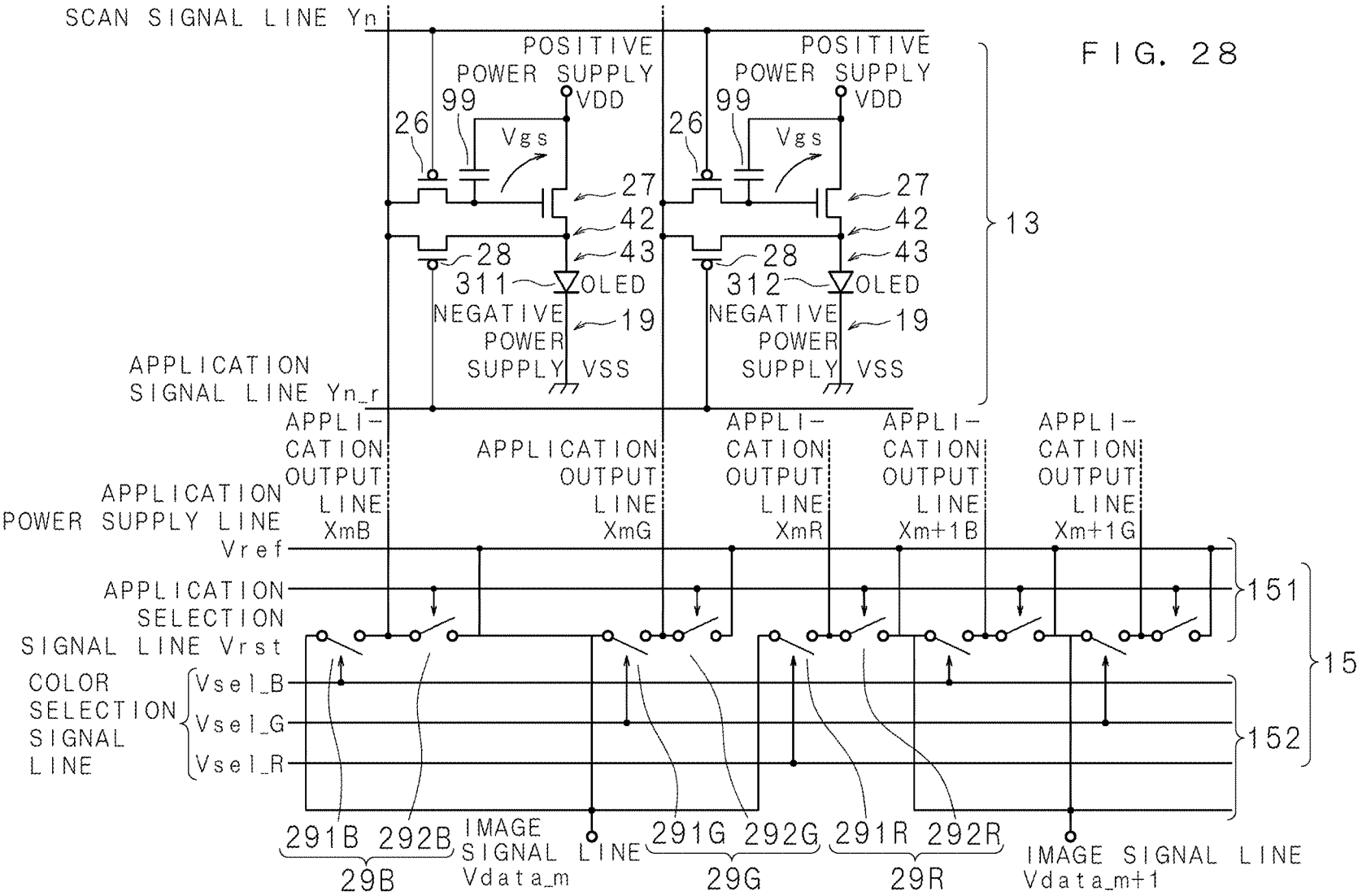
FIG. 28 is a circuit diagram that illustrates a circuit causing one organic light emitting element of Embodiment 8 to emit light.

This embodiment relates to a display device 10 in which an application unit 15 has a function of a multiplexer. FIG. 28 is a circuit diagram that illustrates a circuit causing one organic light emitting element 31 of Embodiment 8 to emit light. The display device 10 according to this embodiment will be described with reference to FIG. 28. Description of parts that are common to Embodiment 1 will not be presented. Similar to Embodiment 1, a same symbol will be used for a signal line and a signal flowing through the signal line.

In FIG. 28, one organic light emitting element 31 will be described by using a symbol of an OLED representing an organic light emitting diode. The circuit illustrated in FIG. 28 includes a pixel circuit 13 and an application unit 15. In FIG. 28, blocks corresponding to two organic light emitting elements 31 included in the pixel circuit 13 are illustrated.

The application unit 15 includes: a switching unit 151; and a demultiplexer unit 152. The switching unit 151 is a circuit that prevents a crosstalk in which an organic light emitting element 31 emits light in accordance with a current leaking from an adjacent organic light emitting element 31. The demultiplexer unit 152 is an example of a distributor that divides a signal representing the luminance of one pixel 33 output from the driver IC 18 into signals representing the luminance of a first-color organic light emitting element 311, a second-color organic light emitting element 312, and a third-color organic light emitting element 313 and distributes the divided signals to the organic light emitting elements 31.

The demultiplexer unit 152 is connected to a first-color selection signal line Vsel_B, a second-color selection signal line Vsel_G, and a third-color selection signal line Vsel_R.

The switching unit 151 includes three sets of switches 29 including a first-color switch 29B, a second-color switch 29G, and a third-color switch 29R. The first-color switch 29B includes two switches 29B including a first switch 291B and a second switch 292B. The second-color switch 29G includes two switches 29G including a first switch 291G and a second switch 292G. The third-color switch 29R includes two switches 29R including a first switch 291R and a second switch 292R. In description presented below, the first switch 291B, the first switch 291G, and the first switch 291R may be described altogether as a first switch 291. Similarly, the second switch 292B, the second switch 292G, and the second switch 292R may be described altogether as a second switch 292.

One end of each of the three first switches 291 is connected to one image signal line Vdata of a driver IC 18. In description presented below, an m-th image signal line Vdata_m will be described as an example. Here, m is an integer of one or more and the number of image signal lines Vdata_m or less. An analog image signal Vdata_m is supplied from the driver IC 18 to the image signal line Vdata_m. In the image signal Vdata_m, image signals of a first color, a second color, and a third color are sequentially included.

Between the first switch 291 and the second switch 292, one of an application output line XmB, an application output line XmG, and an application output line XmR is connected. The application output line XmB is connected to the first-color organic light emitting element 311. The application output line XmG is connected to the second-color organic light emitting element 312. The application output line XmR is connected to the third-color organic light emitting element 313. The other end of the second switch 292 is connected to an application power supply line Vref. In description presented below, the application output line XmB, the application output line XmG, and the application output line XmR may be described altogether as an application output line Xm.

The first switch 291B switches presence/absence of a connection between the application output line XmB and an m-th image signal line Vdata_m. The first switch 291B is controlled according to a color selection signal Vsel_B supplied from the driver IC 18 through the color selection signal line Vsel_B.

The first switch 291G switches presence/absence of a connection between the application output line XmG and the m-th image signal line Vdata_m. The first switch 291G is controlled according to a color selection signal Vsel_G supplied from the driver IC 18 through the color selection signal line Vsel_G.

The first switch 291R switches presence/absence of a connection between the application output line XmR and the m-th image signal line Vdata_m. The first switch 291R is controlled according to a color selection signal Vsel_R supplied from the driver IC 18 through the color selection signal line Vsel_R.

The second switch 292 switches presence/absence of a connection between the application output line XmB, the application output line XmG, or the application output line XmR and the application power supply line Vref. The second switch 292 is controlled according to an application selection signal Vrst supplied from the driver IC 18 through the application selection signal line Vrst.

Figure 29:
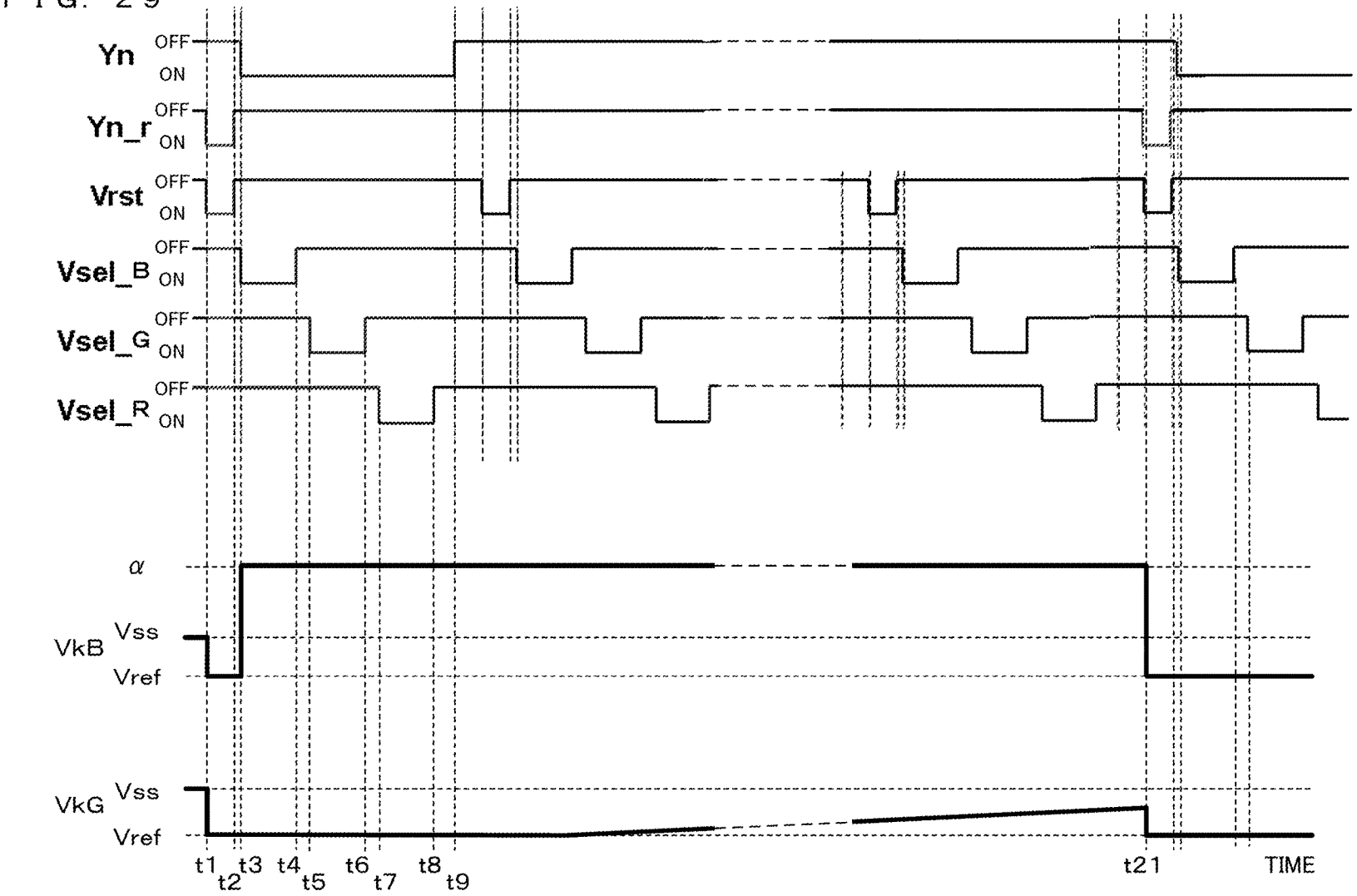
FIG. 29 is a timing diagram that illustrates the operations of a pixel circuit and an application unit according to Embodiment 8.

FIG. 29 is a timing diagram that illustrates the operations of the pixel circuit 13 and the application unit 15 according to Embodiment 8. In FIG. 29, the horizontal axis represents the time. In FIG. 29, upper timing diagrams represent states of an n-th scan signal Yn, an n-th application signal Yn_r, an application selection signal Vrst, a first-color selection signal Vsel_B, a second-color selection signal Vsel_G, and a third-color selection signal Vsel_R. Here, n is an integer of one or more and the number of scan signal lines or less. In the vertical axis of the upper timing diagrams illustrated in FIG. 29, the upper side represents the Off state, and the lower side represents the On state.

The lower timing diagrams illustrated in FIG. 29 illustrate the electric potential VkR of the anode electrode 43 of the k-th first-color organic light emitting element 311 and the electric potential VkG of the anode electrode 43 of the k-th second-color organic light emitting element 312. Here, k is an integer of one or more and a total number of pixels 33 or less. The k-th first-color organic light emitting element 311 and the k-th second-color organic light emitting element 312 are organic light emitting elements 31 included in a same pixel 33 and are connected to a same application output line Xm and a same application selection signal line Vrst. The vertical axis of lower timing diagrams illustrated in FIG. 29 illustrate the electric potential. In the lower timing diagrams illustrated in FIG. 29, the application power Vref and the negative power supply VSS are denoted by broken lines.

Description will be started from a state in which all the n-th scan signal Yn, the n-th application signal Yn_r, the application selection signal Vrst, and the image selection signal Vsel are Off, and the organic light emitting elements 31 included in the k-th pixel 33 do not emit light. In addition, a case will be described as an example in which an image signal Vdata_m representing the emission state of the k-th first-color organic light emitting element 311 and the non-emission state of the k-th second-color organic light emitting element 312 is input.

At time t1, the driver IC 18 sets the n-th application signal Yn_r and the application selection signal Vrst to the On state. In a case where the application selection signal Vrst is in the On state, the second switch 292 connects the application output line Xm to the application power line Vref. In a case where the application signal Yn_r is in the On state, the application TFT 28 of the pixel circuit 13 connected to one application signal line Yn_r connects the application output line Xm to the anode electrode 43 of the k-th organic light emitting element 31 through the TFT circuit output connecting portion 42. For this reason, the electric potential VkB of the anode electrode 43 of the k-th first-color organic light emitting element 311 and the electric potential VkG of the anode electrode 43 of the k-th second-color organic light emitting element 312 become the application power Vref.

At time t2, the driver IC 18 sets the n-th application signal Yn_r and the application selection signal Vrst to the Off state. In a case where the application selection signal Vrst is in the Off state, the second switch 292 blocks the application output line Xm from the application power Vref. In a case where the application signal line Yn_r is in the On state, the application TFT 28 blocks the application output line Xm from the TFT circuit output connecting portion 42.

At time t3, the driver IC 18 sets the n-th scan signal Yn and the first-color selection signal Vsel_B to the On state. Between the time t2 and the time t3, an interval of about 0.5 microseconds is preferably arranged. The reason for this is that, in a case where the application power Vref is applied to the output terminal of the driver IC 18, there is a possibility that the driver IC 18 is damaged.

In a case where the first-color selection signal Vsel_B is in the On state, the first switch 291B connects the application output line XmB to the m-th image signal line Vdata_m. In a case where the scan signal Yn is in the On state, the switching TFT 26 of the pixel circuit 13 connected to one scan signal line Yn connects the application output line XmB to the gate electrode of the driving TFT 27 and the storage capacitor 99 disposed inside the pixel circuit 13 of the k-th first-color organic light emitting element 311.

As described above, in the timing diagram illustrated in FIG. 29, an image signal Vdata_m representing the emission state is input to the k-th first-color organic light emitting element 311. In accordance with an electric potential difference Vgs between the gate electrode and the source electrode of the driving TFT 27, an output current Ids flows between the source electrode and the drain electrode of the driving TFT 27. According to the output current Ids, the k-th first-color organic light emitting element 311 emits light. In description presented below, the electric potential applied to the anode electrode 43 of the k-th first-color organic light emitting element 311 will be described as α. The electric potential a is electric potential between the positive power supply VDD and the negative power supply VSS and is determined according to the electric potential of the application output line Xm. In addition, in accordance with the electric potential of the application output line XmB, electric charge is stored in the storage capacitor 99.

At time t4, the driver IC 18 sets the first-color selection signal Vsel_B to the Off state. In a case where the first-color selection signal Vsel_B is in the Off state, the first switch 291B blocks the application output line XmB and the m-th image signal line Vdata_m.

At time t5, the driver IC 18 sets the second-color selection signal Vsel_G to the On state. Between time t4 and time t5, it is preferable to arrange an interval of about 0.5 microseconds. The reason for this is to avoid color mixing between the first-color organic light emitting element 311 and the second-color organic light emitting element 312.

In a case where the second-color selection signal Vsel_G is in the On state, the first switch 291G connects the application output line XmG to the m-th image signal line Vdata_m. As described above, in the timing diagram illustrated in FIG. 29, an image signal Vdata_m representing the non-emission state is input to the k-th second-color organic light emitting element 312. The electric potential difference Vgs between the gate electrode and the source electrode of the driving TFT 27 is small, and an output current Ids between the source electrode and the drain electrode of the driving TFT 27 does not flow. For this reason, the k-th second-color organic light emitting element 312 does not emit light.

At time t6, the driver IC 18 sets the second-color selection signal Vsel_G to the Off state. In a case where the second-color selection signal Vsel_G is in the Off state, the first switch 291G blocks the application output line XmG and the m-th image signal line Vdata_m.

At time t7, the driver IC 18 sets the third-color selection signal Vsel_R to the On state. Between time t6 and time t7, it is preferable to arrange an interval of about 0.5 microseconds. The reason for this is to avoid color mixing between the second-color organic light emitting element 312 and the third-color organic light emitting element 313.

In a case where the third-color selection signal Vsel_R is in the On state, the first switch 291R connects the application output line XmR to the m-th image signal line Vdata_m. According to the image signal Vdata_m, the k-th third-color organic light emitting element 313 is in the emission state or the non-emission state.

At time t8, the driver IC 18 sets the third-color selection signal Vsel_R to the Off state. In a case where the third-color selection signal Vsel_R is in the Off state, the first switch 291R blocks the application output line XmR and the m-th image signal line Vdata_m.

A period from time t3 to time t4 is an example of a first period according to this embodiment in which electric potential according to the image signal is applied to the pixel circuit 13 of the k-th first-color organic light emitting element 311. In addition, a period from time t5 to time t6 is an example of the first period according to this embodiment in which electric potential according to the image signal is applied to the pixel circuit 13 of the k-th second-color organic light emitting element 312. Furthermore, a period from time t7 to time t8 is an example of the first period according to this embodiment in which electric potential according to the image signal is applied to the pixel circuit 13 of the k-th third-color organic light emitting element 313.

At time t9, the driver IC 18 sets the scan signal Yn to the Off state. Between time t8 and time t9, it is preferable to arrange an interval of about 1.6 microseconds. The reason for this is to wait for the stabilization of the output of the demultiplexer unit 152.

In a case where the scan signal Yn is in the Off state, the switching TFT 26 of the pixel circuit 13 connected to one scan signal line Yn operates. As the switching TFT 26 operates, the application output line XmB and the gate electrode of the driving TFT 27 and the storage capacitor 99 disposed inside the pixel circuit 13 of the k-th first-color organic light emitting element 311 are blocked. Similarly, as the switching TFT 26 operates, the application output line XmG and the gate electrode of the driving TFT 27 and the storage capacitor 99 disposed inside the pixel circuit 13 of the k-th second-color organic light emitting element 312 are blocked. While a circuit diagram and a timing diagram are not illustrated, similarly, as the switching TFT 26 operates, the application output line XmR and the gate electrode of the driving TFT 27 and the storage capacitor 99 disposed inside the pixel circuit 13 of the k-th third-color organic light emitting element 313 are blocked.

The driver IC 18 completes the input of image signals to a plurality of organic light emitting elements 31 included in the n-th scanning line from time t1 to time t9. Thereafter, the driver IC 18 repeats the same operation for scanning lines corresponding to one screen, thereby displaying an image corresponding to one screen at the display unit 30.

At time t21, the driver IC 18 sets the n-th application signal Yn_r and the application selection signal Vrst to the On state. In a case where the application selection signal Vrst is in the On state, the second switch 292 connects the application output line Xm to the application power line Vref. The application TFT 28 of the pixel circuit 13 connected to one application signal line Yn_r connects the application output line Xm to the anode electrode 43 of the k-th organic light emitting element 31 through the TFT circuit output connecting portion 42. For this reason, the electric potential VkR of the anode electrode 43 of the k-th first-color organic light emitting element 311 and the electric potential VkG of the anode electrode 43 of the k-th second-color organic light emitting element 312 have the same electric potential as that of the application power Vref.

A period from time t4 to time t21 is an example of a second period according to this embodiment. The control unit according to this embodiment, based on the electric potential applied to the pixel circuit 13 for the first period, controls the emission luminance of the k-th first-color organic light emitting element 311 by means of the control element according to the embodiment of the present disclosure within the second period.

In other words, the driver IC 18 controls the k-th first-color organic light emitting element 311 to be in the emission state for the second period starting from time t4 and ends at time t21.

In addition, a period from time t6 to time t21 is an example of the second period according to this embodiment. The control unit according to this embodiment, based on the electric potential applied to the pixel circuit 13 for the first period, controls the emission luminance of the k-th second-color organic light emitting element 312 by means of the control element according to the embodiment of the present disclosure within the second period.

Furthermore, a period from time t9 to time t21 is an example of the second period according to this embodiment. The control unit according to this embodiment, based on the electric potential applied to the pixel circuit 13 for the first period, controls the emission luminance of the k-th third-color organic light emitting element 313 by means of the control element according to the embodiment of the present disclosure within the second period.

The application unit 15 applies the application power Vref lower than the negative power supply VSS that is the electric potential of the cathode electrode 19 to the anode electrode 43 for a period from time t1 to time t2 before the start of the second period.

Thereafter, the driver IC 18 repeats a similar operation after time t2, thereby displaying an image corresponding to a next one screen at the display unit 30.

For a period from time t2 to time t21, the electric potential of the anode electrode 43 of the k-th first-color organic light emitting element 311 is maintained according to the electric charge stored in the storage capacitor 99. In this way, the k-th first-color organic light emitting element 311 continues to emit light. During an emission period, some of holes supplied from the storage capacitor 99 to the common layer 47 through the anode electrode 43 form a leaking current A and flow into the common layer 47 of the k-th second-color organic light emitting element 312. However, the leaking current A is much smaller than a current flowing through the k-th first-color organic light emitting element 311. For this reason, the influence of the leaking current A on the emission state of the k-th first-color organic light emitting element 311 can be nearly ignored.

After the electric potential of the application power Vref is applied to the anode electrode 43 of the k-th second-color organic light emitting element 312 between time t1 to time t2, the anode electrode is blocked from the other circuits for a period up to time t21. The holes flowing into the common layer 47 in accordance with the leaking current A recombine with the electrons maintained in the anode electrode 43 and disappear. For this reason, the holes flowing into the common layer 47 in accordance with the leaking current A do not arrive at the light emitting layer 44. Accordingly, a crosstalk in which the k-th second-color organic light emitting element 312 emits light in accordance with a leaking current does not occur.

As represented in VkG of FIG. 29, over time t2 to time t21, as the holes flowing in accordance with the leaking current A disappear, the electric potential VkG of the anode electrode 43 of the k-th second-color organic light emitting element 312 that is in the non-emission state gradually rises. However, since electric potential VkG maintains electric potential lower than the negative voltage VSS, holes do not flow into the light emitting layer 44 to emit light.

A case will be described in which display data having low luminance close to black is input to the k-th second-color organic light emitting element 312. Similar to the description presented with reference to FIG. 21, a case will be described as an example in which a leaking current A flows into the k-th second-color organic light emitting element 312 from an adjacent organic light emitting element. In a case where the leaking current A is relatively large to be unignorable, compared to a current flowing into the anode electrode 43 of the k-th second-color organic light emitting element 312 for light emission, a crosstalk in which light is emitted with a luminance value higher than a luminance value to be originally displayed occurs. However, in the case of this embodiment, at least at a time point at which light emission is started, the k-th second-color organic light emitting element 312 emits light with correct luminance without being influenced by the leaking current A. In this way, according to the display device 10 of this embodiment, there is an effect of suppression of a crosstalk also for low-luminance display data other than black.

According to this embodiment, the number of output lines output from the driver IC 18 can be decreased to ⅓.

Embodiment 9

This embodiment relates to a display device 10 having an external compensation function. The external compensation function is a function for compensating an image displayed at the display unit 30 by using signals used for compensating display unevenness, degradation of the organic light emitting element 31, and the like.

Figure 30:
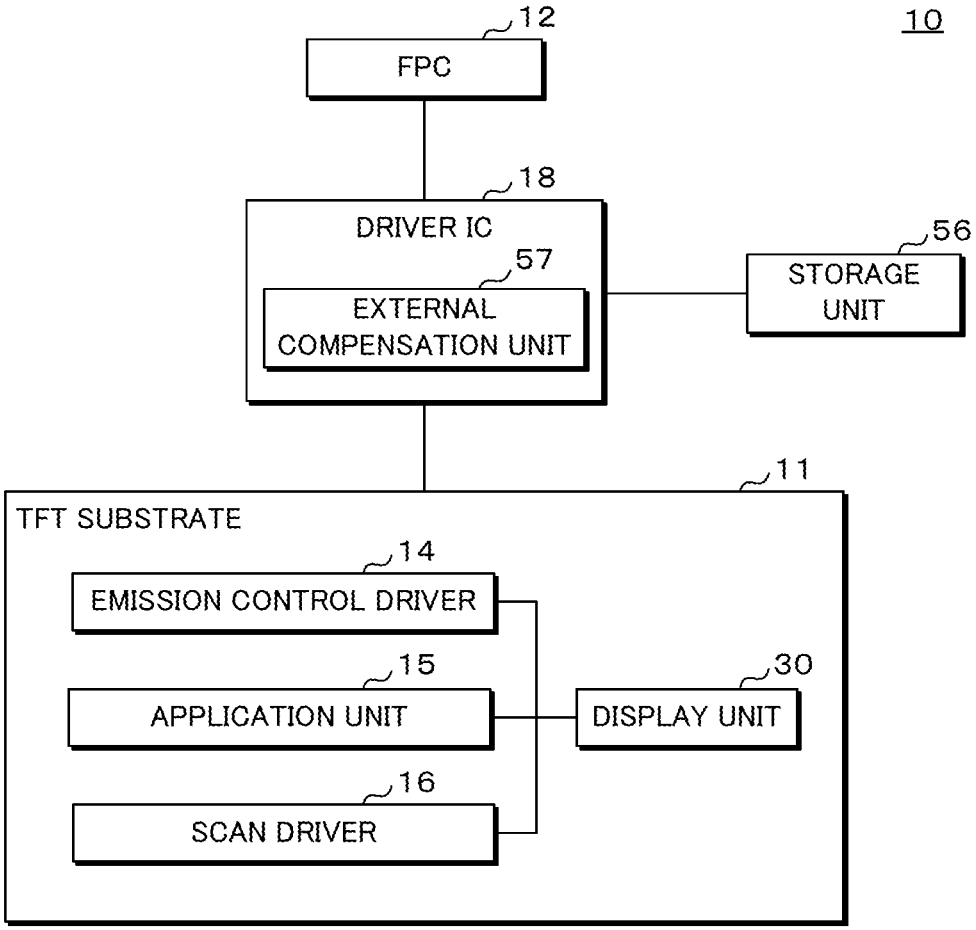
FIG. 30 is a diagram that illustrates the configuration of a display device according to Embodiment 9.

FIG. 30 is a diagram that illustrates the configuration of the display device 10 according to Embodiment 9. The display device 10 according to this embodiment will be described with reference to FIG. 30. Description of parts that are common to Embodiment 1 will not be presented.

The display device 10 includes: an FPC 12; a TFT substrate 11; a driver IC 18; and a storage unit 56. The driver IC 18 includes an external compensation unit 57. A driver IC 18 is connected between the FPC 12 and the TFT substrate 11. The storage unit 56 is connected to the driver IC 18.

The driver IC 18 acquires the state of the TFT substrate 11 through a wiring portion 41. The state of the TFT substrate 11, for example, is a characteristic of a pixel circuit 13 acquired by an application TFT 28. The characteristic of the pixel circuit 13, for example, reflects a deviation of the characteristic of the organic light emitting element 31, the state of degradation of the organic light emitting element 31, and the like.

The driver IC 18 acquires an image signal through the FPC 12. The driver IC 18 processes an acquired image signal and outputs a processed image signal to an emission control driver 14, an application unit 15, and a scan driver 16 of the TFT substrate 11. At this time, in accordance with the state of the TFT substrate 11, the driver IC 18 adjusts signals to be output to the TFT substrate 11. The emission control driver 14, the application unit 15, and the scan driver 16 controls a display unit 30.

Figure 31:
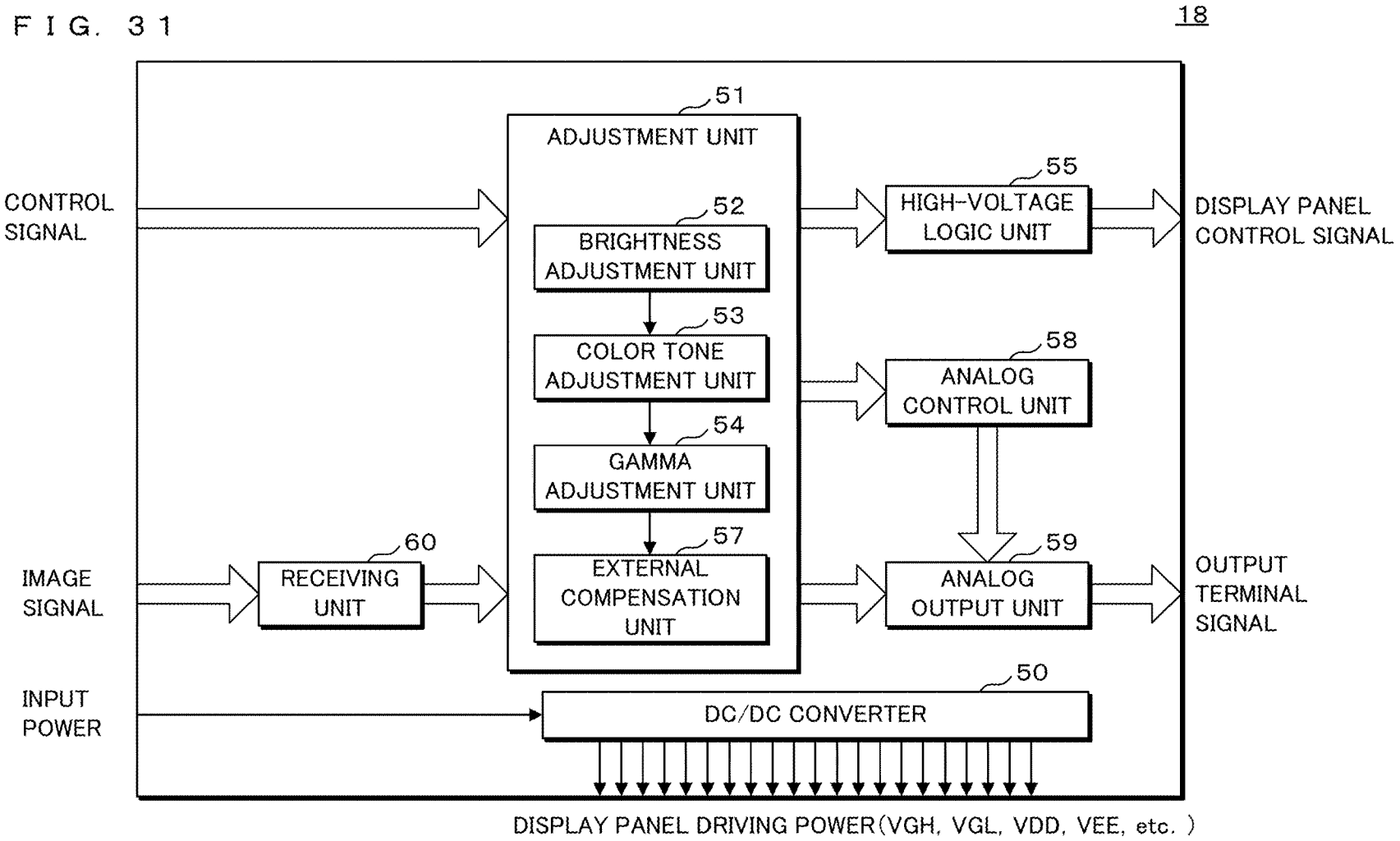
FIG. 31 is a diagram that illustrates the configuration of a driver IC according to Embodiment 9.

FIG. 31 is a diagram that illustrates the configuration of the driver IC 18 according to Embodiment 9. The configuration of the driver IC 18 will be described in more detail with reference to FIG. 31. The driver IC 18 includes: an adjustment unit 51; a receiving unit 60; a high-voltage logic unit 55; an analog control unit 58, an analog output unit 59; and a DC/DC converter 50. The adjustment unit 51 is a low-voltage logic circuit that can operate at a high speed. The adjustment unit 51 includes: a brightness adjustment unit 52; a color tone adjustment unit 53; a gamma adjustment unit 54; and an external compensation unit 57. The brightness adjustment unit 52, the color tone adjustment unit 53, the gamma adjustment unit 54, and the external compensation unit 57 are respectively realized by a brightness adjustment circuit, a color tone adjustment circuit, a gamma adjustment circuit, and an external compensation circuit.

The operation of the driver IC 18 will be described in more detail. The receiving unit 60 receives an image signal and outputs the received image signal to the adjustment unit 51. The brightness adjustment unit 52, the color tone adjustment unit 53, and the gamma adjustment unit 54 adjust the image signal to a signal according to the characteristic of the display device 10 by sequentially processing the image signal based on control signals.

The external compensation unit 57 adjusts a signal output by the gamma adjustment unit 54 based on the state of the TFT substrate 11, a table not illustrated in the drawing, and the like. The table is stored in the storage unit 56 or a memory, which is not illustrated in the drawing, disposed inside the driver IC 18. The external compensation unit 57, for example, adjusts a signal such that the threshold voltage Vth of the driving TFT 27 is compensated.

The adjustment unit 51 outputs an image signal adjusted by the external compensation unit 57 to the high-voltage logic unit 55, the analog control unit 58, and the analog output unit 59.

According to this embodiment, the display device 10 capable of compensating image unevenness, the degradation of the organic light emitting element 31, and the like by using the characteristic of the pixel circuit 13 acquired by using the application TFT 28 can be provided.

Embodiment 10

Figure 32:
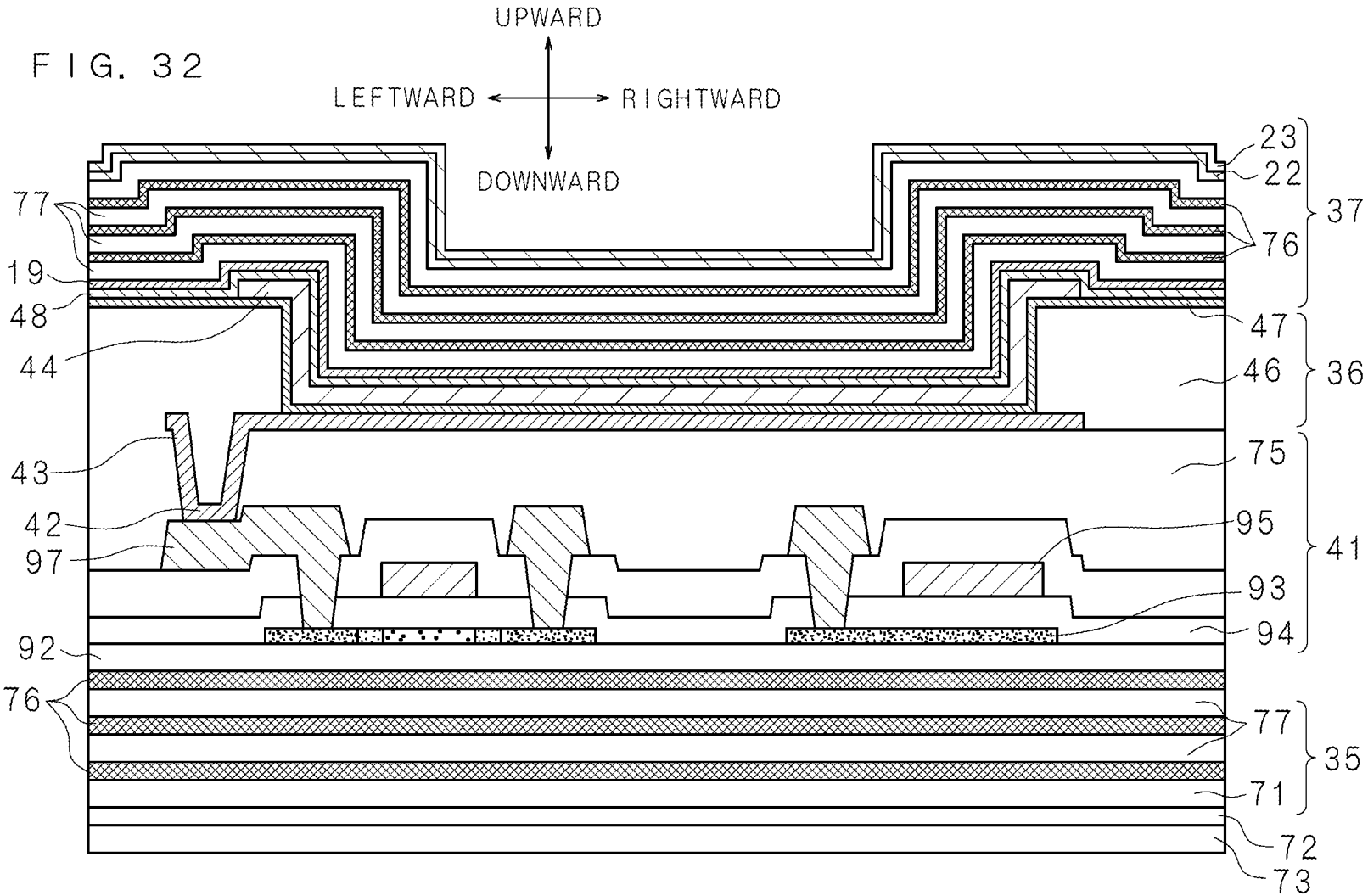
FIG. 32 is a schematic cross-sectional view of a display device 10 according to Embodiment 10.

This embodiment relates to a display device 10 the can be bent. FIG. 32 is a schematic cross-sectional view of the display device 10 according to Embodiment 10. The display device 10 according to this embodiment will be described with reference to FIG. 32. Description of parts that are common to Embodiment 1 will not be presented.

FIG. 32 schematically illustrates a cross-sectional view of a portion of the display device 10, which is in the middle of a manufacturing process, including one organic light emitting element 31 taken along a face vertical to a face in which an image is displayed. The display device 10 includes: a support portion 35, a wiring portion 41, a light emitting portion 36, and a protection portion 37. On the rear side of the support portion 35, a support substrate 73 made of glass is fixed through a peeling layer 72. The peeling layer 72 and the support substrate 73 are detached from the support portion 35 before the completion of the display device 10.

The support portion 35 includes: a flexible substrate 71; an organic film 77; and an inorganic thin film 76. On the rear-most side of the support portion 35, the flexible substrate 71 is present, and the organic film 77, the inorganic thin film 76, the organic film 77, the inorganic thin film 76, the organic film 77, and the inorganic thin film 76 are sequentially laminated over the front side thereof. The flexible substrate 71 is a flexible wiring member in which an insulating film of polyimide or the like and a circuit pattern made of copper are laminated. The flexible substrate 71 may be integrated with the FPC 12. The inorganic thin film 76, for example, is a silicon thin film. The organic film 77, for example, is formed using polyimide.

The wiring portion 41 includes: an underlying insulating film 92; a polysilicon layer 93; a gate insulting film 94; a first metal layer 95; an interlayer insulating film 96; a second metal layer 97; and a flattening layer 75. The light emitting portion 36 includes: an anode electrode 43; an isolation portion 46; a common layer 47; a light emitting layer 44; a cathode underlayer 48; and a cathode electrode 19.

The protection portion 37 includes: an organic film 77; an inorganic thin film 76; a ¼ wavelength phase difference plate 22; and a polarizing plate 23. In the protection portion 37, over the front side of the cathode electrode 19, an organic film 77, an inorganic thin film 76, an organic film 77, an inorganic thin film 76; an organic film 77, an inorganic thin film 76, and an organic film 77 are sequentially laminated, and, over the front side thereof, the ¼ wavelength phase difference plate 22 and the polarizing plate 23 are laminated.

The organic films 77 and the inorganic thin films 76 laminated over the front side and the rear side prevent the degradation of the light emitting layer 44 due to permeation of moisture and oxygen.

According to this embodiment, the display device 10 capable of bending the display unit 30 into a curved face can be provided.

Embodiment 11

Figure 33:
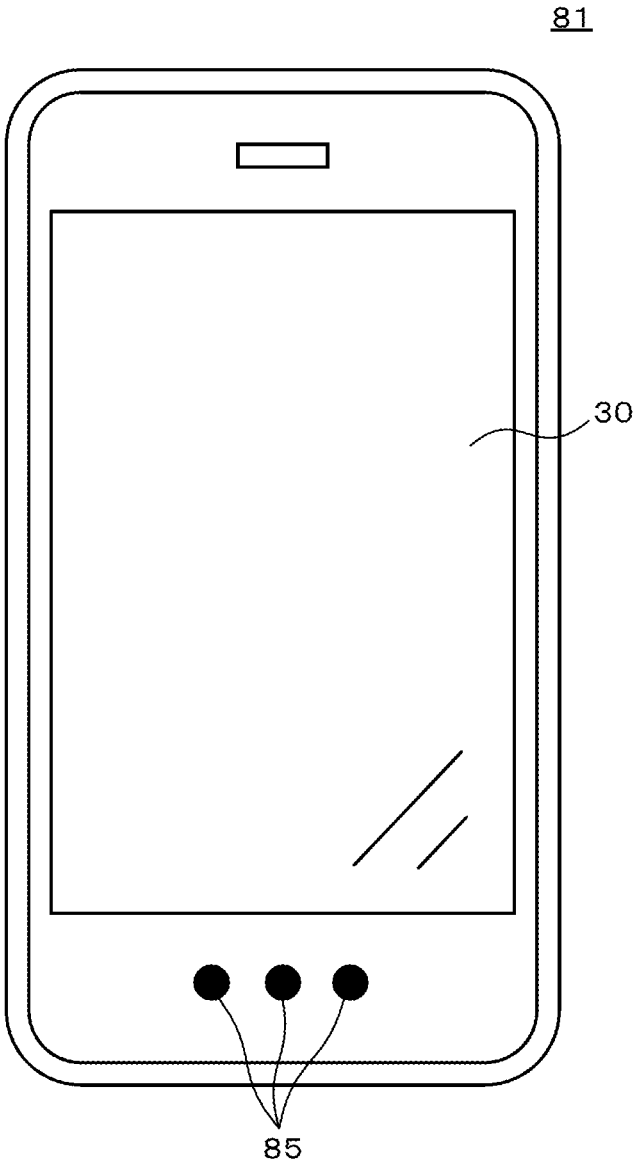
FIG. 33 is an external view of an electronic apparatus according to Embodiment 11.

This embodiment relates to an electronic apparatus in which the display device 10 is built. FIG. 33 is an external view of an electronic apparatus according to Embodiment 11. The configuration of this embodiment will be described with reference to FIG. 33. Description of parts that are common to Embodiment 1 will not be presented.

The electronic apparatus according to this embodiment is a smartphone 81. The smartphone 81 has the shape of a rectangular flat plate and includes the display unit 30 at one surface. At the periphery of the display unit 30, input buttons 85 are disposed. In addition, at the display unit 30, a touch panel for receiving user's scanning is disposed. The smartphone 81 has various information processing functions. For example, the smartphone 81 displays information acquired through a network, which is not illustrated in the drawing, connected through wireless communication or wired communication and information processed based on user's input at the display unit 30.

The smartphone illustrated in FIG. 33 is an example of the electronic apparatus in which the display device 10 is built. The display device 10 can be built in an arbitrary electronic apparatus having an image display function.

In addition, technical characteristics (configuration requirements) described in each embodiment may be combined with each other, and new technical characteristics may be formed by combining the same.

It is to be noted that, as used herein and in the appended claims, the singular forms "a", "an", and "the" include plural referents unless the context clearly dictates otherwise.

It is to be noted that the disclosed embodiment is illustrative and not restrictive in all aspects. The scope of the present disclosure is defined by the appended claims rather than by the description preceding them, and all changes that fall within metes and bounds of the claims, or equivalence of such metes and bounds thereof are therefore intended to be embraced by the claims.

What is claimed is:

1. A display device comprising:

a display unit that includes a plurality of pixel circuits each including both an organic light emitting element including a light emitting layer that emits light by a current flowing between an anode electrode and a cathode electrode and a control element controlling the current;

a control unit that applies electric potential according to an image signal to the pixel circuits for a first period, and that controls emission luminance of the organic light emitting elements based on the electric potential by means of the control elements for a second period after the first period; and an application unit that applies a voltage of less than or equal to a threshold voltage of the organic light emitting element to the anode electrode before a start of the second period, wherein the organic light emitting element has internal capacitance to maintain an electric potential difference between the anode electrode, the electric potential of which is applied by the application unit, and the cathode electrode at a voltage of less than or equal to the threshold voltage, for a vertical scanning period in which a displayed image to be refreshed when the control unit controls the organic light emitting element not to emit light.

2. The display device according to claim 1, wherein the application unit applies electric potential that is less than electric potential of the cathode electrode to the anode electrode.

3. The display device according to claim 1, wherein the application unit applies the electric potential to the anode electrode for a period before the first period.

4. The display device according to claim 1, further comprising a common layer that is disposed to be common to a plurality of organic light emitting elements, wherein the cathode electrode, the light emitting layer, the common layer, and the anode electrode are laminated, wherein the common layer injects holes supplied through the anode electrode to the light emitting layer, wherein the cathode electrode is disposed to be common to a plurality of organic light emitting elements, wherein the anode electrode is connected to the control element, and wherein the organic light emitting elements are arranged in a matrix pattern at a predetermined interval.

5. The display device according to claim 4, wherein the internal capacitance of the organic light emitting element is larger than a value acquired by dividing the period in which the display unit displays one screen by a resistance value of the common layer between the organic light emitting element and one organic light emitting element adjacent to the organic light emitting element.

6. The display device according to claim 4, wherein the internal capacitance of the organic light emitting element is larger than a value acquired by dividing the period in which the display unit displays one screen by a combined resistance value acquired by combining resistance values of the common layer between the organic light emitting element and a plurality of organic light emitting elements adjacent to the organic light emitting element.

7. The display device according to claim 1, wherein the display unit has a rectangular shape, and wherein the application unit, after signals controlling luminance are input to a group of organic light emitting elements along a scanning line from the control unit, before signals controlling luminance are input to a group of organic light emitting elements along a next scanning line from the control unit, applies electric potential to the anode electrodes of the group of organic light emitting elements along the next scanning line.

8. The display device according to claim 5, wherein a shape of the organic light emitting element has at least four sides, and wherein an arrangement of the organic light emitting elements, a thickness of the common layer, and the internal capacitance satisfy Equation (1), $$\frac{\rho \times D \times Coled}{T \times W} > Fr \tag{1}$$

Here, ρ is resistivity of the common layer,

T is a thickness of the common layer between a first organic light emitting element and a second organic light emitting element adjacent to the first organic light emitting element, D is a distance between the first organic light emitting element and the second organic light emitting element, W is a length of a portion in which a first side of the first organic light emitting element that faces the second organic light emitting element and a second side of the second organic light emitting element that faces the first side face each other, Coled is internal capacitance of the first organic light emitting element, Fr is a vertical scanning period in which the displayed image to be refreshed.

9. The display device according to claim 5, wherein a shape of the organic light emitting element has at least four sides, and wherein an arrangement of the organic light emitting elements, a thickness of the common layer, and the internal capacitance satisfy Equation (2), $$\min\left(\frac{\rho n \times Dn}{Tn \times Wn}\right) \times Coled > Fr \tag{2}$$

Here, n is an integer of one to four,

ρn is resistivity of the common layer between a first organic light emitting element and an n-th organic light emitting element adjacent to the first organic light emitting element at the n-th side of the first organic light emitting element, Tn is a thickness of the common layer between the first organic light emitting element and the n-th organic light emitting element, Dn is a distance between the n-th side of the first organic light emitting element and the n-th organic light emitting element, Wn is a length of a portion in which the n-th side of the first organic light emitting element and a side of the n-th organic light emitting element that faces the n-th side face each other, Coled is internal capacitance of the first organic light emitting element, Fr is a vertical scanning period in which the displayed image to be refreshed.

10. The display device according to claim 5, wherein a shape of the organic light emitting element has at least four sides, and wherein an arrangement of the organic light emitting elements, a thickness of the common layer, and the internal capacitance satisfy Equation (3), $$\frac{1}{\sum_{n=1}^{4} \frac{1}{\left(\frac{\rho n \times Dn}{Tn \times Wn}\right)}} \times Coled > Fr \tag{3}$$

Here, ρn is resistivity of the common layer between the first organic light emitting element and the n-th organic light emitting element adjacent to the first organic light emitting element at the n-th side of the first organic light emitting element, Tn is a thickness of the common layer between the first organic light emitting element and the n-th organic light emitting element, Dn is a distance between the n-th side of the first organic light emitting element and the n-th organic light emitting element, Wn is a length of a portion in which the n-th side of the first organic light emitting element and a side of the n-th organic light emitting element that faces the n-th side face each other, Coled is internal capacitance of the organic light emitting element, Fr is a vertical scanning period in which the displayed image to be refreshed.

11. The display device according to claim 5, wherein the display unit includes organic light emitting elements arranged in a matrix pattern, wherein a shape of the organic light emitting element is a rectangle, and wherein an arrangement of the organic light emitting elements, a thickness of the common layer, and the internal capacitance satisfy Equation (4), $$\frac{1}{\sum_{n=1}^{2} \frac{1}{\left(\frac{\rho n \times Dn}{Tn \times Wn}\right)}} \times Coled > Fr \tag{4}$$

ρn is resistivity of the common layer between a first organic light emitting element and an n-th organic light emitting element adjacent to the first organic light emitting element at an n-th long side of the first organic light emitting element, Tn is a thickness of the common layer between the first organic light emitting element and the n-th organic light emitting element, Dn is a distance between the n-th long side of the first organic light emitting element and the n-th organic light emitting element, Wn is a length of a portion in which the n-th long side of the first organic light emitting element and a side of the n-th organic light emitting element that faces the n-th long side face each other, Coled is internal capacitance of the first organic light emitting element, Fr is a vertical scanning period in which the displayed image to be refreshed.

12. The display device according to claim 1, wherein the display unit has a rectangular shape, wherein the control unit controls luminance of the organic light emitting element for each scanning line along one side of the display unit, wherein the control unit includes:

a first switching unit that switches the scanning line; and a second switching unit that connects the organic light emitting element and the application unit together for a period in which the control unit does not input a signal to the organic light emitting element in synchronization with the first switching unit.

13. The display device according to claim 12, wherein the first switching unit blocks a connection between the organic light emitting element and the control unit for a period in which the organic light emitting element and the application unit are connected together and for a predetermined time after the connection is blocked, and wherein the second switching unit blocks a connection between the organic light emitting element and the application unit for a period in which the organic light emitting element and the control unit are connected together and for a predetermined period after the connection is blocked.

14. The display device according to claim 1, wherein the display unit includes a plurality of pixels arranged in a matrix pattern, wherein each of the pixels includes the organic light emitting elements of three colors, wherein the control unit controls the luminance of the organic light emitting elements for each scanning line along the matrix, and wherein the control unit includes:

a distributor that distributes and inputs the signal to the organic light emitting elements included in the each of the pixels;

a first switching unit that switches the scanning line; and a second switching unit that connects the organic light emitting element and the application unit together for a period in which the distributor does not input a signal to the organic light emitting element in synchronization with the first switching unit.

15. The display device according to claim 14, wherein the first switching unit blocks a connection between the organic light emitting element and the distributor for a period in which the organic light emitting element and the application unit are connected together and for a predetermined period after the connection is blocked, and wherein the second switching unit blocks a connection between the organic light emitting element and the application unit for a period in which the organic light emitting element and the distributor are connected together and for a predetermined period after the connection is blocked.

16. The display device according to claim 1, wherein the application unit has a function of an external compensation circuit compensating a signal used for controlling the luminance of the organic light emitting element from the outside.

* * * * *